US006360656B2

(12) United States Patent
Kubo et al.

(10) Patent No.: US 6,360,656 B2
(45) Date of Patent: Mar. 26, 2002

(54) APPARATUS FOR AND METHOD OF PRINTING ON THREE-DIMENSIONAL OBJECT

(75) Inventors: Naoki Kubo, Nishinomiya; Jun Koreishi, Amagasaki; Hideaki Nakanishi, Osaka, all of (JP)

(73) Assignee: Minolta Co., Ltd., Mishima-Gun (JP)

( * ) Notice: Subject to any disclaimer, the term of this patent is extended or adjusted under 35 U.S.C. 154(b) by 0 days.

(21) Appl. No.: 09/793,761

(22) Filed: Feb. 27, 2001

(30) Foreign Application Priority Data

Feb. 28, 2000 (JP) ..... 2000-051447
Mar. 22, 2000 (JP) ..... 2000-080191

(51) Int. Cl.[7] ..... B41F 17/00

(52) U.S. Cl. ..... 101/35; 400/76; 400/70; 400/61

(58) Field of Search ..... 101/35; 400/61, 400/70, 76

(56) References Cited

U.S. PATENT DOCUMENTS 5,831,641 A * 11/1998 Carlson ..... 347/2
6,096,132 A * 8/2000 Kaiba et al. ..... 118/680

FOREIGN PATENT DOCUMENTS

JP 9-193368 7/1997
JP 10-58668 3/1998

* cited by examiner

*Primary Examiner*—John S. Hilten
*Assistant Examiner*—Charles H. Nolan, Jr.
(74) *Attorney, Agent, or Firm*—McDermott, Will & Emery

(57) ABSTRACT

A three-dimensional object printing apparatus according to the present invention comprises: a shape recognition section for obtaining three-dimensional shape data about a surface shape of a three-dimensional object by measurement or the like; an ejection section for ejecting ink toward the three-dimensional object; a scanning section for causing the ejection section to scan relative to the three-dimensional object; and a control section for controlling an operation of the ejection section and/or the scanning section in accordance with information about inclination of the surface of the three-dimensional object, the information being indicated in the data obtained by the shape recognition section. The printing apparatus performs printing in accordance with the information obtained by measurement on the surface inclination of the object to achieve a high-quality printing process. More specifically, a mode of operation is determined for each of a main scanning direction and a sub-scanning direction in accordance with an inclination angle of an inclined surface with respect to each of the main scanning direction and the sub-scanning direction. The printing operation is performed based on the mode of operation.

39 Claims, 35 Drawing Sheets

MAIN SCANNING DIRECTION

APPARATUS FOR AND METHOD OF PRINTING ON THREE-DIMENSIONAL OBJECT

This application is based on applications Nos. 2000-51447 and 2000-80191 filed in Japan, the contents of which are hereby incorporated by reference.

BACKGROUND OF THE INVENTION

1. Field of the Invention

The present invention relates to an apparatus for and method of printing on a three-dimensional object.

2. Description of the Background Art

A printing apparatus which ejects ink onto printing paper by an ink jet technique to print a desired image and the like is conventionally known. In such a printing apparatus, an ejection head expels ink while continuously moving in a main scanning direction. Upon completion of printing of one line in the main scanning direction, the ejection head is moved a fixed distance in a sub-scanning direction orthogonal to the main scanning direction, and starts the next printing operation in the main scanning direction.

An attempt has been made to print on a three-dimensional object by using the technique of ejecting ink such as the ink jet technique.

However, printing by ejecting droplets of ink from the ejection head onto the three-dimensional object has a problem such that the density of dots changes with the surface shape of the object. More specifically, printing on a portion of the object which has a near-horizontal surface, like the printing on a surface of printing paper and the like, provides a high-density dot distribution, whereas printing on an inclined surface of the object results in a dot distribution which is sparse depending on the angle of inclination of the inclined surface.

FIGS. 36A and 36B show a conventional printing method for illustration of the above-mentioned phenomenon. FIG. 36A shows a dot distribution when printed on a horizontal surface, and FIG. 36B shows a dot distribution when printed on an inclined surface. For printing on a three-dimensional object, a conventional printing apparatus moves the ejection head stepwise every fixed distance in the sub-scanning direction, independently of whether a to-be-printed portion of the object has a horizontal surface or an inclined surface. The fixed distance is set at a distance d which provides a dense distribution of dots printed on the horizontal surface, as shown in FIG. 36A. Thus, when the to-be-printed portion of the object has an inclined surface at an inclination angle $\theta$ with respect to the sub-scanning direction, the movement of the fixed distance d of the ejection head in the sub-scanning direction as shown in FIG. 36B causes a dot-to-dot spacing on the inclined surface to equal $d/\cos\theta$, resulting in a sparse dot distribution.

This phenomenon also occurs in the main scanning direction in which the ejection head continuously moves. However, the problem of the above-mentioned phenomenon in the main scanning direction in which the ejection head continuously moves is relatively easily overcome by controlling the timing of ejection of ink from the ejection head or otherwise.

On the other hand, since the ejection head is driven stepwise in the sub-scanning direction after the continuous printing in the main scanning direction, the problem of the above-mentioned phenomenon in the sub-scanning direction is not overcome by merely controlling the timing of ink ejection.

To solve the above-mentioned problem in the case where the object is inclined with respect to the sub-scanning direction, it is contemplated to incline the ejection head in accordance with the inclined surface so that the ink is always ejected in a direction normal to the inclined surface to perform sub-scanning through the fixed distance d along the inclined surface. Such an arrangement, however, increases the complexity of driving mechanisms and operational control, and accordingly increases the size of the apparatus.

For a printing apparatus for printing on a two-dimensional object (e.g., printing paper), there has been no need to consider the surface shape of the object which is constant or flat. However, for printing on the three-dimensional object, it is necessary to consider the three-dimensional shape of the object to achieve proper printing.

In many of the printing apparatuses for printing on the two-dimensional object (e.g., printing paper), a slight positional deviation of the printing paper does not become a problem. However, for printing on the three-dimensional object, a positional deviation of the object results in improper printing. For example, when applying different colors to two adjacent faces bordered by an edge, there is a problem such that a deviation of the coloring position is very conspicuous to result in remarkable deterioration of a print quality.

Thus, the printing on a three-dimensional object is required to take the three-dimensional shape of the object into consideration to provide a high print quality.

SUMMARY OF THE INVENTION

The present invention is intended for an apparatus for providing ink to a surface of a three-dimensional object. According to a first aspect of the present invention, the apparatus comprises: a shape recognition section for obtaining data about a surface shape of a three-dimensional object; an ejection section for ejecting ink toward the three-dimensional object; a scanning section for causing the ejection section to scan relative to the three-dimensional object; and a control section for controlling an operation of the ejection section and/or the scanning section in accordance with information about inclination of the surface of the three-dimensional object, the information being indicated in the data obtained by the shape recognition section.

Thus, the operation of the ejection section and/or the scanning section is controlled in accordance with the information about the surface inclination of the three-dimensional object, the information being indicated in the data obtained by the shape recognition section. Therefore, the apparatus can perform a high-quality printing process.

According to a second aspect of the present invention, in the apparatus of the first aspect, the scanning section performs a plurality of continuous main scanning operations in a predetermined operations, and repeats a sub-scanning operation for each of the continuous main scanning direction. The operation of the scanning section controlled by the control section is the sub-scanning operation.

Thus, the operation of the scanning section controlled by the control section is the sub-scanning operation. Therefore, the apparatus can provide a uniform distribution of dots of ink in the sub-scanning direction when printing on the three-dimensional object.

According to a third aspect of the present invention, in the apparatus of the first aspect, the ejection section comprises a plurality of nozzles for ejecting ink, and the operation of the ejection section controlled by the control section is to make a predetermined one of the plurality of nozzles available or unavailable.

Thus, the predetermined one of the plurality of nozzles is made available or unavailable. Therefore, the apparatus can eject ink within tolerance of a target position on the object.

According to a fourth aspect of the present invention, in the apparatus of the first aspect, the shape recognition section comprises a sensor for measuring the surface shape of the three-dimensional object to obtain the data about the surface shape of the three-dimensional object. The sensor is caused to scan the surface of the three-dimensional object along with the ejection section by the scanning section in order to determine the height of a predetermined point on the surface of the three-dimensional object with respect to a predetermined reference plane.

Thus, the shape recognition section comprises the sensor for measuring the surface shape of the three-dimensional object to obtain the data about the surface shape of the three-dimensional object. The sensor is caused to scan the surface of the three-dimensional object along with the ejection section by the scanning section in order to determine the height of the predetermined point on the surface of the three-dimensional object with respect to the predetermined reference plane. Therefore, the apparatus can efficiently obtain the data about the surface shape of the three-dimensional object.

According to a fifth aspect of the present invention, the control section moves the ejection section stepwise every fine pitch in the sub-scanning direction, and controls the main scanning section to effect main scanning at a position at which the amount of movement of the ejection section in the sub-scanning direction equals a travel pitch.

Thus, the control section moves the scanning section stepwise every fine pitch in the sub-scanning direction, and controls the main scanning section to effect main scanning at the position at which the amount of movement of the ejection section in the sub-scanning direction equals the travel pitch. This achieves efficient printing.

It is an object of the present invention to provide an apparatus for and method of printing which can print on a three-dimensional object with high quality.

It is another object of the present invention to provide an apparatus for and method of printing which can constantly provide a uniform distribution of dots of ink particularly when printing on a three-dimensional object.

These and other objects, features, aspects and advantages of the present invention will become more apparent from the following detailed description of the present invention when taken in conjunction with the accompanying drawings.

BRIEF DESCRIPTION OF THE DRAWINGS

FIG. 6B shows printing on an inclined surface at an inclination angle with respect to the main scanning direction;

DESCRIPTION OF THE PREFERRED EMBODIMENTS

Preferred embodiments according to the present invention will now be described in detail with reference to the drawings.

A. First Preferred Embodiment

A1. Overall Construction of Printing Apparatus

Figure 1:
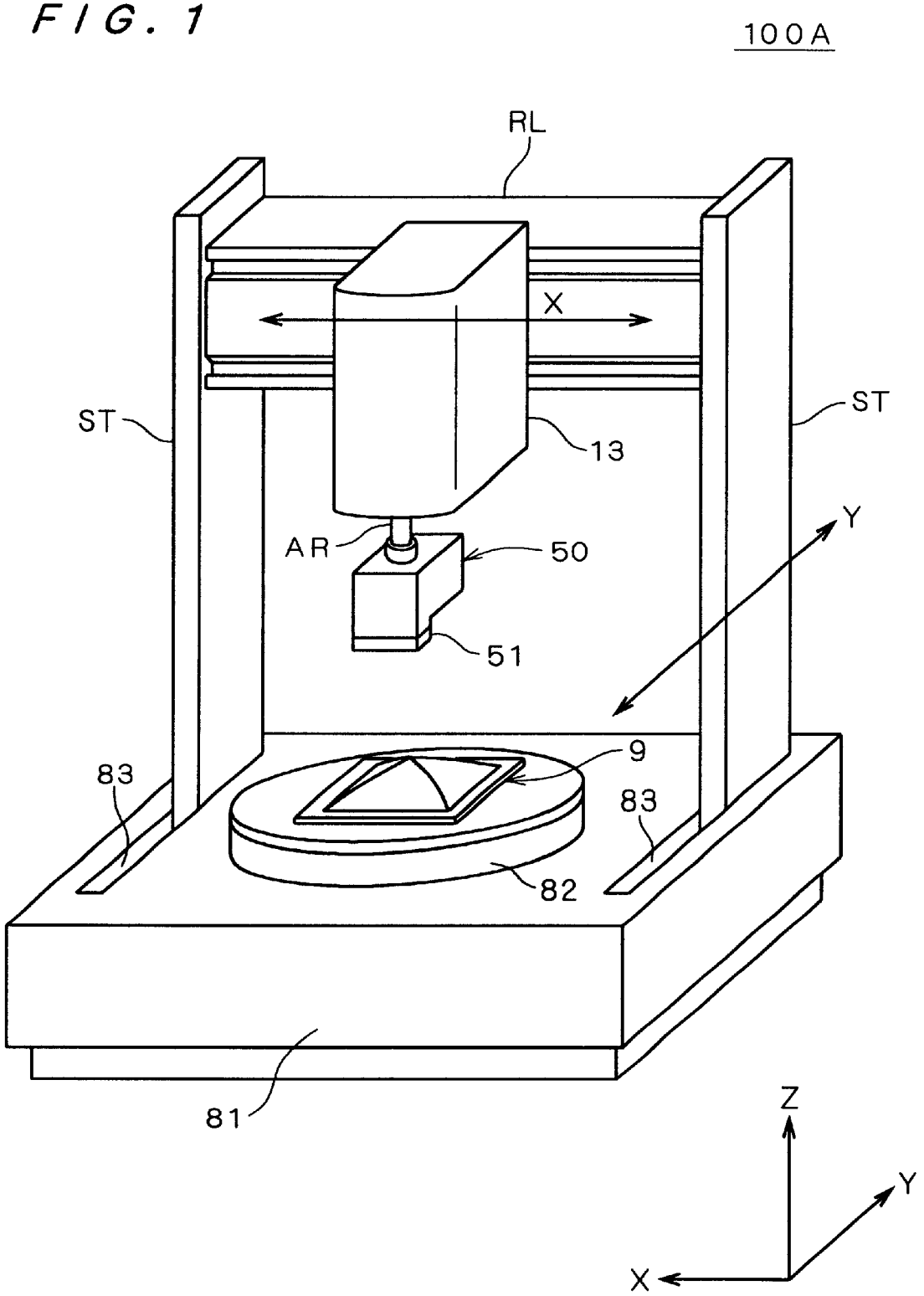
FIG. 1 is an external view of a printing apparatus according to a first preferred embodiment of the present invention.

FIG. 1 is an external view of a printing apparatus 100A according to a first preferred embodiment of the present invention. Three mutually orthogonal axes X, Y and Z are defined as those depicted in FIG. 1 in this preferred embodiment.

The printing apparatus 100A comprises a base plate 81, a stage 82 in a central position on the upper surface of the base plate 81 for placing thereon an object 9 to be printed, and a pair of grooves 83 extending along the Y axis in the base plate 81 outside the stage 82. The pair of grooves 83 receive a pair of stands ST, respectively, which are movable along the grooves 83 (i.e. in the Y direction) by a sub-scanning direction driver 20 (See FIG. 7) provided inside the base plate 81. A rail RL is mounted between upper parts of the respective stands ST, and is provided with a head holding mechanism 13. A main scanning direction driver 10 (See FIG. 7) is provided inside the rail RL. The head holding mechanism 13 is movable along the rail RL (i.e. in the X direction) by the main scanning direction driver 10. An ejection head rotation driver 30 (See FIG. 7) is provided inside the head holding mechanism 13. The head holding mechanism 13 further includes a driver for vertically moving up and down an ejection head 50. The ejection head 50 moves downwardly for printing, and moves upwardly for replacement of the object.

The ejection head 50 is coupled to a lower part of the head holding mechanism 13 via a rotary shaft AR rotatable by the ejection head rotation driver 30. The ejection head 50 has a nozzle unit 51 for ejecting printing ink toward the object 9 by the ink jet technique or the like. A surface of the nozzle unit 51 which is opposed to the object 9 is provided with ejection nozzles for ejecting the ink. An ejection nozzle driver 60 (See FIG. 7) for driving the ejection nozzles is provided inside the ejection head 50. The ejection nozzle driver 60 causes the ejection nozzles to eject the ink toward the object 9. In this preferred embodiment, the ink is ejected vertically downwardly toward the X-Y plane from the ejection nozzles.

Figure 2:
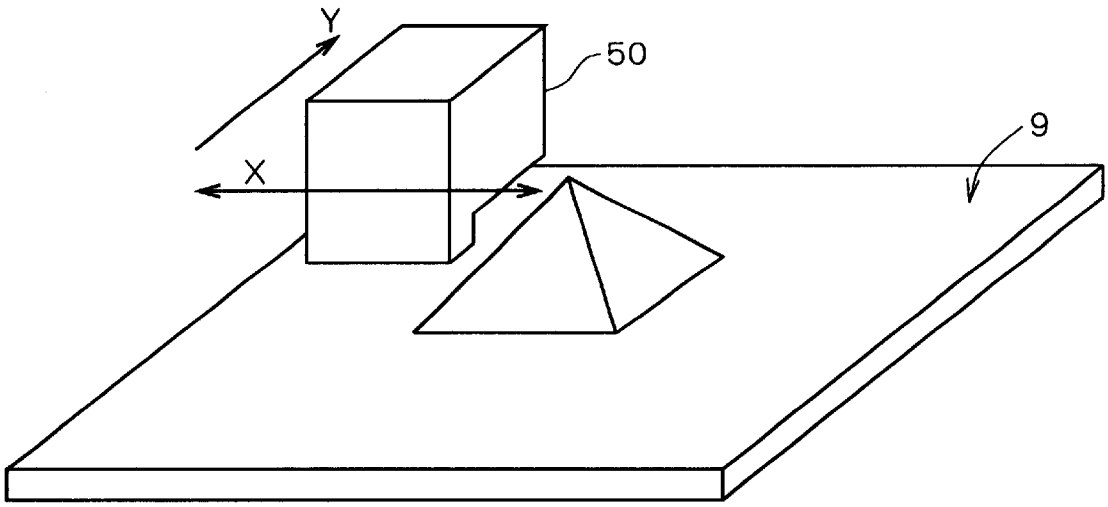
FIG. 2 shows a positional relationship between an ejection head and an object to be printed.

FIG. 2 shows a positional relationship between the ejection head 50 and the object 9. The printing apparatus 100A shown in FIG. 1 performs a printing operation while moving the ejection head 50 relative to the object 9 in the X direction used as a main scanning direction and in the Y direction used as a sub-scanning direction. More specifically, printing one line in the main scanning direction X is done by ejecting ink from the ejection nozzles of the ejection head 50 while continuously moving the ejection head 50 in the main scanning direction X. Upon completion of the one-line printing operation in the main scanning direction X, the ejection head 50 is moved in the sub-scanning direction Y to the next position and starts the next printing operation in the main scanning direction X.

The printing apparatus 100A is designed to control an ink ejection pattern during the movement of the ejection nozzles both in the main scanning direction X and in the sub-scanning direction Y in accordance with an inclination of the object at a position at which a droplet of ink ejected from an ejection nozzle of the ejection head 50 strikes the object (i.e. a position corresponding to the current position of an ejection nozzle of the ejection head 50). This achieves a uniform dot distribution on the object both in the main scanning direction X and in the sub-scanning direction Y.

A2. Ejection Pattern Control in Sub-Scanning Direction Y

Ejection pattern control in the sub-scanning direction Y will be described first.

Figure 3A:
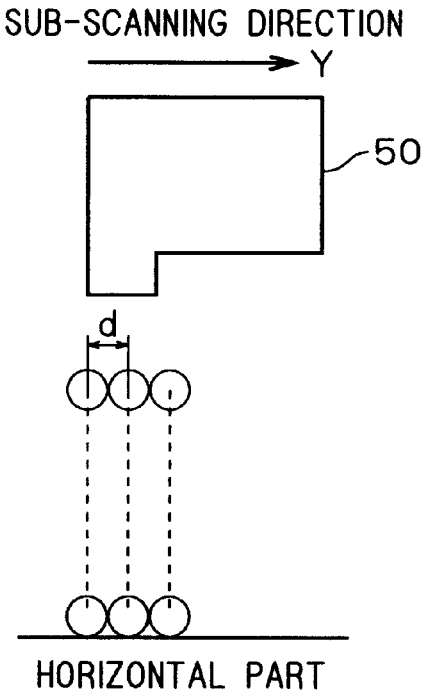
FIGS. 3A and 3B show the principle of providing a uniform dot distribution in a sub-scanning direction, FIG. 3A illustrating printing on a horizontal surface in the sub-scanning direction, FIG. 3B illustrating printing on an inclined surface at an inclination angle with respect to the sub-scanning direction.
Figure 3B:
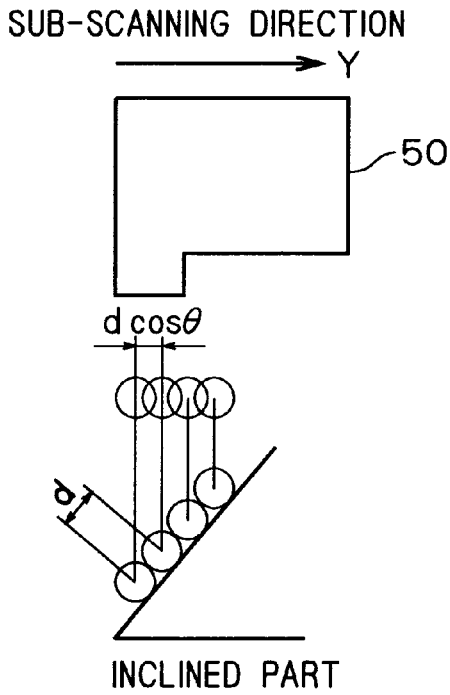

FIGS. 3A and 3B show the principle of providing a uniform dot distribution in the sub-scanning direction Y. FIG. 3A shows printing on a horizontal surface in the sub-scanning direction Y, and FIG. 3B shows printing on an inclined surface at an inclination angle θ with respect to the sub-scanning direction Y. The term "horizontal" used herein means being parallel to the Y axis, and the term "inclined" used herein means not being parallel to the Y axis. The inclination angle θ is the angle of inclination of the surface of the object 9 with respect to a reference plane of measurement (X-Y plane herein).

To provide a dense dot distribution in the sub-scanning direction Y when printing on the horizontal surface of the object 9 as shown in FIG. 3A, the travel distance of the ejection head 50 in the sub-scanning direction Y is set at a distance d as in the conventional manner. As a result, the spacing between dots of ink on the horizontal part of the object 9 equals d. This provides a high-definition printing result.

On the other hand, to provide a dense dot distribution in the sub-scanning direction Y when printing on the inclined surface of the object 9 as shown in FIG. 3B, the travel distance of the ejection head 50 in the sub-scanning direction Y is set at a distance d cos θ depending on the inclination angle θ. Starting the printing operation in the main scanning direction X provides the dot-to-dot spacing which equals d in the sub-scanning direction Y on the inclined surface. This dot-to-dot spacing is equal to the spacing d between the dots printed on the horizontal surface. As a result, a high-definition printing result is obtained also on the inclined surface.

In other words, the printing apparatus 100A features a variable travel distance of the ejection head 50 in the sub-scanning direction Y, and changes the travel distance of the ejection head 50 depending on the inclination with respect to the sub-scanning direction Y when moving the ejection head 50 stepwise in the sub-scanning direction Y. More specifically, when the travel distance in the sub-scanning direction Y is d in the case of printing on the horizontal surface and the inclination angle is θ with respect to the sub-scanning direction, the travel distance of the ejection head 50 in the sub-scanning direction Y is set at d cos θ. This provides the dot-to-dot spacing which equals d in the sub-scanning direction Y independently of the surface shape of the object 9, thereby achieving a uniform dot distribution.

Figure 4A:
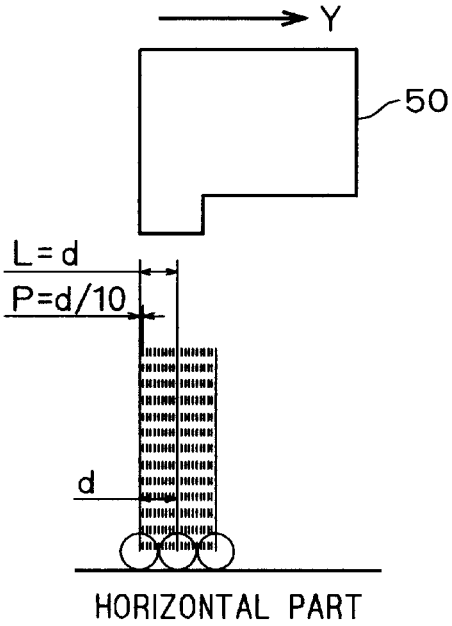
FIGS. 4A, 4B, 4C and 4D show a specific driving method for providing a travel distance in the sub-scanning direction, FIG. 4A illustrating printing on a horizontal surface in the sub-scanning direction, FIG. 4B illustrating printing on an inclined surface at an inclination angle of 30° with respect to the sub-scanning direction, FIG. 4C illustrating printing on an inclined surface at an inclination angle of 45°, FIG. 4D illustrating printing on an inclined surface at an inclination angle of 60°.
Figure 4B:
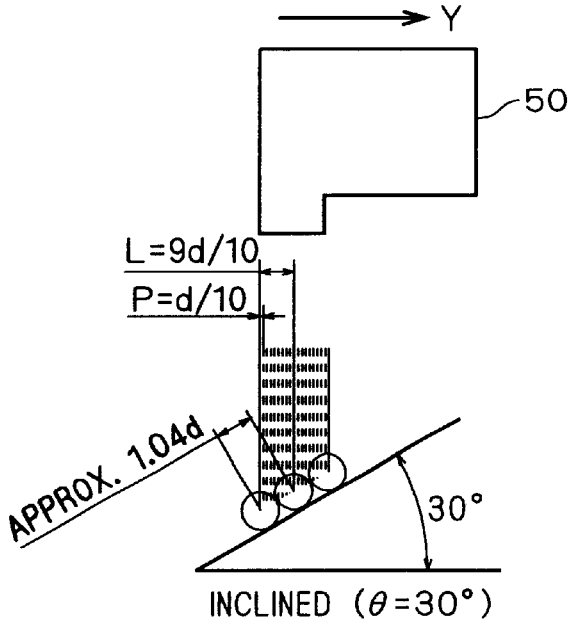
Figure 4C:
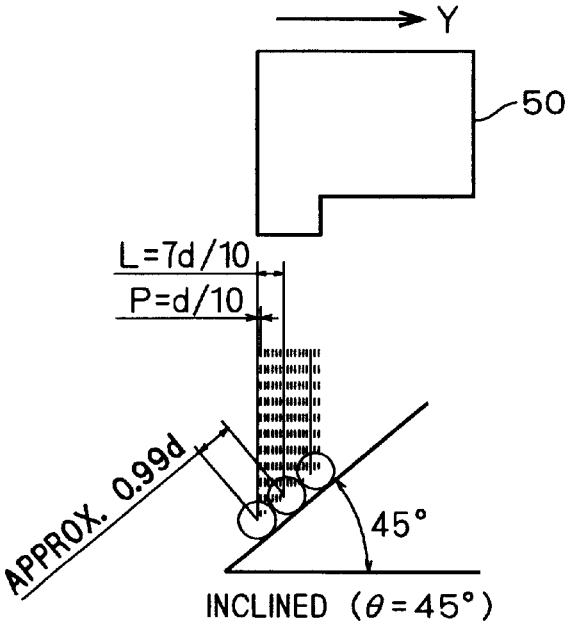
Figure 4D:
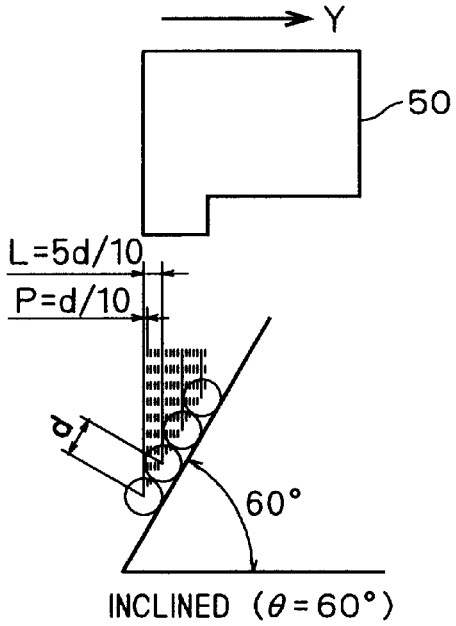

FIGS. 4A, 4B, 4C and 4D show a specific driving method for providing a travel distance (or travel pitch) L of the ejection head 50 in the sub-scanning direction Y. FIG. 4A illustrates printing on a horizontal surface in the sub-scanning direction Y, FIG. 4B illustrates printing on an inclined surface at an inclination angle of 30° with respect to the sub-scanning direction Y, FIG. 4C illustrates printing on an inclined surface at an inclination angle of 45°, and FIG. 4D illustrates printing on an inclined surface at an inclination angle of 60°.

The printing apparatus 100A is constructed to drive the ejection head 50 to move a fine pitch p as a unit in the sub-scanning direction Y. The fine pitch p is a minimum unit of distance the ejection head 50 is driven to move in the sub-scanning direction Y in the printing apparatus 100A, and is set at a value smaller than the travel distance L (=d) used for printing on the horizontal surface. In this preferred embodiment, the fine pitch p is set at d/10 as shown in FIGS. 4A to 4D.

In the printing apparatus 100A, a controller 43 (See FIG. 7) to be described later determines the travel distance L in accordance with the inclined surface by calculating the cumulative value of the fine pitch p so that the spacing between dots of ink to be formed on the inclined surface is closest to the dot-to-dot spacing d on the horizontal surface and then by defining the cumulative value as the travel distance L.

More specifically, when printing on the horizontal surface of the object 9 as shown in FIG. 4A, the travel distance L is set at d since the dot-to-dot spacing on the horizontal surface is required to equal d.

Next, when printing on the inclined surface of the object 9 which has the inclination angle of 30° as shown in FIG. 4B, the travel distance L is determined so that the dot-to-dot spacing on the inclined surface is closest to d. The dot-to-dot spacing on the inclined surface is approximately 0.92 d when the ejection head 50 moves the fine pitch p eight times to provide the travel distance L=8 d/10, and is approximately 1.04 d when the ejection head 50 moves the fine pitch p nine times to provide the travel distance L=9 d/10. In this case, the travel distance L is set at 9 d/10 which is closest to the dot-to-dot spacing d on the horizontal surface.

Next, when printing on the inclined surface of the object 9 which has the inclination angle of 45° as shown in FIG. 4C, the travel distance L is set at 7 d/10 so that the dot-to-dot spacing on the inclined surface is closest to d. In this case, the dot-to-dot spacing on the inclined surface is approximately 0.99 d.

Next, when printing on the inclined surface of the object 9 which has the inclination angle of 60° as shown in FIG. 4D, the travel distance L is set at 5 d/10 so that the dot-to-dot spacing on the inclined surface is closest to d. In this case, the dot-to-dot spacing on the inclined surface is equal to the dot-to-dot spacing d on the horizontal surface.

Therefore, the printing apparatus 100A establishes the fine pitch p as the unit of distance the ejection head 50 is driven to move in the sub-scanning direction Y so that the fine pitch p is less than the dot-to-dot spacing on the surface of the object 9, thereby to maintain the spacing in the sub-scanning direction Y between the dots of ink even on the inclined surfaces at an approximately fixed value. This accomplishes fine-definition printing also in the sub-scanning direction.

Two modes of operation are contemplated when actually moving the ejection head 50 relative to the object 9 to perform printing.

A first mode of operation is such that the ejection head 50 is driven in the main scanning direction X each time the ejection head 50 is moved stepwise the fine pitch p in the sub-scanning direction Y. In this mode, when moving the ejection head 50 relative to the object 9, the main scanning direction driver 10 and the sub-scanning direction driver 20 may be adapted to repeatedly drive the ejection head 50 in the main scanning direction X each time the ejection head 50 is driven to move a fixed distance, or the fine pitch p, in the sub-scanning direction Y. The ejection nozzles of the ejection head 50 may be adapted to selectively eject required ink upon reaching a predetermined ink ejection position over the object 9 to achieve the printing on the object 9.

Thus, in the first mode of operation, it is not necessary to transmit information about the travel distance L to the sub-scanning direction driver 20. The driving system for moving the ejection head 50 in the main scanning direction X and in the sub-scanning direction Y is required only to perform a steady driving operation. This simplifies a mechanism for controlling the driving system.

The first mode of operation is effective when a plurality of inclined surfaces having different inclination angles are arranged in the main scanning direction X as viewed from a certain sub-scanning position, particularly when the surface of the object 9 has a continuously curved shape and the like, for the reason to be described below. When the ejection head 50 is in such a sub-scanning position, the travel distance L for providing the optimum dot-to-dot spacing is established for each of the inclined surface. On some occasions, there is an inclined surface such that the amount of movement of the ejection head 50 in the sub-scanning direction is equal to the travel distance L established therefor, after the ejection head 50 is driven to move the fine pitch p which is the minimum unit of distance the ejection head 50 is driven in the sub-scanning direction Y. Therefore, the movement of the ejection head 50 at the fine pitch p and the driving of the ejection head 50 in the main scanning direction X are alternately repeated to allow stable printing on the object having a three-dimensional complicated shape.

In the first mode of operation, however, there are occasions when there is no such inclined surface that the amount of movement of the ejection head 50 in the sub-scanning direction Y is equal to the travel distance L established therefor, after the ejection head 50 is driven to move the fine pitch p in the sub-scanning direction Y. On these occasions, the driving of the ejection head 50 in the main scanning direction X at that sub-scanning position does not involve the ejection of ink to become a factor responsible for the reduction in printing efficiency.

A second mode of operation is effective to avoid such reduction in printing efficiency.

The second mode of operation is such that the ejection head 50 is repeatedly driven to move the fine pitch p until the amount of movement of the ejection head 50 in the sub-scanning direction Y equals the travel distance L, and the ejection head 50 is not driven in the main scanning direction X if the amount of movement of the ejection head 50 in the sub-scanning direction Y does not equal the travel distance L after the ejection head 50 is driven to move the fine pitch p. In other words, the second mode of operation is similar to the first mode in that the ejection head 50 is repeatedly driven to move the fine pitch p in the sub-scanning direction Y, but differs therefrom in that the ejection head 50 is not moved in the main scanning direction X at a sub-scanning position which does not involve the ejection of ink.

Thus, in the second mode of operation, the ejection head 50 is not driven in the main scanning direction X if ink ejection is not involved. This saves the operating time, to reduce the time required for printing, thereby increasing the printing efficiency and achieving high-speed printing.

A3. Ejection Pattern Control in Main Scanning Direction X

Next, ejection pattern control in the main scanning direction X will be described. The ejection head 50 is moved continuously, rather than stepwise, in the main scanning direction X. Thus, the technique of providing a uniform dot distribution in the main scanning direction X includes two methods: a method of changing the velocity of the continuous movement of the ejection head 50 in accordance with the inclined surface with respect to the main scanning direction X; and a method of changing the timing of ink ejection (i.e. the driving frequency of the ejection nozzles) in accordance with the inclined surface while maintaining the velocity of the continuous movement of the ejection head 50 at a fixed value.

Figure 5A:
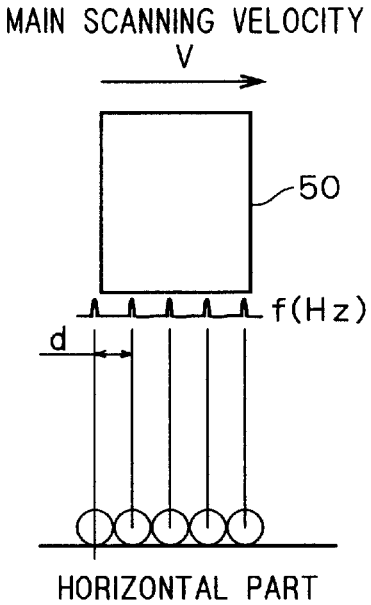
FIGS. 5A and 5B show a first method for ejection pattern control in a main scanning direction, FIG. 5A illustrating printing on a horizontal surface in the main scanning direction, FIG. 5B illustrating printing on an inclined surface at an inclination angle with respect to the main scanning direction.
Figure 5B:
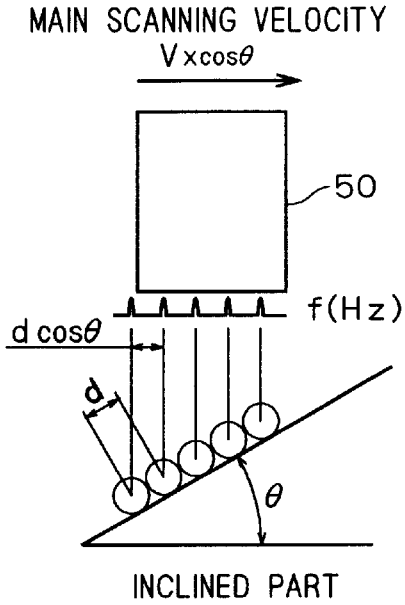

FIGS. 5A and 5B show the first method for ejection pattern control in the main scanning direction X. FIG. 5A shows printing on a horizontal surface in the main scanning direction X, and FIG. 5B shows printing on an inclined surface at an inclination angle θ with respect to the main scanning direction X.

In the example of operation shown in FIGS. 5A and 5B, the travel velocity V of the ejection head 50 moving continuously in the main scanning direction is changed in accordance with the inclined surface with respect to the main scanning direction X.

More specifically, when ejecting ink onto the horizontal surface in the main scanning direction X, the ejection head 50 is moved at a main scanning velocity V, as shown in FIG. 5A. On the other hand, when ejecting ink onto the inclined surface at the inclination angle θ with respect to the main scanning direction X, the travel velocity of the ejection head 50 is changed to a main scanning velocity V cos θ depending on the inclination angle θ, as shown in FIG. 5B.

For instance, it is assumed that, for a uniform dot-to-dot spacing d in the main scanning direction X on the horizontal surface, the driving frequency for driving the ejection nozzles of the ejection head 50 moving at the main scanning velocity V is set at f (Hz), as shown in FIG. 5A. In order for the ejection head 50 to form a uniform dot distribution having the dot-to-dot spacing d on the inclined surface at the inclination angle θ, it is necessary to change the travel velocity V of the ejection head 50 in the main scanning direction X in accordance with the inclination angle θ when the driving frequency f (Hz) is maintained at a fixed value. In the example of operation shown in FIG. 5B, even when ejecting ink onto the inclined surface at the inclination angle θ without changing the driving frequency f (Hz), the ejection head 50 moving at the main scanning velocity $V_\theta = V \cos \theta$ can provide the dot-to-dot spacing d on the inclined surface which is equal to the dot-to-dot spacing d to be formed on the horizontal surface, to achieve the uniform dot distribution.

Figure 6A:
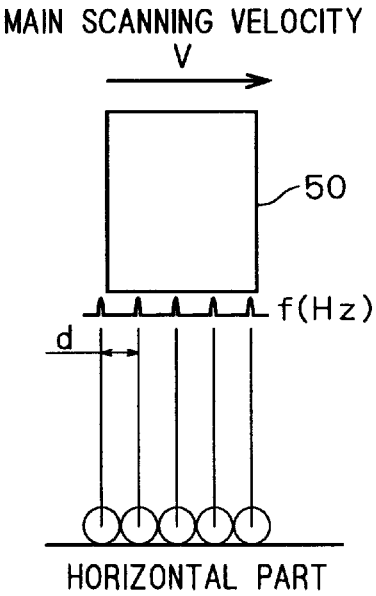
FIGS. 6A and 6B show a second method for ejection pattern control in the main scanning direction, FIG. 6A illustrating printing on a horizontal surface in the main scanning direction.
Figure 6B:
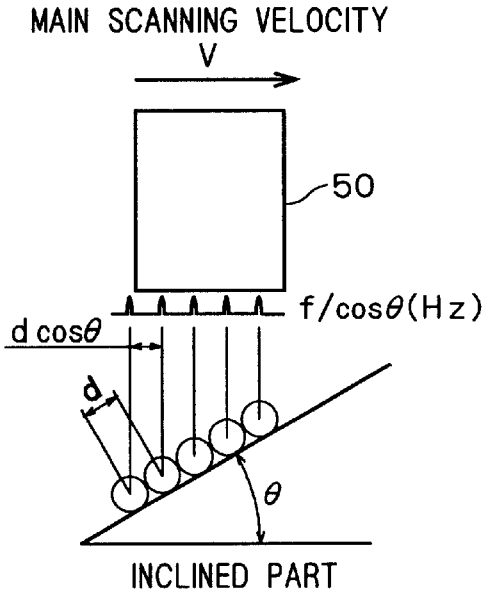

FIGS. 6A and 6B show the second method for ejection pattern control in the main scanning direction X. FIG. 6A shows printing on a horizontal surface in the main scanning direction X, and FIG. 6B shows printing on an inclined surface at an inclination angle θ with respect to the main scanning direction X.

In the example of operation shown in FIGS. 6A and 6B, the timing of ejection of ink from the ejection nozzles, or the driving frequency of the ejection nozzles, is changed in accordance with the inclined surface with respect to the main scanning direction X, while the travel velocity V of the ejection head 50 moving continuously in the main scanning direction X is held constant.

More specifically, the travel velocity of the ejection head 50 moving continuously in the main scanning direction X, i.e. the main scanning velocity, is held constant at V. When ejecting ink onto the horizontal surface in the main scanning direction X, the driving frequency of the ejection nozzles of the ejection head 50 is set at f, as shown in FIG. 6A. On the other hand, when ejecting ink onto the inclined surface at the inclination angle θ with respect to the main scanning direction X, the driving frequency $f_\theta$ of the ejection nozzles of the ejection head 50 is changed to $f_\theta = f/\cos\theta$ depending on the inclination angle θ, as shown in FIG. 6B.

For instance, it is assumed that, for a uniform dot-to-dot spacing d in the main scanning direction X on the horizontal surface, the driving frequency for driving the ejection nozzles of the ejection head 50 moving at the main scanning velocity V is set at f (Hz), as shown in FIG. 6A. In order for the ejection head 50 to form a uniform dot distribution having the dot-to-dot spacing d on the inclined surface at the inclination angle θ while the main scanning velocity V is held constant, it is necessary to change the driving frequency $f_\theta$ in accordance with the inclination angle θ. In the example of operation shown in FIG. 6B, when ejecting ink onto the inclined surface at the inclination angle θ, the driving frequency $f_\theta$ of the ejection nozzles is changed to $f_\theta = f/\cos\theta$ (Hz) depending on the inclined surface at the inclination angle θ while maintaining the main scanning velocity at V. This provides the dot-to-dot spacing d on the inclined surface which is equal to the dot-to-dot spacing d to be formed on the horizontal surface, to achieve the uniform dot distribution.

As described above, since the ejection head 50 is moved continuously, rather than stepwise, in the main scanning direction X, the use of any one of the two above-mentioned methods of operation for the uniform dot distribution in the main scanning direction X allows the dot-to-dot spacing in the main scanning direction X to be held uniform, independently of the presence or absence of the inclination. Although only one of the main scanning velocity $V_\theta$ and the driving frequency $f_\theta$ is illustrated as changed in accordance with the inclination angle θ in the above description, the present invention is not limited to this, but may be controlled to change both of the main scanning velocity $V_\theta$ and the driving frequency $f_\theta$. More specifically, a combination ($V_\theta$, $f_\theta$) of the main scanning velocity $V_\theta$ and the driving frequency $f_\theta$ is not limited to (V cos θ, f) and (V, f/cos θ), but may be other combinations ($V_\theta$, $f_\theta$) which satisfy the relationship: $V_\theta/f_\theta = V\cos\theta/f$.

A4. Control Mechanism and Overall Operation in Printing Apparatus 100A

A control mechanism in the printing apparatus 100A will be described hereinafter.

Figure 7:
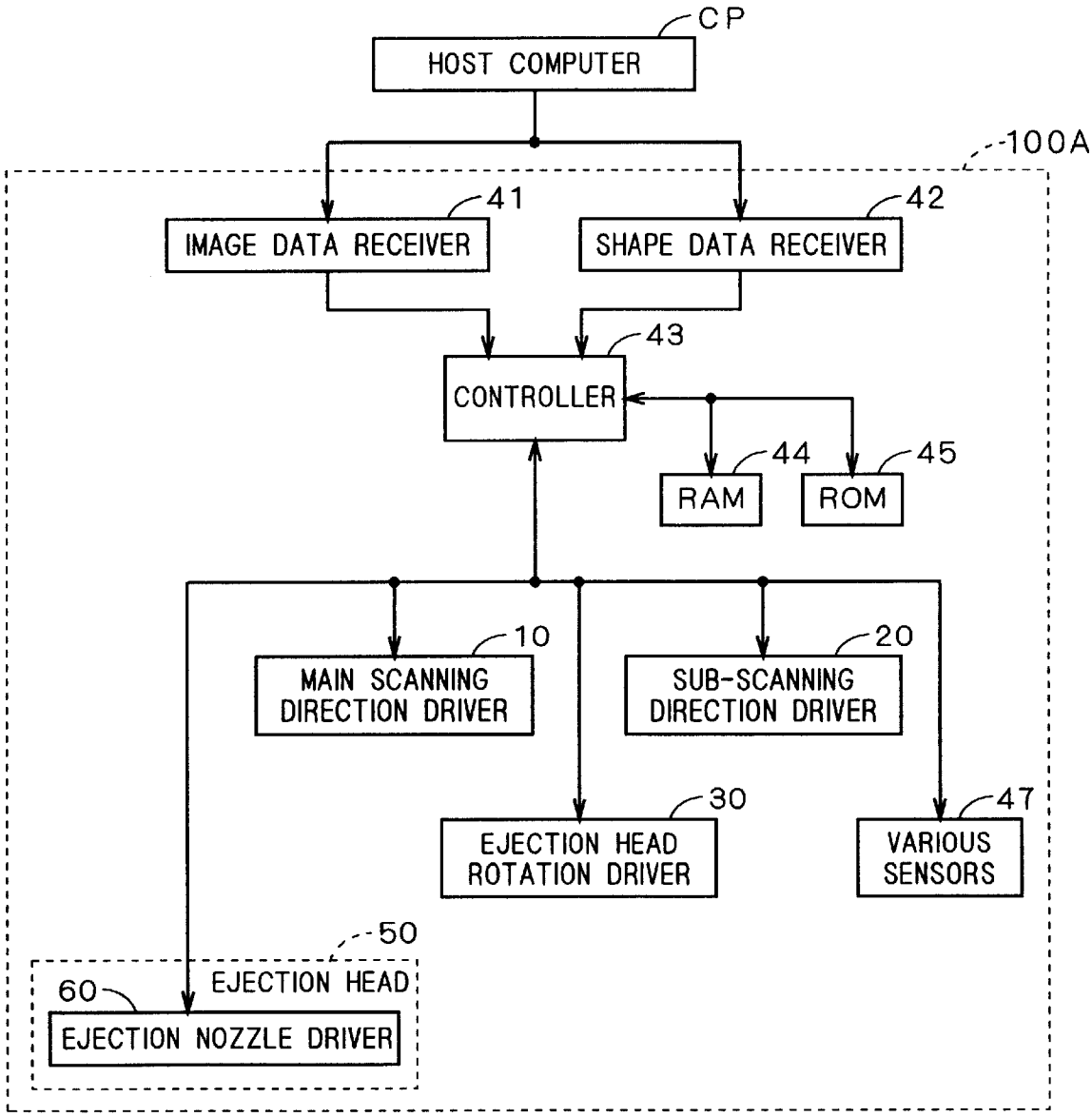
FIG. 7 is a block diagram of a control mechanism in the printing apparatus.

FIG. 7 is a block diagram of the control mechanism in the printing apparatus 100A. As illustrated in FIG. 7, the printing apparatus 100A comprises an image data receiver 41, a shape data receiver 42, the controller 43, a RAM 44, a ROM 45, the main scanning direction driver 10, the sub-scanning direction driver 20, the ejection head rotation driver 30, various sensors 47, and the ejection nozzle driver 60. The image data receiver 41 receives from an externally connected host computer CP image data about what is to be printed on the object 9 which is represented as an image. The shape data receiver 42 receives from the host computer CP shape data about the shape of the surface of the object 9. Hence, the surface shape of the three-dimensional object is recognized.

The controller 43 determines the ejection patterns of the printing ink to be ejected in the main scanning direction X and in the sub-scanning direction Y, respectively, for printing on the object 9, and controls the main scanning direction driver 10, the sub-scanning direction driver 20, the ejection nozzle driver 60 and the like based on the determined ejection patterns, thereby to achieve the uniform dot distribution on the object 9. The RAM 44 is a memory for storing the image data and the shape data both received from the host computer CP, and data about the respective ejection patterns for controlling the printing operation, such as data about the travel distance L in the sub-scanning direction Y. The ROM 45 is a memory for storing a program corresponding to a printing procedure (the flowchart of FIG. 8 to be described later) to be executed by the controller 43.

The main scanning direction driver 10 provided inside the rail RL (See FIG. 1) drives a predetermined motor and the like based on an operating instruction from the controller 43 to move the head holding mechanism 13 along the rail RL, thereby moving the ejection head 50 in the main scanning direction X.

The sub-scanning direction driver 20 provided in the base plate 81 (See FIG. 1) drives a predetermined motor and the like based on an operating instruction from the controller 43 to move the stands ST along the grooves 83 extending in the Y direction, thereby moving the ejection head 50 in the sub-scanning direction Y.

The ejection head rotation driver 30 provided in the head holding mechanism 13 rotates the ejection head 50 within an X-Y plane based on an operating instruction from the controller 43. This rotational operation is particularly effective when the ejection head 50 has a multi-nozzle form, which will be described later.

The various sensors 47 are sensing means for sensing the home position of each operating mechanism component such as the main scanning direction driver 10, and for detecting the amount of ink remaining in the ejection head 50 and the like. This sensing means achieves correct operation in each direction and allows a user to know the time to replace an ink tank and the like.

The ejection nozzle driver 60 provided in the ejection head 50 causes the ejection nozzles of the ejection head 50 to eject ink, based on the ejection timing from the controller 43.

Description will be given on the operation for printing on the three-dimensional object 9 in practice in the printing apparatus 100A having the above-mentioned construction.

Figure 8:
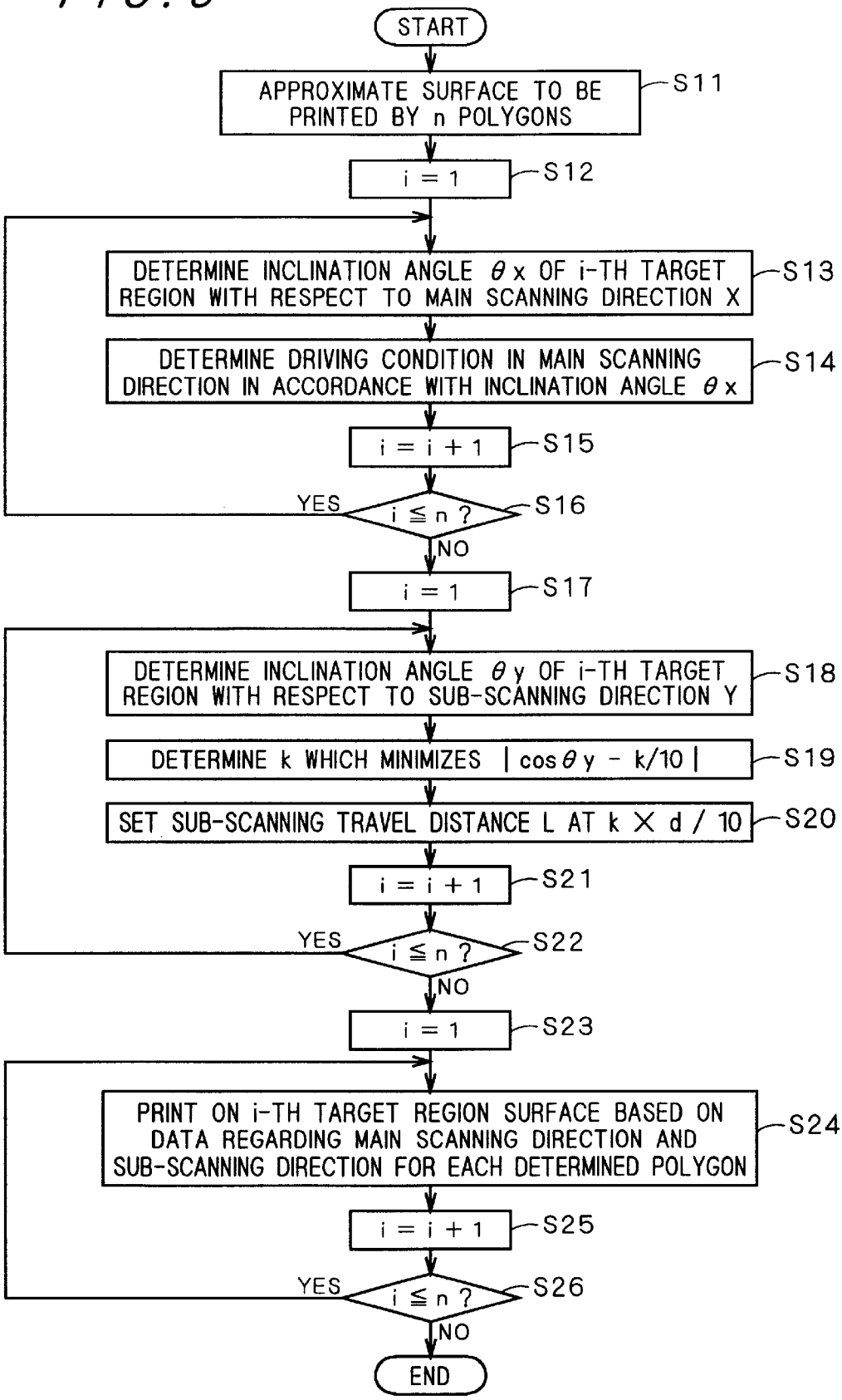
FIG. 8 is a flowchart showing the overall operation of the printing apparatus.

FIG. 8 is a flowchart showing the overall operation of the printing apparatus 100A. The flowchart of FIG. 8 illustrates the procedure principally executed in the controller 43 in the printing apparatus 100A.

First, in Step S11, the surface of the object 9 to be printed is approximated by n polygonal faces (where n is an integer). That is, the surface shape of the three-dimensional object is approximated by a polyhedron comprised of a plurality of polygons. More specifically, upon receiving the shape data about the object 9 from the host computer CP, the controller 43 processes the data, even if the object 9 has a surface shape including smooth projections and depressions or the like, to represent the surface shape as a set of polygonal faces.

Figure 9A:
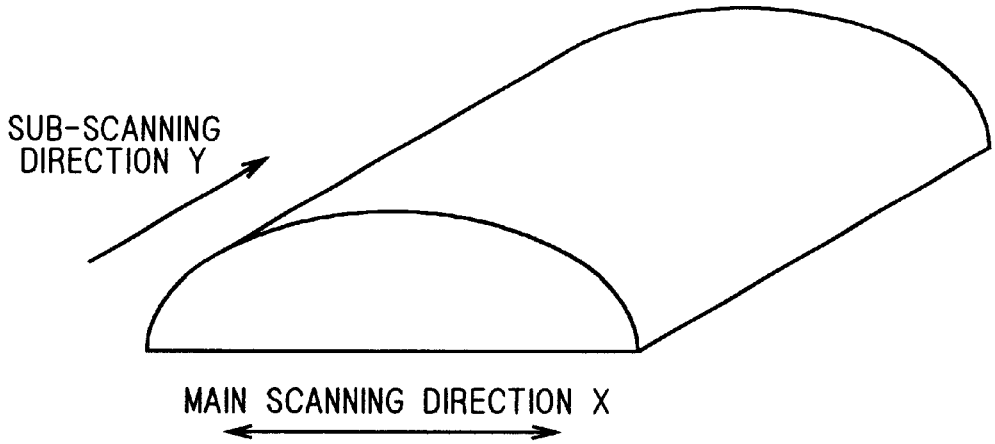
FIGS. 9A and 9B show an example of an approximation of the shape of the object which is made by polygonal faces, FIG. 9A illustrating an example of the object having a smoothly curved surface, FIG. 9B illustrating the shape of FIG. 9A approximated by a plurality of polygons.
Figure 9B:
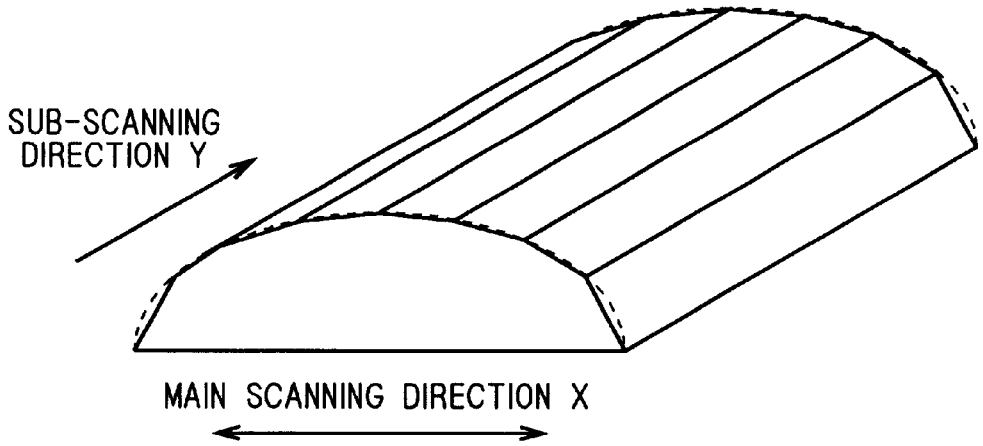
Figure 10A:
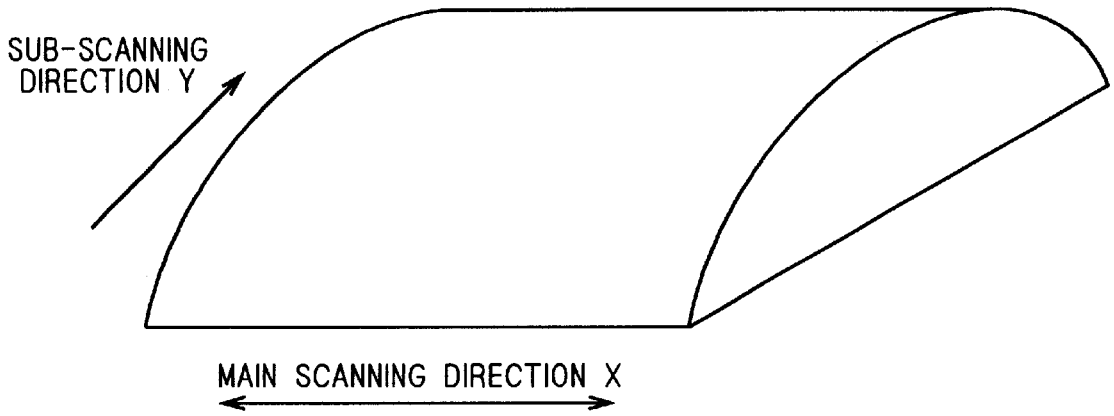
FIGS. 10A and 10B show another example of the approximation of the shape of the object which is made by polygonal faces, FIG. 10A illustrating an example of the object having a smoothly curved surface, FIG. 10B illustrating the shape of FIG. 10A approximated by a plurality of polygons.
Figure 10B:
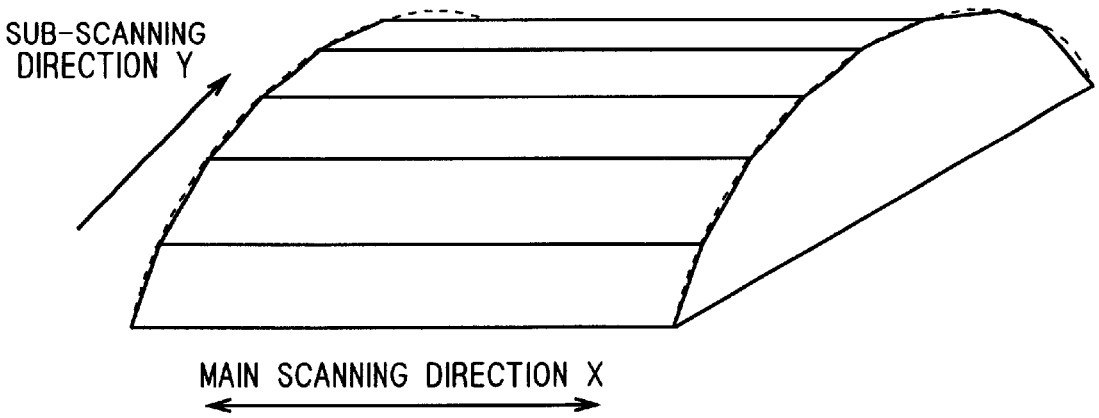
Figure 11A:
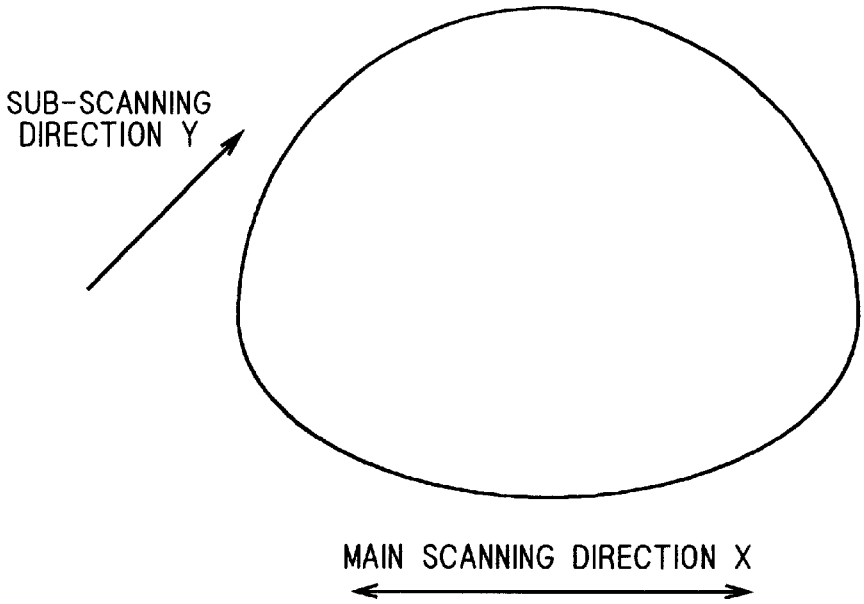
FIGS. 11A and 11B show still another example of the approximation of the shape of the object which is made by polygonal faces, FIG. 11A illustrating an example of the object having a smoothly curved surface, FIG. 11B illustrating the shape of FIG. 11A approximated by a plurality of polygons.
Figure 11B:
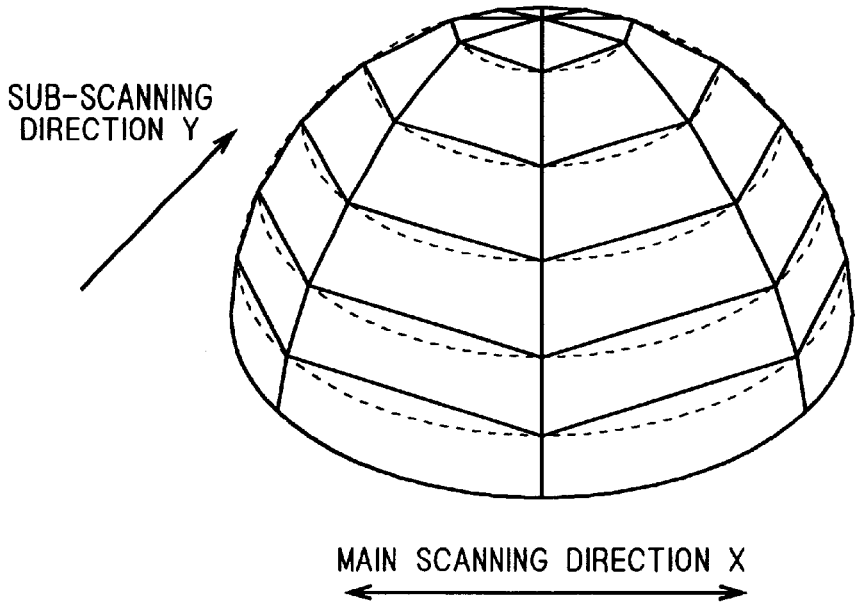

FIGS. 9A, 9B, 10A, 10B, 11A and 11B show examples of the approximation of the shape of the object 9 which is made by polygonal faces in the controller 43. FIGS. 9A and 9B show the object 9 to be subjected to printing which is inclined with respect to only the main scanning direction X, FIGS. 10A and 10B show the object 9 to be subjected to printing which is inclined with respect to only the sub-scanning direction Y, and FIGS. 11A and 11B show the object 9 to be subjected to printing which is inclined with respect to both the main scanning direction X and the sub-scanning direction Y.

In the case shown in FIGS. 9A and 9B, the shape data about the object 9 given from the host computer CP includes a surface smoothly curved with respect to the main scanning direction X, as shown in FIG. 9A. In this state, however, since the inclination angle of the object 9 changes continuously with respect to the main scanning direction X, it is necessary to determine the inclination angles at all ink striking positions with respect to the main scanning direction X and accordingly to produce the ejection pattern for each of the ink striking positions. This requires enormous calculations. To solve this problem, the controller 43 segments the surface shape of the object 9 into a plurality of regions arranged in the main scanning direction X, as shown in FIG. 9B, to approximate the curved face of each of the regions by a planar polygonal face. Consequently, the curved surface with respect to the main scanning direction X is represented by the plurality of polygonal faces. The controller 43 determines the inclination angle with respect to the main scanning direction X for each of the polygons, to change the ejection pattern.

In the case shown in FIGS. 10A and 10B, the shape data about the object 9 given from the host computer CP includes a surface smoothly curved with respect to the sub-scanning direction Y, as shown in FIG. 10A. In this state, however, since the inclination angle of the object 9 changes continuously with respect to the sub-scanning direction Y, it is necessary to determine the inclination angles at all ink striking positions with respect to the sub-scanning direction Y and accordingly to produce the ejection pattern for each of the ink striking positions. This requires enormous calculations. To solve this problem, the controller 43 segments the surface shape of the object 9 into a plurality of regions arranged in the sub-scanning direction Y, as shown in FIG. 10B, to approximate the curved face of each of the regions by a planar polygonal face. Consequently, the curved surface with respect to the sub-scanning direction Y is represented by the plurality of polygonal faces. The controller 43 determines the inclination angle with respect to the sub-scanning direction Y for each of the polygons, to change the ejection pattern.

In the case shown in FIGS. 11A and 11B, the shape data about the object 9 given from the host computer CP includes a surface smoothly curved with respect to both the main scanning direction X and the sub-scanning direction Y, as shown in FIG. 11A. In this state, however, since the inclination angle of the object 9 changes continuously with respect to both the main scanning direction X and the sub-scanning direction Y, it is necessary to determine the inclination angles at all ink striking positions with respect to both the main scanning direction X and the sub-scanning direction Y and accordingly to produce the ejection pattern for each of the ink striking positions. This requires enormous calculations. To solve this problem, the controller 43 segments the surface shape of the object 9 into a plurality of regions, as shown in FIG. 11B, to approximate the curved face of each of the regions by a planar polygonal face. Consequently, the curved surface of the object 9 is represented by the plurality of polygonal faces. The controller 43 determines the inclination angles with respect to both the main scanning direction X and the sub-scanning direction Y for each of the polygons, to change the ejection pattern.

The approximation is made by the n polygonal faces in this manner in Step S11. Such polygonal approximation can improve the printing efficiency. The use of the polygonal approximation requires the controller 43 only to determine the printing conditions and the like for each polygon with respect to the main scanning direction X and the sub-scanning direction Y and to change the printing operation for each polygon. Thus, the use of n polygons requires the change in ejection pattern for printing operation to be made n times.

It is possible to change the ejection pattern each time the inclination angle of the continuously changing curved surface is determined for each position of the ejection head without making the polygonal approximation. However, this process necessitates the change in ejection pattern each time a droplet of ink is ejected, to cause significantly complicated control for printing operation and require enormous time for arithmetic and printing operations.

The use of the polygonal approximation of the object surface allows the printing operation to be performed under the same condition for each polygon, to achieve efficient printing.

Next, in Step S12, a polygon parameter i is initialized to "1." In Step S13, the inclination angle $\theta x$ of the i-th polygon with respect to the main scanning direction X is determined. In Step S14, the driving condition in the main scanning direction X is determined in accordance with the inclination angle $\theta x$, and the determined driving condition is temporarily stored in the RAM 44. As stated above, the determined driving condition includes the ejection frequency ($f/\cos\theta x$) and/or the driving velocity ($V\times\cos\theta x$). In Step S15, the polygon parameter i is incremented by one, and the flow proceeds to Step S16. In Step S16, a judgment is made as to whether or not the driving condition in the main scanning direction X has been determined for all of the n polygons. If the determination for all of the n polygons is completed, the flow proceeds to Step S17. If the determination for all of the n polygons is not completed, the flow returns to Step S13 to determine the driving condition for the next polygon.

The processes in Steps S12 to S16 are performed to determine the driving condition in the main scanning direction X for all polygons. After the driving condition in the main scanning direction X is determined for all polygons, processes in Steps S17 to S22 are then executed to determine the driving condition in the sub-scanning direction Y (i.e. the stepwise travel distance L in the sub-scanning direction Y).

In Step S17, the polygon parameter i is initialized to "1." In Step S18, the inclination angle $\theta y$ of the i-th polygon with respect to the sub-scanning direction Y is determined. Then, in Step S19, an integer k which minimizes the absolute value of ($\cos\theta y - k/10$) is determined. The integer k is a value indicating the cumulative value of the fine pitch p in the sub-scanning direction Y. In Step S20, the travel distance L in the sub-scanning direction Y for providing the dot-to-dot spacing equaling d for the i-th polygon is set at $k\times d/10$. In other words, when the travel distance L=k×d/10 for the i-th polygon, the dot-to-dot spacing in the sub-scanning direction is closest to the dot-to-dot spacing d on the horizontal surface. The travel distance L determined in Step S20 is temporarily stored in the RAM 44. In Step S21, the polygon parameter i is incremented by one, and the flow proceeds to Step S22. In Step S22, a judgment is made as to whether or not the travel distance L in the sub-scanning direction Y has been determined for all of the n polygons. If the determination for all of the n polygons is completed, the flow proceeds to Step S23. If the determination for all of the n polygons is not completed, the flow returns to Step S18 to determine the travel distance L for the next polygon.

Next, processes in Steps S23 to S26 are executed for printing on each of the polygons.

In Step S23, the polygon parameter i is initialized to "1." In step S24, the controller 43 obtains from the RAM 44 the driving condition in the main scanning direction X and the travel distance in the sub-scanning direction Y for the i-th polygon, to perform printing on an i-th target region surface (the actual surface approximated by the i-th polygon) based on the obtained data. After the printing operation on that region surface, the polygon parameter i is incremented by one in Step S25, and the flow proceeds to Step S26. In Step S26, a judgment is made as to whether or not the printing operation has been completed for all of the n polygons. If the printing operation for all of the n polygons is completed, the printing operation on the object 9 is terminated. If the printing operation for all of the n polygons is not completed, the flow returns to Step S24 to start the printing operation for the next polygon.

In the printing operation in Step S24, the ejection head 50 is driven in the main scanning direction X based on the driving condition determined for each polygon, and is moved stepwise in the sub-scanning direction Y based on the travel distance L determined for each polygon. Therefore, the printing operation in Step S24 allows the plurality of polygons to be substantially identical in dot-to-dot spacing both in the main scanning direction X and in the sub-scanning direction Y, to form the uniform dot distribution.

A5. Multi-Nozzle Form of Ejection Head

Description is given on a multi-nozzle arrangement of the ejection head 50 including a plurality of ejection nozzles for ejecting the printing ink. The multi-nozzle arrangement of the ejection head 50 produces the peculiar function and effect of simultaneously ejecting a plurality of ink droplets to achieve high-speed printing.

When the plurality of ejection nozzles are arranged in the sub-scanning direction Y, the spacings between the nozzles are constant in the sub-scanning direction Y. The ink ejected from the constantly spaced ejection nozzles produces dots between which gaps are formed depending on the constant spacings. It is therefore necessary to fill the gaps with dots by repeatedly driving the ejection nozzles in the sub-scanning direction Y.

For printing on the horizontal surface, the travel distance L in the sub-scanning direction Y may be set at the distance d which provides the dense dot distribution (See FIG. 4A), thereby to fill the gaps with the dots evenly and properly.

However, for printing on an inclined surface, since the travel distance L in the sub-scanning direction Y is set at a distance which provides the dense dot distribution (See FIGS. 4B to 4D), the gaps between the dots resulting from the constant spacing between the ejection nozzles are not filled with the dots evenly and properly.

To avoid this phenomenon, it is desirable to change the spacing between the ejection nozzles in accordance with the inclination with respect to the sub-scanning direction Y. It is, however, technically difficult to freely change the spacing between the ejection nozzles of the ejection head 50.

The printing apparatus 100A is designed to rotate the ejection head 50 by the ejection head rotation driver 30 in accordance with the inclination angle with respect to the sub-scanning direction Y to control the spacing between the ejection nozzles in the sub-scanning direction.

Figure 12:
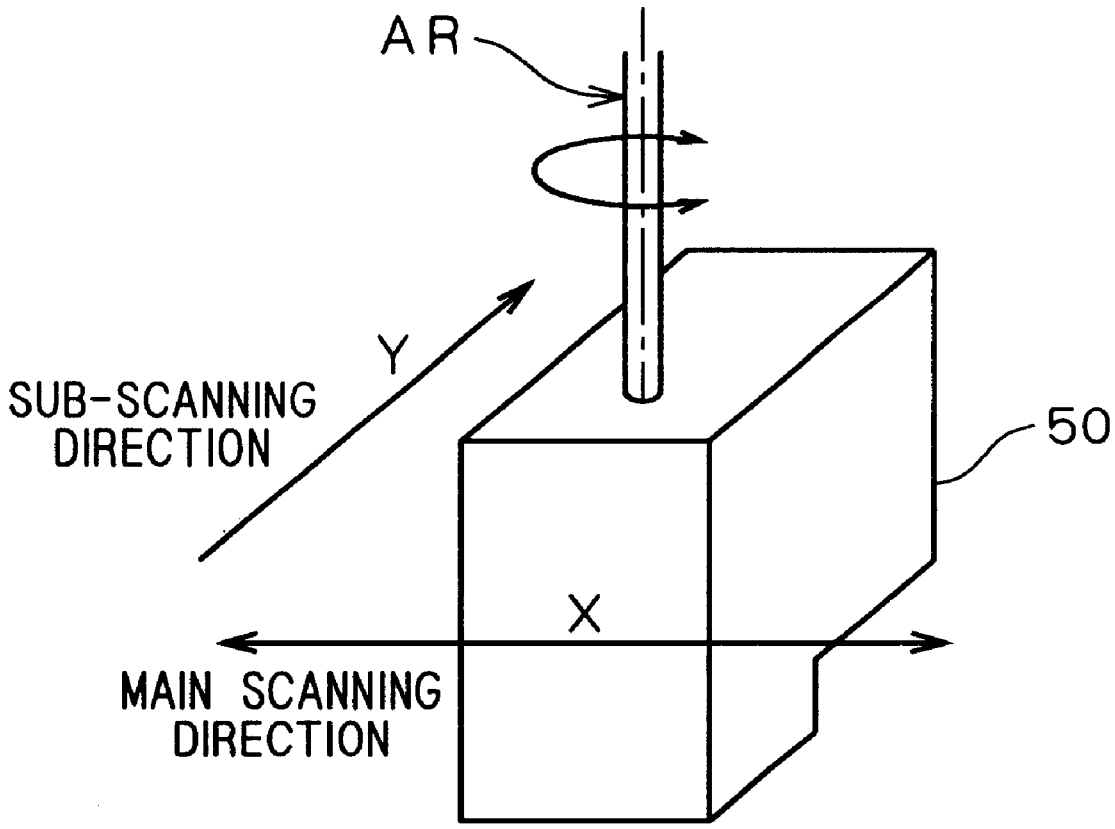
FIG. 12 shows the rotational operation of the ejection head.

FIG. 12 shows the rotational operation of the ejection head 50. As shown in FIG. 12, the ejection head 50 is adapted to rotate within the X-Y plane as the ejection head rotation driver 30 rotates the rotary shaft AR. Consequently, when the plurality of ejection nozzles are arranged in the sub-scanning direction Y on the underside of the ejection head 50, this structure can control the nozzle-to-nozzle spacing in the sub-scanning direction Y.

Three examples of the multi-nozzle arrangement of the ejection head 50 will be specifically described with reference to FIGS. 13A, 13B, 13C, 14A, 14B, 14C, 15A, 15B and 15C. For multi-color printing on the object 9, the ejection head 50 of the multi-nozzle arrangement to be described below comprises the plurality of ejection nozzles for each of the four color components: Y (yellow), M (magenta), C (cyan) and K (black).

Figure 13A:
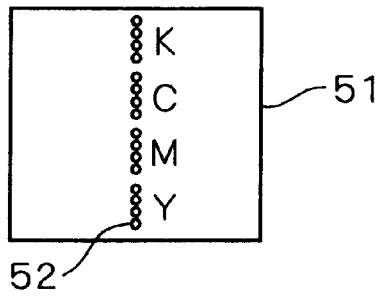
FIGS. 13A, 13B and 13C show an example of a multi-nozzle arrangement of the ejection head, FIG. 13A illustrating a nozzle unit of the ejection head as viewed from the object, FIG. 13B illustrating the nozzle unit rotated in accordance with the inclination angle, FIG. 13C being an enlarged view of a portion A shown in FIG. 13B.
Figure 13B:
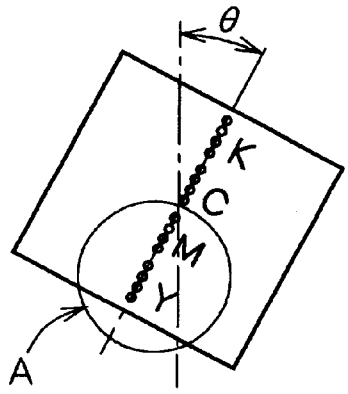
Figure 13C:
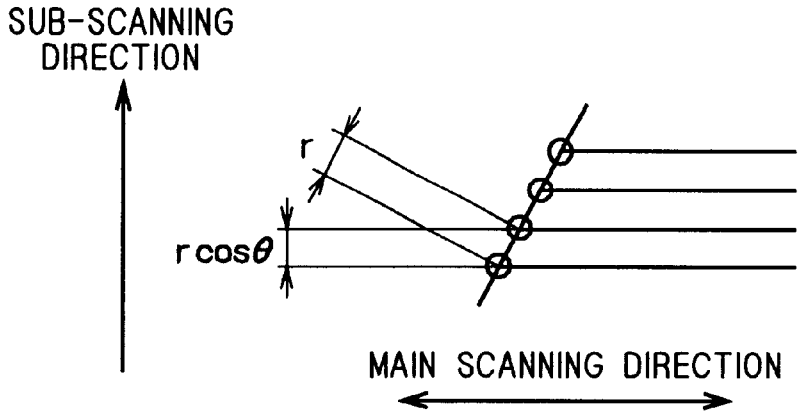

FIGS. 13A, 13B and 13C show a first example of the multi-nozzle arrangement including a plurality of ejection nozzles 52 for the color components Y, M, C and K arranged in a column in the sub-scanning direction Y.

FIG. 13A shows the nozzle unit 51 of the ejection head 50 as viewed from the object 9. As shown in FIG. 13A, the nozzle unit 51 includes an array of ejection nozzles 52 for each color component Y, M, C and K which are arranged in a column in the sub-scanning direction Y, with the nozzle arrays for the respective color components arranged in a column.

For printing by such an ejection head 50 on the inclined surface at the inclination angle θ with respect to the sub-scanning direction Y, the travel distance L of the ejection head 50 in the sub-scanning direction Y is determined in accordance with the inclination angle θ in the above-mentioned manner, and a rotation angle θ is imparted to the ejection head 50 to rotate the nozzle unit 51 in accordance with the inclination angle θ, as shown in FIG. 13B. Consequently, the column of the ejection nozzles 52 arranged in the sub-scanning direction Y before the rotation forms an angle θ with the sub-scanning direction Y after the rotation.

FIG. 13C is an enlarged view of a portion A (or an ejection nozzle portion) shown in FIG. 13B. The rotation of the nozzle unit 51 in accordance with the inclination angle θ with respect to the sub-scanning direction Y provides a nozzle-to-nozzle spacing in the sub-scanning direction Y which equals r cos θ where r is a physical distance between adjacent nozzles in the nozzle unit 51. This substantially reduces the spacing between the ejection nozzles in the sub-scanning direction Y.

Thus imparting the rotation angle equaling the inclination angle θ of the inclined surface to the ejection head 50 allows the spacing between the dots formed by the ink ejected from adjacent ejection nozzles 52 to be maintained at r on the inclined surface. This dot-to-dot spacing r is equal to the spacing between the dots formed by the adjacent ejection nozzles 52 in the case of printing on the horizontal surface by the multi-nozzle arrangement. Therefore, the printing operation by setting the travel distance L of the ejection head 50 in the sub-scanning direction Y so as to provide a dot distribution similar to that on the horizontal surface can form the dots in the gaps of the dot-to-dot spacing r evenly and properly as the ejection head 50 moves in the sub-scanning direction Y.

Even if the travel distance L of the ejection head 50 in the sub-scanning direction Y in accordance with the inclination angle θ is set to be smaller than that in the case of printing on the horizontal surface, the nozzle-to-nozzle spacing in the sub-scanning direction Y becomes accordingly smaller. Thus, the gaps between the dots of ink ejected from the plurality of ejection nozzles 52 are filled with the dots evenly and properly. Consequently, high-definition printing is achieved.

In this case, however, the rotation of the ejection head 50 changes the positional relationship of the ejection nozzles 52 relative to the main scanning direction X. Therefore, when the controller 43 generates data for the printing operation (more specifically, the data representing the timing of driving of the ejection nozzles), it is necessary to previously consider the change in position of the ejection nozzles 52 relative to the main scanning direction X to generate corrected data about the position change.

Figure 14A:
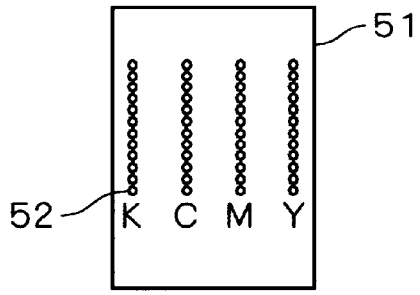
FIGS. 14A, 14B and 14C show another example of the multi-nozzle arrangement of the ejection head, FIG. 14A illustrating the nozzle unit of the ejection head as viewed from the object, FIG. 14B illustrating the nozzle unit rotated in accordance with the inclination angle, FIG. 14C being an enlarged view of the portion A shown in FIG. 14B.
Figure 14B:
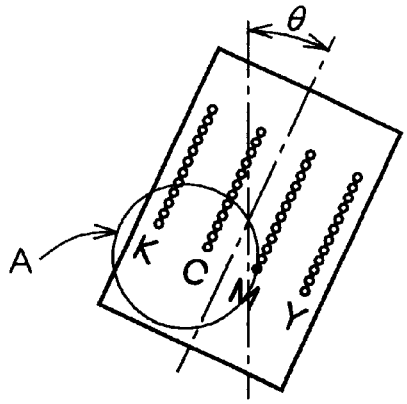
Figure 14C:
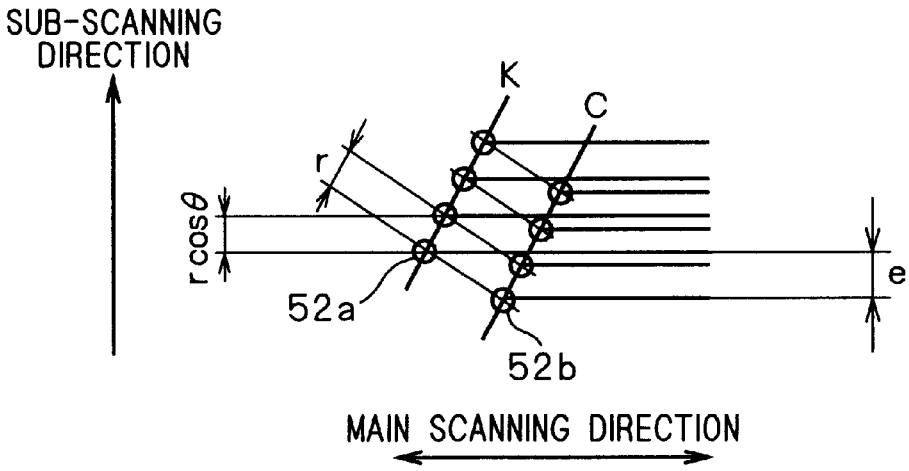

FIGS. 14A, 14B and 14C show a second example of the multi-nozzle arrangement in which an array of ejection nozzles 52 for each color component Y, M, C and K are arranged in a column in the sub-scanning direction Y, and the nozzle arrays for the respective color components are arranged in parallel.

FIG. 14A shows the nozzle unit 51 of the ejection head 50 as viewed from the object 9. As shown in FIG. 14A, the nozzle unit 51 includes the array of ejection nozzles 52 for each color component Y, M, C and K which are arranged in a column in the sub-scanning direction Y, with the nozzle arrays for the respective color components arranged in parallel with the Y direction.

For printing by such an ejection head 50 on the inclined surface at the inclination angle θ with respect to the sub-scanning direction Y, the travel distance L of the ejection head 50 in the sub-scanning direction Y is determined in accordance with the inclination angle θ in the above-mentioned manner, and the rotation angle θ is imparted to the ejection head 50 to rotate the nozzle unit 51 in accordance with the inclination angle θ, as shown in FIG. 14B. Consequently, the column, for each color component, of the ejection nozzles 52 arranged in the sub-scanning direction Y before the rotation forms the angle θ with the sub-scanning direction Y after the rotation.

FIG. 14C is an enlarged view of the portion A (or the ejection nozzle portion) shown in FIG. 14B. The rotation of the nozzle unit 51 in accordance with the inclination angle θ with respect to the sub-scanning direction Y provides a nozzle-to-nozzle spacing in the sub-scanning direction Y which equals r cos θ where r is the physical distance between adjacent nozzles for the same color component in the nozzle unit 51. This substantially reduces the spacing between the ejection nozzles in the sub-scanning direction Y.

Thus imparting the rotation angle equaling the inclination angle θ of the inclined surface to the ejection head 50 allows the spacing between the dots formed by the ink ejected from adjacent ejection nozzles 52 to be maintained at r on the inclined surface. This dot-to-dot spacing r is equal to the spacing between the dots formed by the adjacent ejection nozzles 52 in the case of printing on the horizontal surface by the multi-nozzle arrangement. Therefore, the printing operation by setting the travel distance L of the ejection head 50 in the sub-scanning direction Y so as to provide a dot distribution similar to that on the horizontal surface can form the dots in the gaps of the dot-to-dot spacing r evenly and properly as the ejection head 50 moves in the sub-scanning direction Y.

However, this is based on the consideration focused on the same color component, and causes an unpreferable relationship with other color components. More specifically, the rotation of the nozzle unit 51 through the angle θ causes a K ejection nozzle 52*a* and a C ejection nozzle 52*b* both of which would otherwise scan the same sub-scanning position to differ in sub-scanning position from each other to create a deviation corresponding to a distance e. Therefore, this multi-nozzle arrangement requires printing control for each color component, for example, in such a manner that the printing operation for K is initiated to move the ejection head 50 the distance e in the sub-scanning direction Y and then the printing operation for C is initiated. This involves the problem of the reduction in printing efficiency.

With this multi-nozzle arrangement, the change in position of the ejection nozzles 52 relative to the main scanning direction X also occurs. Therefore, it is necessary to previously generate corrected data about the position change in the main scanning direction X as described above.

Figure 15A:
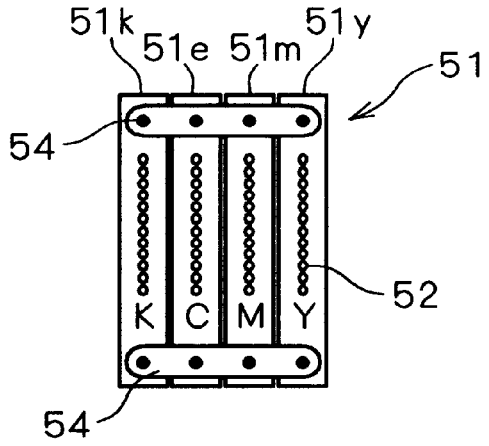
FIGS. 15A, 15B and 15C show still another example of the multi-nozzle arrangement of the ejection head, FIG. 15A illustrating the nozzle unit of the ejection head as viewed from the object, FIG. 15B illustrating nozzle array members of the nozzle unit rotated in accordance with the inclination angle, FIG. 15C being an enlarged view of the portion A shown in FIG. 15B.
Figure 15B:
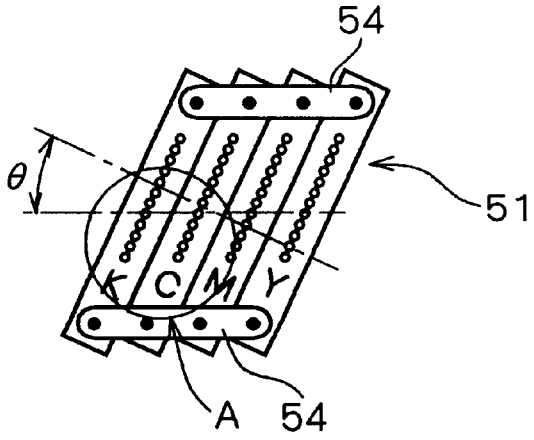
Figure 15C:
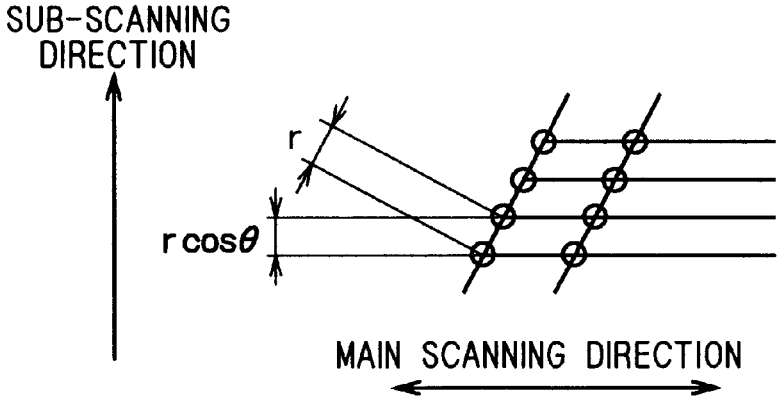

FIGS. 15A, 15B and 15C show a third example of the multi-nozzle arrangement including nozzle array members 51*y*, 51*m*, 51*c* and 51*k* for the respective color components Y, M, C and K, the nozzle array members 51*y*, 51*m*, 51*c* and 51*k* being coupled together by a pair of linkage mechanisms 54.

FIG. 15A shows the nozzle unit 51 of the ejection head 50 as viewed from the object 9. As shown in FIG. 15A, the nozzle unit 51 comprises the nozzle array members 51*y*, 51*m*, 51*c* and 51*k* for the respective color components Y, M, C and K each of which has the array of ejection nozzles 52 arranged in a column in the sub-scanning direction Y, and the pair of linkage mechanisms 54 for coupling the nozzle array members 51*y*, 51*m*, 51*c* and 51*k* together at their opposite ends as viewed in the sub-scanning direction. The linkage mechanisms 54 are designed to prevent the deviation of the positional relationship between the corresponding ejection nozzles 52 for the respective color components in the sub-scanning direction Y when the ejection head rotation driver 30 drives the ejection head 50 to rotate.

For printing by the ejection head 50 having such a nozzle unit 51 on the inclined surface at the inclination angle θ with respect to the sub-scanning direction Y, the travel distance L of the ejection head 50 in the sub-scanning direction Y is determined in accordance with the inclination angle θ in the above-mentioned manner, and the rotation angle θ is imparted to the ejection head 50.

FIG. 15B shows the nozzle unit 51 to which the rotation angle θ is imparted. As shown in FIG. 15B, when the rotation angle θ is imparted to the nozzle unit 51 in accordance with the inclination angle θ, the linkage mechanisms 54 act to rotate the nozzle array members 51*y*, 51*m*, 51*c* and 51*k* through the angle θ. Consequently, the column of the ejection nozzles 52 arranged in the sub-scanning direction Y in each of the nozzle array members 51*y*, 51 m, 51*c* and 51*k* before the rotation forms the angle θ with the sub-scanning direction Y after the rotation.

FIG. 15C is an enlarged view of the portion A (or the ejection nozzle portion) shown in FIG. 15B. The rotation of the nozzle unit 51 in accordance with the inclination angle θ with respect to the sub-scanning direction Y provides a nozzle-to-nozzle spacing in the sub-scanning direction Y which equals r cos θ where r is the physical distance between adjacent nozzles for the same color component in the nozzle unit 51. This substantially reduces the spacing between the ejection nozzles in the sub-scanning direction Y.

Thus imparting the rotation angle equaling the inclination angle θ of the inclined surface to the ejection head 50 allows the spacing between the dots formed by the ink ejected from adjacent ejection nozzles 52 to be maintained at r on the inclined surface. This dot-to-dot spacing r is equal to the spacing between the dots formed by the adjacent ejection nozzles 52 in the case of printing on the horizontal surface by the multi-nozzle arrangement. Therefore, the printing operation by setting the travel distance L of the ejection head 50 in the sub-scanning direction Y so as to provide a dot distribution similar to that on the horizontal surface can form the dots in the gaps of the dot-to-dot spacing r evenly and properly as the ejection head 50 moves in the sub-scanning direction Y.

Additionally, the function of the linkage mechanisms 54 prevents the positional deviation of the corresponding ejection nozzles in the nozzle array members 51*y*, 51*m*, 51*c* and 51*k* in the sub-scanning direction Y.

As illustrated in FIGS. 15A, 15B and 15C, the nozzle unit 51 is divided into the nozzle array members 51*y*, 51*m*, 51*c* and 51*k* in corresponding relation to the ejection nozzle arrays for the respective color components, and the nozzle array members 51*y*, 51*m*, 51*c* and 51*k* are coupled together by the linkage mechanisms 54. This arrangement can prevent the positional deviation of the corresponding ejection nozzles for the respective color components in the sub-scanning direction Y, and also can adjust the spacing between adjacent ejection nozzles 52 in the sub-scanning direction Y, to easily provide four-color simultaneous printing during one main scanning operation, thereby achieving printing on the three-dimensional object 9 most efficiently.

With this multi-nozzle arrangement, the change in position of the ejection nozzles 52 relative to the main scanning direction X also occurs. Therefore, it is necessary to previously generate corrected data about the position change in the main scanning direction X as described above.

B. Second Preferred Embodiment

B1. Construction of Printing Apparatus

Overall Construction

Figure 16:
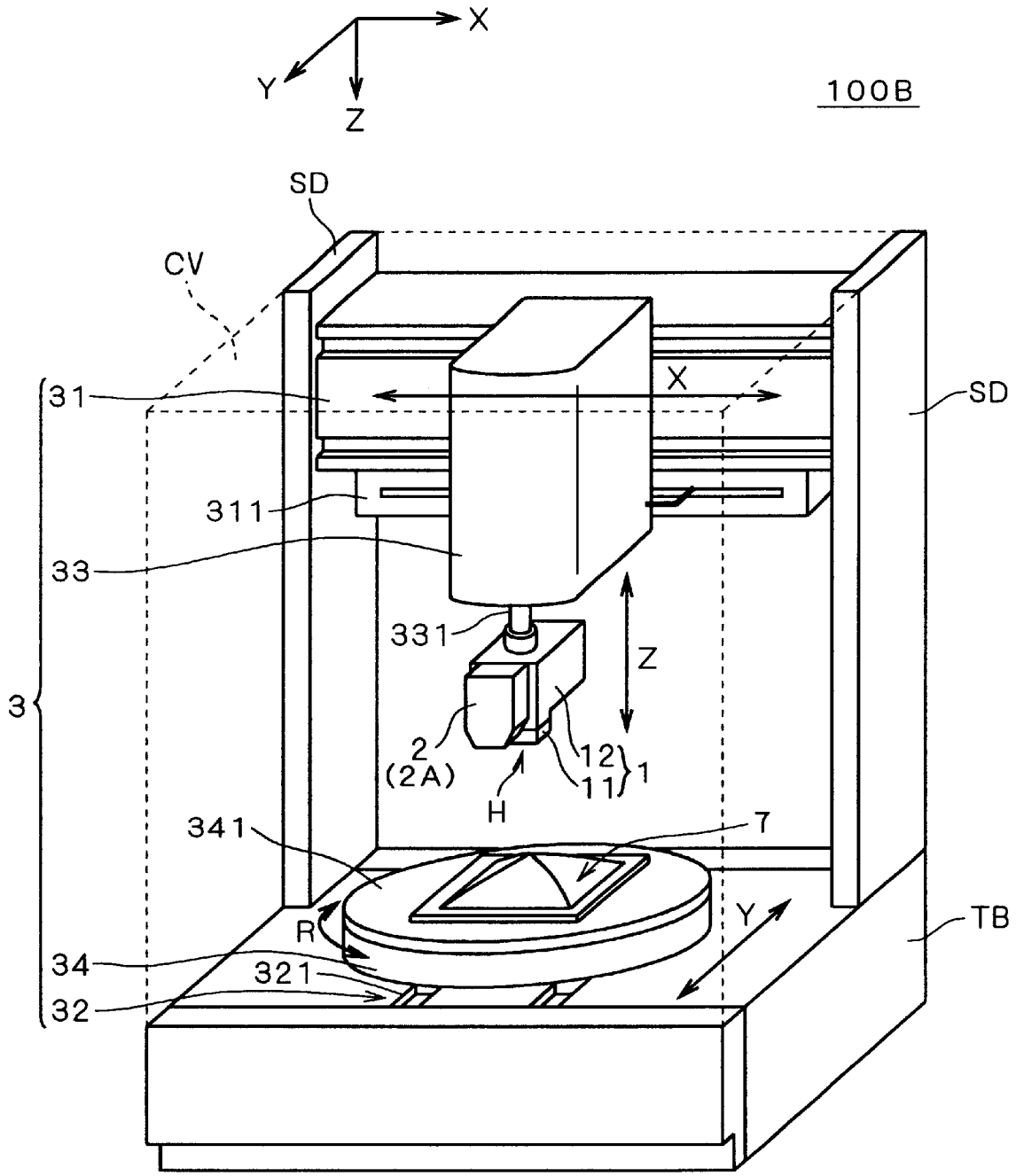
FIG. 16 is a perspective view of the structure of a three-dimensional object printing apparatus according to a second preferred embodiment of the present invention.

FIG. 16 is a perspective view of a three-dimensional object printing apparatus 100B (also referred to simply as a "printing apparatus" hereinafter) according to a second preferred embodiment of the present invention. The printing apparatus 100B is an apparatus for printing on a three-dimensional object. The construction of the printing apparatus 100B will be described with reference to FIG. 16. Three mutually orthogonal axes (X, Y and Z axes) are defined as those depicted in FIG. 16 herein.

Figure 18:
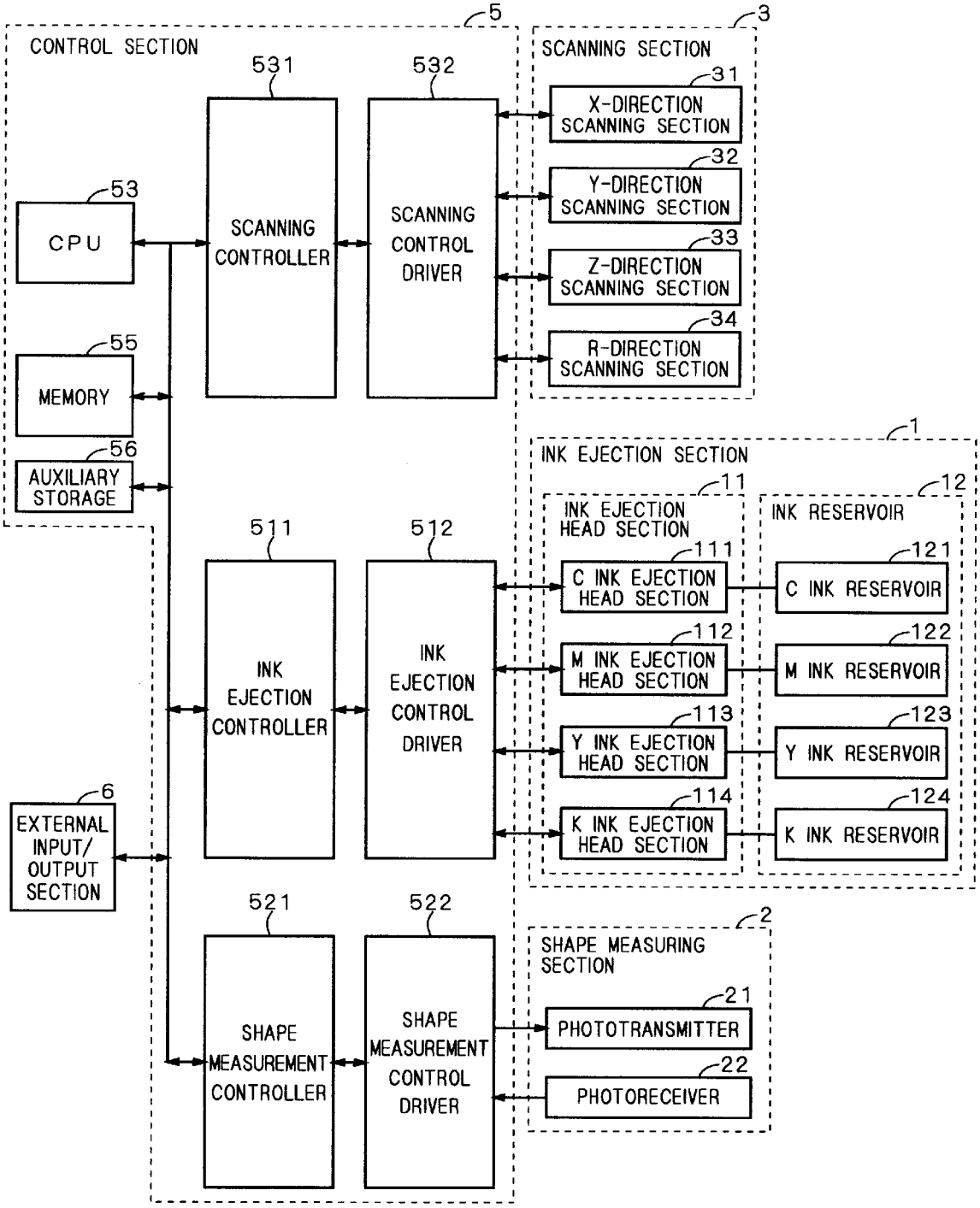
FIG. 18 is a schematic diagram showing the construction of the printing apparatus of FIG. 16.

The printing apparatus 100B comprises an ink ejection section 1, a shape measuring section 2, a scanning section 3, a control section 5, and an external input/output section 6 (See FIG. 18). These sections will be discussed below.

Scanning Section

The scanning section 3 moves the ink ejection section 1 relative to an object 7. More specifically, the scanning section 3 comprises a plurality of scanning sections corresponding to respective axial directions, i.e., an X-direction scanning section 31, a Y-direction scanning section 32, a Z-direction scanning section 33, and an R-direction scanning section 34.

In the printing apparatus 100B, the Y-direction scanning section 32 is contained in a table TB, and moves the R-direction scanning section 34 mounted to an output portion of the Y-direction scanning section 32 linearly in the Y direction. The object 7 is fixed to a turntable 341 serving as an output portion of the R-direction scanning section 34. A three-dimensional object of a pyramidal configuration is illustrated in FIG. 16 as an example of the object 7. A suitable method of fixing the object 7 to the turntable 341 may be used depending on the shape of the object 7. Examples of the fixing method include a method of holding the object 7 at its opposite ends in a manner like a vice, a method of pressing a non-printing portion of the object 7 against the turntable 341 with a spring retainer, and a method of bonding the object 7 to the turntable 341 with an adhesive tape or the like, for example, in the case where the object 7 has a relatively large contact area with the turntable 341 as illustrated. The object 7 is fixed on the turntable 341 by these retaining mechanisms, and is rotated in the R direction, or about the Z axis, by the R-direction scanning section 34.

The printing apparatus 100B further comprises a pair of stands SD extending vertically from the table TB placed horizontally on the floor. Each of the pair of stands SD has a first end mounted on the table TB, and a second end supporting the X-direction scanning section 31, as illustrated in FIG. 16. The X-direction scanning section 31 has an output portion for holding the Z-direction scanning section 33, and moves the Z-direction scanning section 33 linearly in the X direction. The Z-direction scanning section 33 has an output shaft 331 to which are mounted the ink ejection section 1 and the shape measuring section 2 integral with each other to form a print head section H, and moves the print head section H linearly in the Z direction.

Thus, the printing apparatus 100B has the plurality of scanning sections corresponding to the respective directions (X, Y, Z and R directions), i.e., the X-direction scanning section 31, the Y-direction scanning section 32, the Z-direction scanning section 33, and the R-direction scanning section 34. A combination of these scanning sections 31, 32, 33 and 34 corresponding to the respective directions allows the ink ejection section 1 and the shape measuring section 2 to move relative to the object 7 in a three-dimensional space. The printing apparatus 100B further comprises a cover CV indicated by the broken lines in FIG. 16 on the outer periphery thereof for covering the printing apparatus 100B during printing to prevent ink from scattering outwardly and to prevent a user from contacting the driving sections.

Ink Ejection Section

Figure 17:
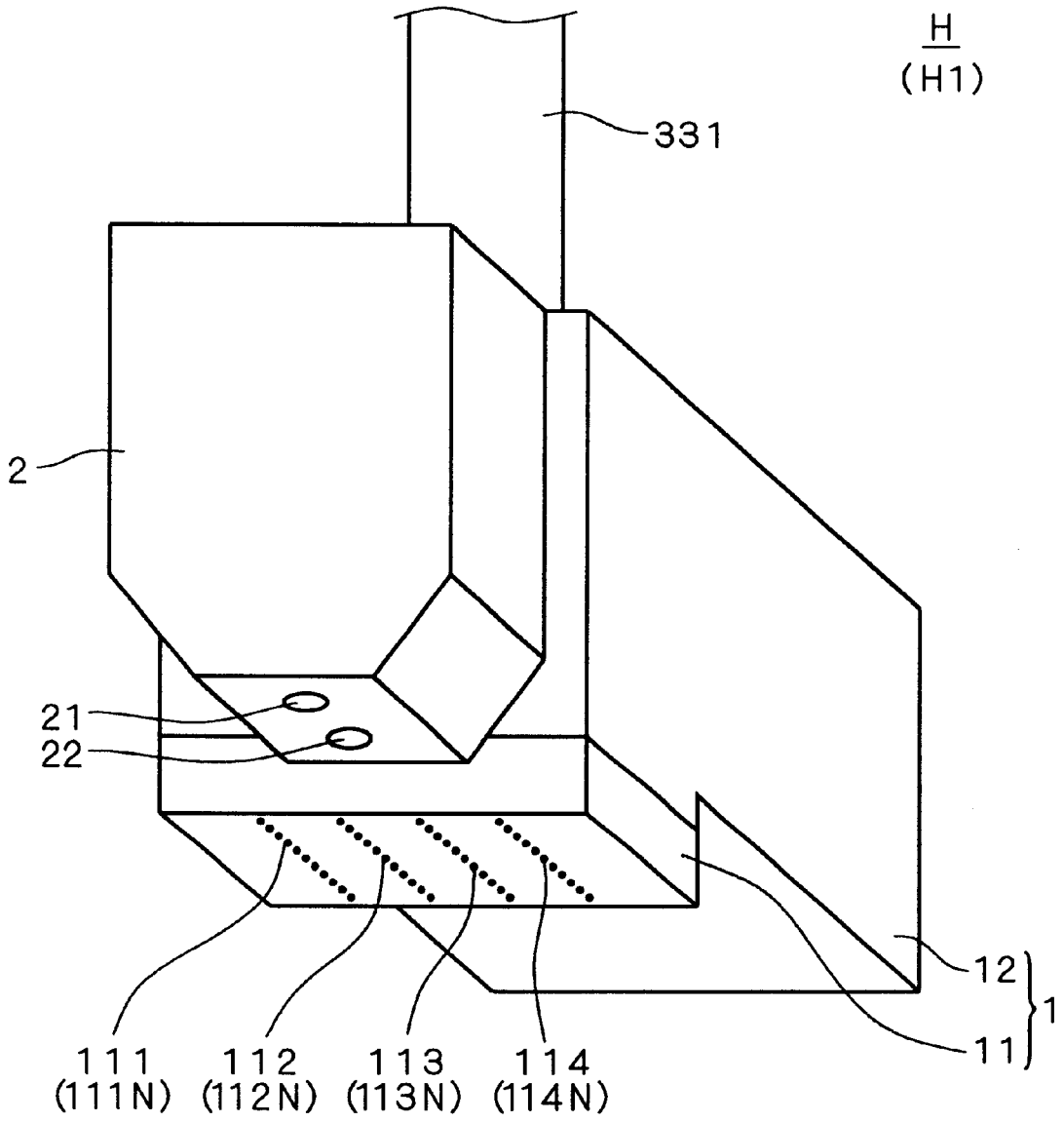
FIG. 17 shows a print head section as viewed obliquely from below.

FIG. 17 shows the print head section H (H1) mounted to the output shaft 331 of the Z-direction scanning section 33 as viewed obliquely from below. The print head section H has the ink ejection section 1 and the shape measuring section 2 disposed integrally together. These sections will be described one by one with reference to FIG. 17.

As illustrated in FIG. 17, the ink ejection section 1 comprises an ink ejection head section 11 and an ink reservoir 12.

The ink ejection head section 11 comprises a C ink ejection head section 111 for ejecting C (cyan) ink, an M ink ejection head section 112 for ejecting M (magenta) ink, a Y ink ejection head section 113 for ejecting Y (yellow) ink, and a K ink ejection head section 114 for ejecting K (black) ink. The four ink ejection head sections 111, 112, 113 and 114 for the respective colors (C, M, Y and K) comprise a plurality of C (cyan) ink ejection nozzles 111N, a plurality of M (magenta) ink ejection nozzles 112N, a plurality of Y (yellow) ink ejection nozzles 113N, and a plurality of K (black) ink ejection nozzles 114N, respectively, for ejecting the inks of the corresponding colors (C, M, Y and K). These nozzles are shown as arranged in a linear array for each of the four colors. It is assumed that the ink ejection nozzles 111N to 114N used herein are of an ink jet type.

The ink reservoir 12 comprises a C ink reservoir 121, an M ink reservoir 122, a Y ink reservoir 123, and a K ink reservoir 124 (See FIG. 18). These ink reservoirs 121, 122, 123 and 124 for the respective colors not shown in FIGS. 16 and 17 are contained in the ink reservoir 12.

The C, M, Y and K ink ejection nozzles 111N to 114N are supplied with the four color inks from the C, M, Y and K ink reservoirs 121 to 124, respectively, to selectively eject the inks toward the object 7. This provides printing (coloring) on the surface of the object 7.

The types of the inks to be used are not limited to those described above. The inks required to color the surface of the object 7 are properly combined depending on the colors and characteristics of the inks. For multi-color printing, it is necessary to provide a plurality of ink ejection head sections for different color inks depending on required colors, and an equal plurality of ink reservoir tanks for storing the respective color inks. For example, the four colors C, M, Y and K may be used singly or in combination, or a combination of R (red), G (green) and B (blue) may be used. Alternatively, a mixture of these color inks or an ink mixed with a luster pigment or the like may be used. The number of inks to be selected among these inks may be increased or decreased, as required, or the sequence of the application of the inks may be changed. For single-color printing (in the case where the ink to be used is of a single color), it is necessary to provide only at least one ink ejection nozzle and at least one ink reservoir tank.

A multi-nozzle arrangement illustrated in FIG. 17 is such that the plurality of ink ejection nozzles 111N to 114N are arranged in a linear array for each color. However, since a smaller head section which can be moved closer to the object is advantageous particularly when the object has a greater inclination or a rougher surface, the number of nozzles may be reduced or a single-nozzle arrangement may be used. However, the decrease in the number of nozzles (or the use of the single-nozzle arrangement) requires longer printing time than the use of a multi-nozzle arrangement including more nozzles. It is therefore preferable to give a higher priority to the reduction in printing time and to use the multi-nozzle arrangement (particularly the multi-nozzle arrangement including a multiplicity of nozzles) when the object 7 has a less rough surface.

Although assumed to be of the ink jet type, the ink ejection nozzles 111N, 112N, 113N and 114N may be of a spray gun type, depending on the characteristic of a required image. Alternatively, the printing apparatus 100B may comprise both ink jet type ejection nozzles and spray gun type ejection nozzles to select between ink ejection from the ink jet type ejection nozzles and ink ejection from the spray gun type ejection nozzles so that the ink jet type ejection nozzles are used to print on a confined area or an area in which a high-definition image is required whereas the spray gun type ejection nozzles are used to coat a wide area with ink in a short time or to print on an area in which moderate blurriness is required.

The ink ejection head section 11 including the ink ejection nozzles and the ink reservoir 12 are shown in FIGS. 16 and 17 as provided integrally in the print head section H, but need not necessarily be integral with each other. It is desirable that the ink ejection nozzles are arranged as close as possible to each other since this arrangement can reduce the head size to make the ink ejection head section 11 easy to approach the object. On the other hand, the ink reservoir 12 may be designed so that C, M, Y and K ink reservoirs 121 to 124 are provided separately from each other. For increase in ink storage capacity of the ink reservoir 12 or for reduction in the entire mounting area thereof to the output shaft 331, the C, M, Y and K ink reservoirs 121 to 124 may be provided in the body of the Z-direction scanning section 33, with flow channels provided between the ink reservoirs 121 to 124 and the ink ejection nozzles.

Shape Measuring Section

Next, the shape measuring section 2 will be described. The shape measuring section 2 described herein is assumed to comprise an optical displacement sensor 2A. The optical displacement sensor 2A of the shape measuring section 2 includes a phototransmitter 21 and a photoreceiver 22. The phototransmitter 21 directs laser light downwardly in the Z direction, and the photoreceiver 22 including a line sensor (CCD, PSD (optical position detecting device) or the like) and a lens receives light diffuse-reflected from the surface of the object 7. Thus, the optical displacement sensor 2A can measure a distance by a triangulation technique. Hence, the surface shape of the three-dimensional object is recognized.

It is assumed herein that a predetermined plane (for example, the plane Z=0) parallel to the X-Y plane is used as a reference plane of measurement and a distance is measured in the Z direction at each point (X, Y). More specifically, the displacement sensor 2A measures a distance from each point (X, Y) within the reference plane to the surface of the object 7 in a direction (Z direction) perpendicular to the reference plane, thereby to measure the shape of the surface of the object 7. The reference plane is also perpendicular to the direction (Z direction) in which the ink ejection section 1 ejects ink. The scanning section 3 is capable of scanning in two directions (X direction and Y direction) parallel to the reference plane.

The shape measuring section 2 is disposed integrally with the ink ejection section 1 in the print head section H, and scans the surface of the object 7 simultaneously with the scanning of the scanning section 3. This eliminates the need for a separate driving mechanism to increase efficiency. Further, the ink ejection section 1 and the shape measuring section 2 are operated simultaneously by the same scanning operation of the scanning section 3, as will be described later, to achieve more efficient measuring and printing operations.

The shape measuring section 2 includes, but is not limited to, the reflective optical sensor. Other optical sensors, contact sensors or ultrasonic sensors may be used. However, the distance information detected by these sensors is obtained as an average value within the area subjected to the distance measurement (for example, the area of a spot irradiated with the laser light in the case of the optical sensor). Then, the resultant three-dimensional shape data is blurred as if it were filtered by a low pass filter. It is therefore preferable to use a sensor capable of measuring a distance within a small area (e.g., as small as the area of a dot formed when ink strikes the surface of the object) in order to detect edges or finely rugged shapes more correctly.

Control Section

The control section 5 will be described with reference to the diagram of FIG. 18. The control section 5, not shown in FIG. 16, is provided inside or separately outside the body of the printing apparatus 100B.

The control section 5 comprises an ink ejection controller 511, an ink ejection control driver 512, a shape measurement controller 521, a shape measurement control driver 522, a scanning controller 531, a scanning control driver 532, a CPU 53, a semiconductor memory (also referred to simply as a "memory" hereinafter) 55 such as a ROM and a RAM, and an auxiliary storage 56 (hard disk drive).

In the memory 55 and/or the auxiliary storage 56 is stored a software program (also referred to simply as a "program" hereinafter) for controlling the driving of the sections 1, 2 and 3, i.e., for controlling the ejection timing of the color inks from the ink ejection section 1, the operation of measurement of the shape measuring section 2 and the scanning of the scanning section 3. Also stored in the memory 55 and/or the auxiliary storage 56 are a program for creating three-dimensional shape data from the distance information obtained by the shape measuring section 2, a program for associating image data with the three-dimensional shape data, a program for planning a printing procedure based on these data, and required data including a geometrical position correction table for the ink ejection nozzles and the shape measuring section 2, a scanning velocity correction table, and an ink ejection timing correction table.

The CPU 53 executes a program containing procedures corresponding to different image formation procedures to be described later to perform sequential processing based on the data stored in the memory 55, thereby outputting control signals to the controllers 511, 521 and 531. The controllers 511, 521 and 531 process the control signals to transmit to the drivers 512, 522 and 532 signals for actually driving the ink ejection section 1, the shape measuring section 2 and the scanning section 3, respectively. In response to these signals, the drivers 512, 522 and 532 drive the respective sections 1, 2 and 3.

The sections 1, 2 and 3 transmit signals through the drivers 512, 522 and 532 to the controllers 511, 521 and 531, as required, respectively. In response to these signals, the CPU 53 feeds back new control signals to the controllers 511, 521 and 531 based on the data stored in the memory 55 or produces and stores new data.

The signals from the sections 1, 2 and 3 include signals for indicating a nozzle trouble and the remaining amount of ink in the ink ejection section 1, the distance information (or two-dimensional or three-dimensional shape data about the surface of the object 7) from a reference position (e.g., the central position of an end surface of the sensor) in the shape measuring section 2 to a laser irradiation position on the surface of the object 7 which is transmitted from the photoreceiver of the shape measuring section 2, and position information from a position sensor (not shown) for each direction in the scanning section 3.

Figure 19:
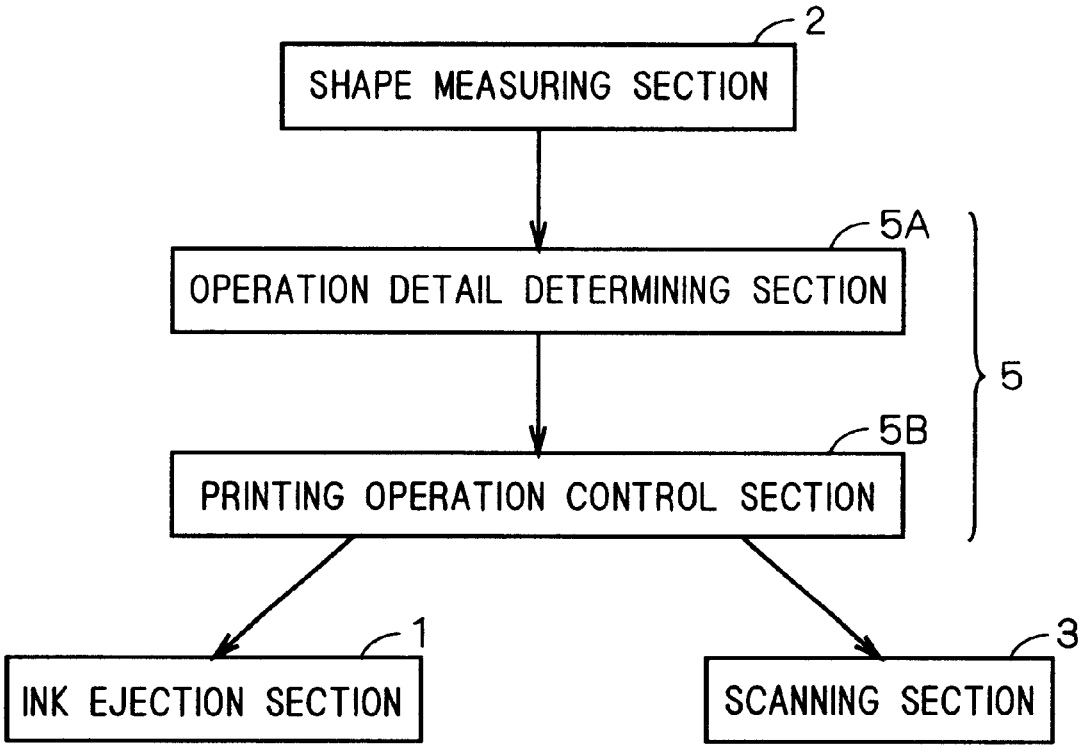
FIG. 19 is a functional block diagram of the printing apparatus of FIG. 16.

FIG. 19 is a functional block diagram of the printing apparatus 100B. The control section 5 executes the above-mentioned corresponding programs in the CPU 53 to function as an operation detail determining section 5A and a printing operation control section 5B. The operation detail determining section 5A functions to determine the details of operations of the ink ejection section 1 and the scanning section 3 in accordance with information about the inclination of the surface of the object which is included in the three-dimensional shape data obtained using the shape measuring section 2. The printing operation control section 5B functions to control the operations of the ink ejection section 1 and the scanning section 3 to perform the printing operation in accordance with the details of operations determined by the operation detail determining section 5A.

External Input/Output Section

The external input/output section 6 is provided inside the printing apparatus body shown in FIG. 16 as a part thereof and/or separately provided outside the printing apparatus body, and functions as an interface to an operator of the printing apparatus. More specifically, the external input/output section 6 comprises an indicator (output portion) such as a monitor and a lamp, and an input portion such as a keyboard, a teaching pendant and an emergency stop button. The external input/output section 6 is used, for example, to input printing start and stop signals, to indicate information in the event of trouble, to operate an emergency stop or the like in the event of trouble, and to rewrite the contents of the memory 55. These signals are transmitted through internal buses for interconnection between the external input/output section 6, and the CPU 53, the memory 55 and the controllers 511, 521, 531, as illustrated in FIG. 18.

B2. Operation in Printing Apparatus

The printing operation is performed by the above-mentioned mechanisms. Specifically, the scanning section 3 causes the shape measuring section 2 to scan the surface of the object 7, and the shape measuring section 2 measures the shape of the surface of the object 7. Based on the three-dimensional shape data obtained from the result of the measurement in the shape measuring section 2, the ink ejection section 1 ejects ink toward a print area of the object 7 during the scanning by the scanning section 3 through positions spaced apart in the Z direction from ink striking positions relative to the print area of the object 7. Thus, a desired image is formed (or printed) on the surface of the object 7. These sections 1, 2 and 3 are controlled by the above-mentioned control section 5.

Operation in the printing apparatus 100B according to the second preferred embodiment will be described with reference to the flowchart of FIG. 20.

Upon initiating the operation in response to an operation start instruction (Step S100), the printing apparatus 100B uses the control section 5 to control the X-, Y-, Z- and R-direction scanning sections 31, 32, 33 and 34 to return the scanning section 3 to its mechanical home position (Step S111). For example, the topmost, leftmost and rearmost position to which the scanning section 3 can move as viewed in FIG. 16 is defined as the home position.

Next, the shape measuring section 2 is used to obtain the three-dimensional shape data about the object 7. To this end, the shape measuring section 2 in the print head section H scans the surface of the object 7 through a predetermined distance (beyond a printable range in the X direction) in a predetermined, positive or negative, main scanning direction (e.g., from left (−X) to right (+X) or in the +X direction as viewed in FIG. 16; assuming that the main scanning direction is the X direction herein). The term "main scanning direction" used herein means the direction in which the print head section H moves continuously. While scanning in the above-mentioned manner, the shape measuring section 2 measures a distance (in the Z direction) from the shape measuring section 2 to the laser irradiation position on the surface of the object 7 (Step S112).

The operation of measuring the distance in the Z direction at spots of measurement (the laser exposed positions) may be performed either at predetermined time intervals or so as to provide approximately equal spacings of measurement on the surface of the object 7. Further, this operation may be performed at irregular intervals. The two-dimensional position coordinates (X, Y) of each spot of measurement are determined based on a position detection result from an X-direction position detector (linear encoder) 311 (FIG. 16) in the X-direction scanning section 31 and a position detection result from a Y-direction position detector (linear encoder) 321 (FIG. 16) in the Y-direction scanning section 32. Therefore, the printing apparatus 100B can establish correspondence between the measurement value of the distance (in the Z direction) from the shape measuring section 2 to the laser irradiation position on the surface of the object 7 and the two-dimensional position coordinates (X, Y) of the corresponding spot of measurement, independently of the types of intervals of measurement. This achieves the measurement of the shape of the surface of the object 7 to provide the three-dimensional shape data about the object 7.

If a distance measurement range in the Z direction is sufficiently large, the shape measuring section 2 may scan at a constant elevation. If the distance measurement range in the Z direction is small, the shape measuring section 2 may scan while being controlled in the Z direction so that the distance from the surface of the object 7 does not exceed the distance measurement range, based on the detected distance value. In this case, both a detected current position value from a Z-direction position detector (not shown) contained in the Z-direction scanning section 33 and the detected distance value are used to obtain the position information about the surface of the object 7.

After the distance measurement for one line, a judgment is made as to whether or not all of the distance measurements within the target range of distance measurement (not less than the allowable size of the object in the X and Y directions) is completed (Step S113). If all of the distance measurements are completed, the flow proceeds to Step S121. If all of the distance measurements are not completed, the flow returns to Step S112 again to perform the distance measurement for the next line.

For the distance measurement for the next line, the shape measuring section 2 is moved to a distance measurement start position for the next line, that is, a position shifted a predetermined distance in the +Y direction (toward the viewer of the figure) or a positive sub-scanning direction (orthogonal to the main scanning direction) but not shifted in the main scanning direction (X direction) from the distance measurement start position for the current line (Step S114). Then, scanning in the main scanning direction is started again. Repeating such an operation provides the distance measurements within a predetermined range of distance measurement. The detected values obtained by these distance measurements and other data are stored in the memory 55.

After all of the distance measurements within the target range of shape measurement are completed, the resultant data are processed to produce the three-dimensional shape data about the object 7 in a predetermined format (Step S121).

Next, print image data is obtained (Step S122). The print image data is obtained by inputting through the external input/output section 6 (such as a scanner). Alternatively, an operator may selectively determine the print image data among a plurality of data previously stored in the memory 55 or obtain the single stored data without freedom of choice.

Then, matching is performed between the three-dimensional shape data obtained by the measurement and the image data (print image data) to be printed on the surface of the object. In other words, the print image data is located and affixed to the three-dimensional shape data about the surface of the object 7 (Step S123). This produces data affixed to the object. This process may be performed by an operator manually inputting the data while viewing an output portion (such as monitor) of the external input/output section 6 or performed automatically in accordance with a predetermined setting. The data affixed to the object is produced based on the three-dimensional shape data obtained by measurement and the image data to be printed on the surface of the object. This enhances the precision of the produced data about positions to achieve a high-quality printing process.

Thereafter, scanning control data and ink ejection control data are produced (Step S124). More specifically, a scanning path is determined, and data for scanning control about the positions, velocities and accelerations of the X-, Y-, Z- and R-direction scanning sections 31, 32, 33 and 34 for each unit of time is produced. Also produced is data about the timing of ejection of the ink from the ink ejection nozzles in corresponding relation to the scanning control. The operation detail determining section 5A produces these data (or determines the details of the operation).

Figure 21:
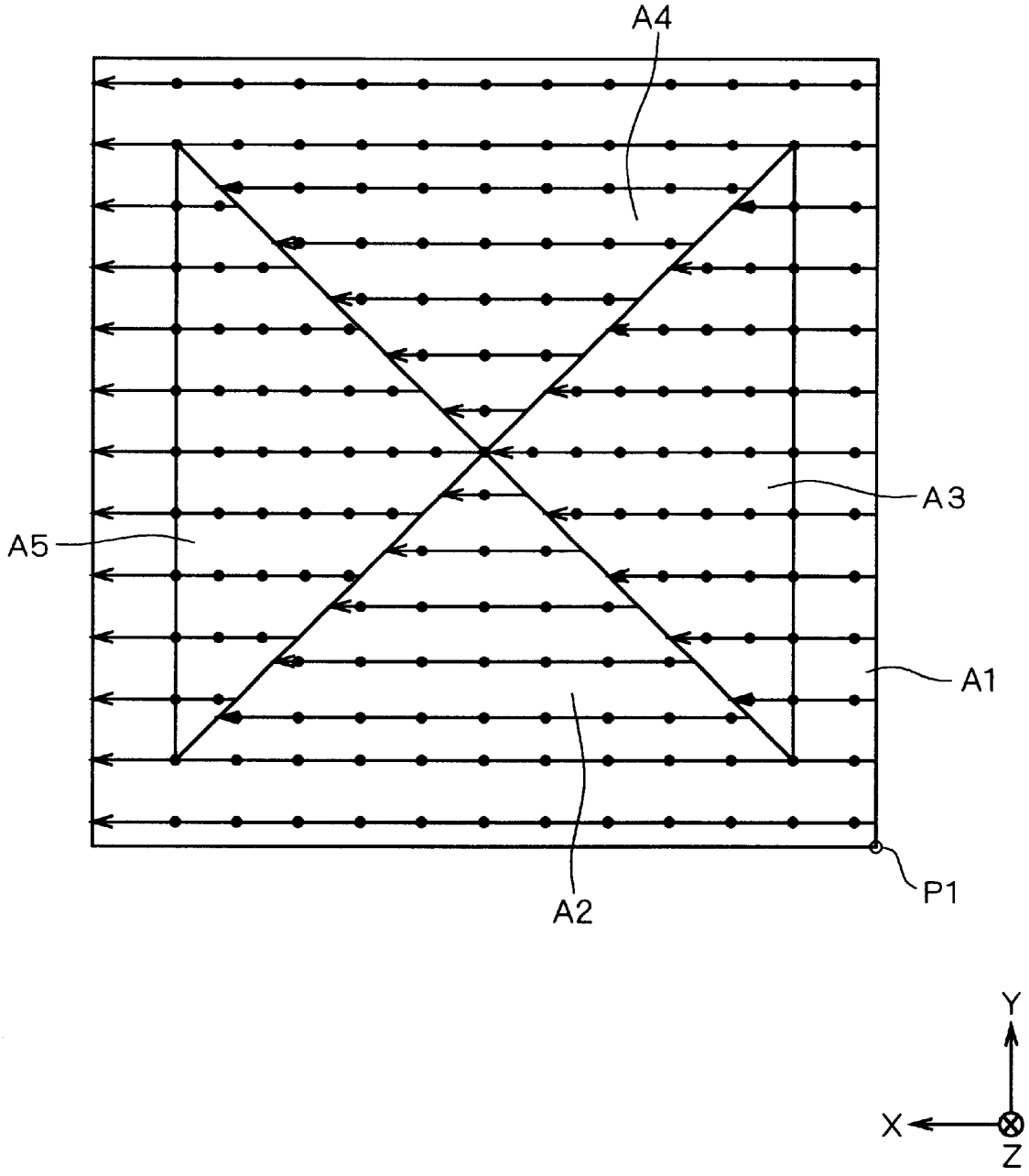
FIG. 21 is a top plan view of an object to be printed as viewed from the −Z direction.
Figure 22:
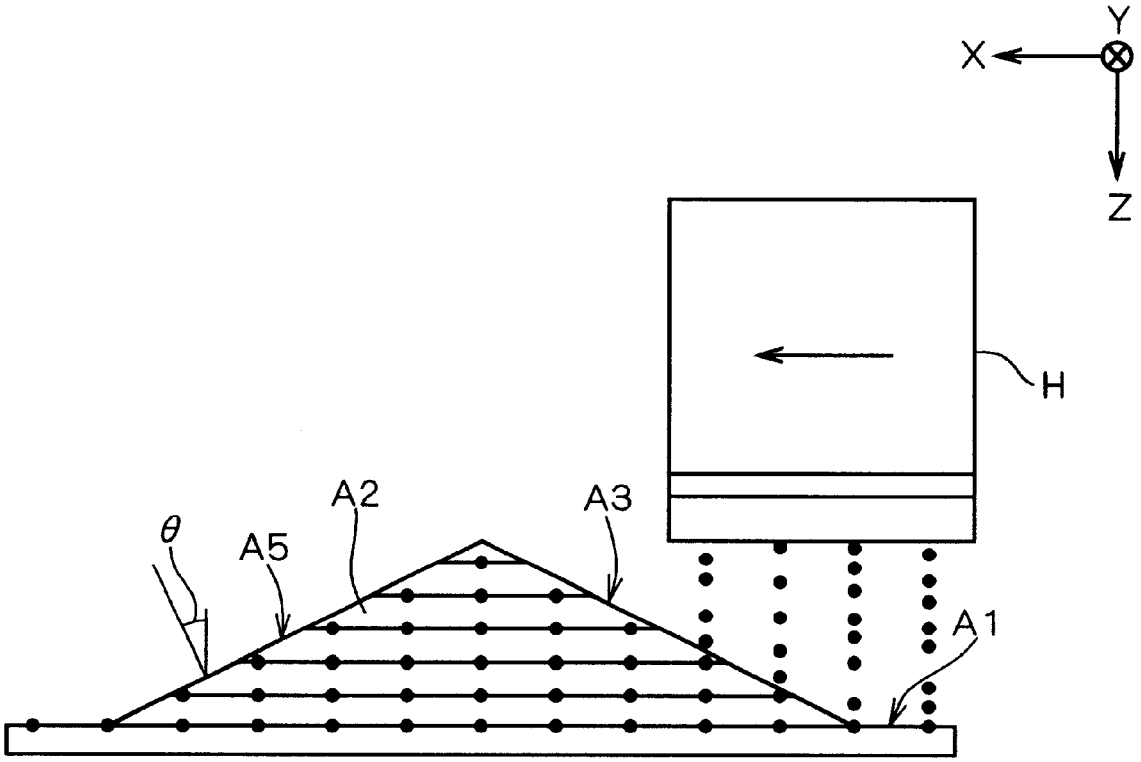
FIG. 22 is a side view of the object as viewed from the −Y direction.

The object 7 described herein is of a pyramidal configuration, as shown in FIG. 16. FIG. 21 is a top plan view of the object 7 as viewed from the −Z direction. FIG. 22 is a side view of the object 7 as viewed from the −Y direction. The closed circles of FIGS. 21 and 22 indicate the ink striking positions in exaggeration, with some of the actual ink striking positions omitted, and the arrows of FIGS. 21 and 22 indicate the paths of the nozzles when ejecting the ink toward the ink striking positions.

When the spacing between the ink striking positions on a face A1 of FIG. 21 in the main scanning direction (X direction) and in the sub-scanning direction (Y direction) is assumed to be 1, the ink is ejected onto faces A2 and A4 at a spacing of 1 in the main scanning direction and at a spacing of cos θ in the sub-scanning direction and to strike faces A3 and A5 at a spacing of cos θ in the main scanning direction and at a spacing of 1 in the sub-scanning direction, where θ is an angle formed between a vector normal to each inclined part of the object 7 and the Z axis. Thus, ejection of the ink onto all of the faces so as to always provide the same resolution as viewed in the direction normal to the faces reduces difference in print quality depending on the direction.

More specifically, the ink ejection operations in the main scanning direction and in the sub-scanning direction may be performed in a manner described with reference to FIGS. 3, 5 and 6.

First, the ink ejection operation (or the ejection pattern control) in the sub-scanning direction (Y direction) is achieved in a manner described with reference to FIG. 3. It should be noted that the ejection head 50 shown in FIG. 3 corresponds to the print head H of the second preferred embodiment. The stepwise travel distance of the ink ejection section 1 relative to the object 7 in the sub-scanning direction is determined in accordance with information about the inclination of the surface of the object 7. Therefore, consideration of information about the position in which the object 7 is actually disposed achieves the printing operation which ensures the uniform dot distribution more precisely.

The ejection pattern control in the main scanning direction X is achieved in a manner described with reference to FIGS. 5 and 6. More specifically, adoptable methods of ejection pattern control in the main scanning direction X includes: a method of changing the travel velocity (main scanning velocity) $V_\theta$ of the print head in accordance with the inclination angle θ so as to satisfy $V_\theta = V \times \cos\theta$ while fixing the ink ejection frequency at the constant value f, as shown in FIG. 5; and a method of changing the time intervals of ink ejection (i.e. the driving frequency of the ejection nozzles) in accordance with the inclination while fixing the main scanning velocity of the print head H at the fixed value V, as shown in FIG. 6. These methods can provide the dot-to-dot spacing which equals the constant value d on the inclined surface independently of the inclination angle θ, to achieve the uniform dot distribution.

The high-quality printing operations (FIGS. 3, 5 and 6) which provide a constant resolution on the inclined surface are described hereinabove. Another operation for high-quality printing will be described below.

First, the operation of controlling the ink ejection head section 11 also in the Z direction at the time of printing will be described. This operation is to prevent the deviation of the ink striking positions and a problem known as satellite which result from the structure of the ink ejection nozzles and the like in the case of an increased distance (e.g. in the Z direction) between the ink ejection nozzles and the ink striking positions. Such problems are solved by controlling the scanning in the vertical direction (Z direction) so that the ink ejection nozzles are always within a predetermined distance from the ink striking positions. To this end, the scanning control data for the X-, Y-, Z- and R-direction scanning sections 31, 32, 33 and 34 may be produced so that the ink ejection head section 11 moves within planes perpendicular to the normal vectors to the respective faces of the object 7, or within planes parallel to the respective faces of the object 7.

Another solution to the above-mentioned problems is to select some ejection nozzles for use in printing among all of the ejection nozzles of the ink ejection head section 11 of a multi-nozzle arrangement, based on the distance between the ejection nozzles and the object during the printing operation, to perform the printing operation using the selected ejection nozzles. This suppresses an error of the dot striking positions on the object 7 within tolerance to prevent the deterioration in quality of the printed image on the object 7.

This operation will now be described in detail with reference to FIGS. 23A, 23B, 23C and 23D (in the sub-scanning direction) and FIGS. 24A, 24B, 24C and 24D (in the main scanning direction).

The ejection control in the sub-scanning direction Y is described in detail hereinafter.

FIGS. 23A, 23B, 23C and 23D show the ejection control in the sub-scanning direction Y. The paths of ink ejection from enabled (or available) ejection nozzles (i.e. ejection nozzles allowed to eject ink) are shown by the solid lines in FIGS. 23A, 23B, 23C and 23D, and the paths of ink ejection from disabled (or unavailable) ejection nozzles (i.e. ejection nozzles inhibited from ejecting ink) are shown by the broken lines.

In the process of moving the print head section H in the sub-scanning direction Y, a minimum clearance (gap) between the print head section H and the object 7 is maintained at a predetermined value $r_0$ to avoid the interference between the print head section H and the object 7. The minimum clearance is a minimum spacing between a part of the print head section H which is opposed to the object 7 and a surface part of the object 7. To maintain the minimum clearance at the predetermined value $r_0$, the Z-direction scanning section 33 is driven in accordance with the scanning position of the print head section H to adjust the vertical position of the print head section H in the Z direction.

Figure 23A:
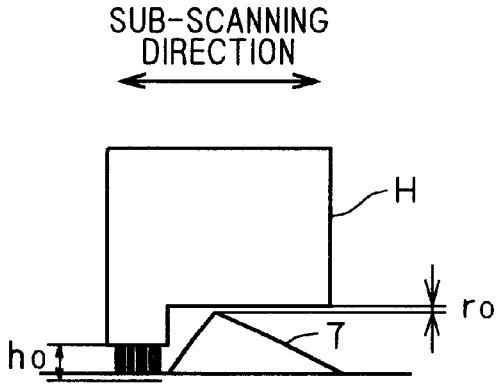
FIGS. 23A, 23B, 23C and 23D show ink ejection control (in the sub-scanning direction) with ejection nozzle control, FIG. 23A illustrating printing on a horizontal part of the object, FIG. 23B illustrating printing on a steeply inclined surface of the object, FIG. 23C illustrating printing on the top of the object, FIG. 23D illustrating printing on a gently inclined surface of the object.

FIG. 23A shows printing on a horizontal part of the object 7. A distance h between each ejection nozzle and the object 7 is determined, with the minimum clearance between the print head section H and the object 7 maintained at the predetermined value $r_0$. As a result, all of the ejection nozzles satisfy the relationship: $h \leqq h_0$ where $h_0$ is an allowable distance. Therefore, all of the ejection nozzles eject ink to achieve efficient printing in the case of FIG. 23A.

Figure 23B:
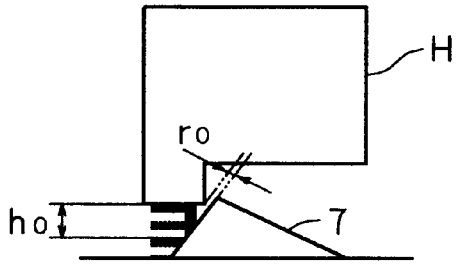

FIG. 23B shows printing on a steeply inclined surface of the object 7. The distance h between each ejection nozzle and the object 7 is determined, with the minimum clearance between the print head section H and the object 7 maintained at the predetermined value $r_0$. As a result, ejection nozzles for ejection toward an upper part of the inclined surface satisfy $h \leqq h_0$, whereas ejection nozzles for ejection toward a lower part of the inclined surface satisfy $h > h_0$. Therefore, the ejection nozzles for ejection toward the lower part of the inclined surface are disabled, and only the ejection nozzles for ejection toward the upper part of the inclined surface are used for printing.

Figure 23C:
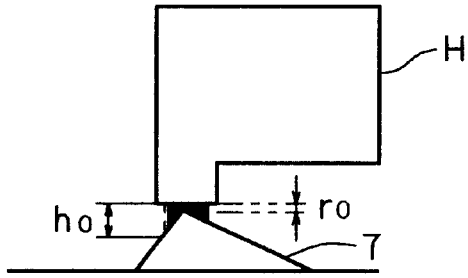

FIG. 23C shows printing on the top of the object 7. The distance h between each ejection nozzle and the object 7 is determined, with the minimum clearance between the print head section H and the object 7 maintained at the predetermined value $r_0$. As a result, ejection nozzles for ejection toward about the top satisfy $h \leqq h_0$, whereas some of the ejection nozzles for ejection toward the steeply inclined surface satisfy $h > h_0$. Therefore, these ejection nozzles which satisfy $h > h_0$ are disabled, and only the ejection nozzles for ejection toward about the top are used for printing.

Figure 23D:
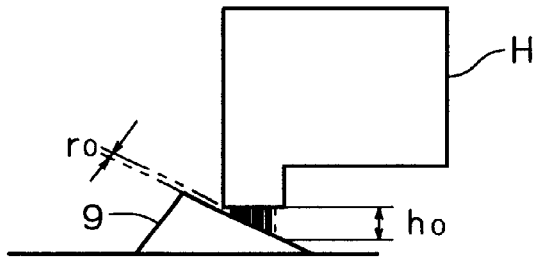

FIG. 23D shows printing on a gently inclined surface of the object 7. The distance h between each ejection nozzle and the object 7 is determined, with the minimum clearance between the print head section H and the object 7 maintained at the predetermined value $r_0$. As a result, ejection nozzles for ejection toward an upper part of the inclined surface satisfy $h \leqq h_0$, whereas ejection nozzles for ejection toward a lower part of the inclined surface satisfy $h > h_0$. Therefore, the ejection nozzles for ejection toward the lower part of the inclined surface are disabled, and only the ejection nozzles for ejection toward the upper part of the inclined surface are used for printing. A smaller number of ejection nozzles are disabled in printing on the gently inclined surface than in printing on the steeply inclined surface. This provides efficient printing.

Thus, while moving the print head section H in the sub-scanning direction Y, the printing apparatus 100B determines the distance h in accordance with the position of the ejection nozzles during the printing, and selects only the ejection nozzles having the distance h falling within the range specified by the allowable distance $h_0$ to use the selected ejection nozzles for printing. This allows the ink to strike the object 7 within the tolerance of the target position, or suppresses the deterioration of quality of the printed image. The selection of the ejection nozzles is made using the information about the inclination of the surface of the object which is included in the three-dimensional shape data.

Next, the ejection control in the main scanning direction X is described in detail hereinafter.

FIGS. 24A, 24B, 24C and 24D show the ejection control in the main scanning direction X. The paths of ink ejection from enabled ejection nozzles (i.e. ejection nozzles allowed to eject ink) are shown by the solid lines in FIGS. 24A, 24B, 24C and 24D, and the paths of ink ejection from disabled ejection nozzles (i.e. ejection nozzles inhibited from ejecting ink) are shown by the broken lines.

In the process of moving the print head section H in the main scanning direction X, the minimum clearance between the print head section H and the object 7 is maintained at the predetermined value $r_0$ to avoid the interference between the print head section H and the object 7. In this case, the Z-direction scanning section 33 is driven, as required, to adjust the vertical position of the print head section H in the Z direction.

Figure 24A:
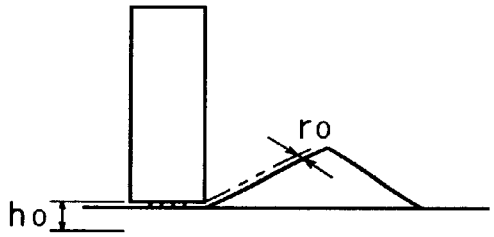
FIGS. 24A, 24B, 24C and 24D show ink ejection control (in the main scanning direction) with ejection nozzle control, FIG. 24A illustrating printing on a horizontal part of the object, FIG. 24B illustrating printing on a gently inclined surface of the object, FIG. 24C illustrating printing on the top of the object, FIG. 24D illustrating printing on a steeply inclined surface of the object.

FIG. 24A shows printing on a horizontal part of the object 7. The distance h between each ejection nozzle and the object 7 is determined, with the minimum clearance between the print head section H and the object 7 maintained at the predetermined value $r_0$. As a result, all of the ejection nozzles satisfy the relationship: $h \leqq h_0$. Therefore, all of the ejection nozzles eject ink to achieve efficient printing in the case of FIG. 24A.

Figure 24B:
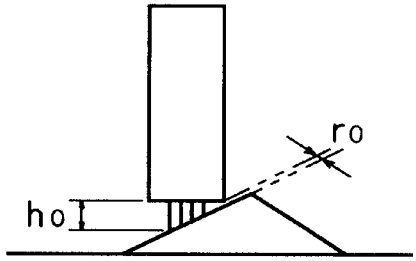

FIG. 24B shows printing on a gently inclined surface of the object 7. The distance h between each ejection nozzle and the object 7 is determined, with the minimum clearance between the print head section H and the object 7 maintained at the predetermined value $r_0$. As a result, all of the ejection nozzles satisfy $h \leqq h_0$. Therefore, all of the ejection nozzles eject ink to achieve efficient printing in the case of FIG. 24B.

Figure 24C:
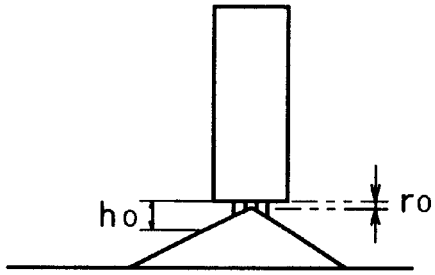

FIG. 24C shows printing on the top of the object 7. The distance h between each ejection nozzle and the object 7 is determined, with the minimum clearance between the print head section H and the object 7 maintained at the predetermined value $r_0$. As a result, all of the ejection nozzles satisfy $h \leqq h_0$. Therefore, all of the ejection nozzles eject ink to achieve efficient printing in the case of FIG. 24C.

Figure 24D:
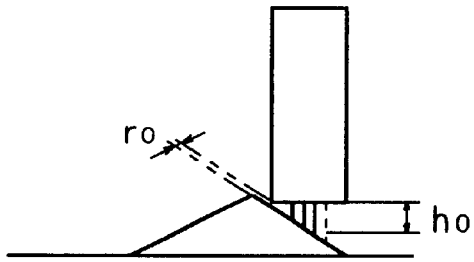

FIG. 24D shows printing on a steeply inclined surface of the object 7. The distance h between each ejection nozzle and the object 7 is determined, with the minimum clearance between the print head section H and the object 7 maintained at the predetermined value $r_0$. As a result, ejection nozzles for ejection toward an upper part of the inclined surface satisfy $h \leqq h_0$, whereas ejection nozzles for ejection toward a lower part of the inclined surface satisfy $h > h_0$. Therefore, the ejection nozzles for ejection toward the lower part of the inclined surface are disabled, and only the ejection nozzles for ejection toward the upper part of the inclined surface are used for printing.

Thus, the printing apparatus 100B can select some ejection nozzles for use in printing among all of the ejection nozzles of the ink ejection head section 11 of a multi-nozzle arrangement, based on the distance between each ejection nozzle and the object during the printing operation, to perform the printing operation using the selected ejection nozzles. The selection of the ejection nozzles is made using the information about the inclination of the surface of the object which is included in the three-dimensional shape data.

As described hereinabove, when the object has a three-dimensional shape, it is preferable, as in the present invention, to previously make the distance measurements not only in the main scanning direction but also in the sub-scanning direction to obtain the three-dimensional position information, and thereafter to segment the surface of the object into regions so that the faces of the respective regions have the same (or substantially the same) vector normal thereto (or has substantially the same inclination) to plan the scanning control procedure and the ink ejection procedure for each of the regions (having substantially the same inclination).

In the example shown in FIG. 21 or 22, the CPU 53 produces the control data based on the data stored in the memory 55 so that printing (the ink ejection operation and the scanning operation) starts from the home position P1 and is sequentially performed on the faces A1, A2, A3, A4 and A5 of five segmented regions. The data about the scanning velocity, the ink ejection timing and the travel distance in the sub-scanning direction is set for each segmented region. Such a setting operation is performed by the operation detail determining section 5A.

In consideration for the continuity of the regions to be printed, the printing apparatus 100B shall perform each of the ink ejection operation on the faces A2 and A4 and the ink ejection operation on the faces A3 and A5 during a continuous series of scanning operations considered collectively as a unit. In other words, the sequence of the ink ejection operation on the faces is: (1) the face A1, (2) the faces A2 and A4, and (3) the faces A3 and A5.

Figure 20:
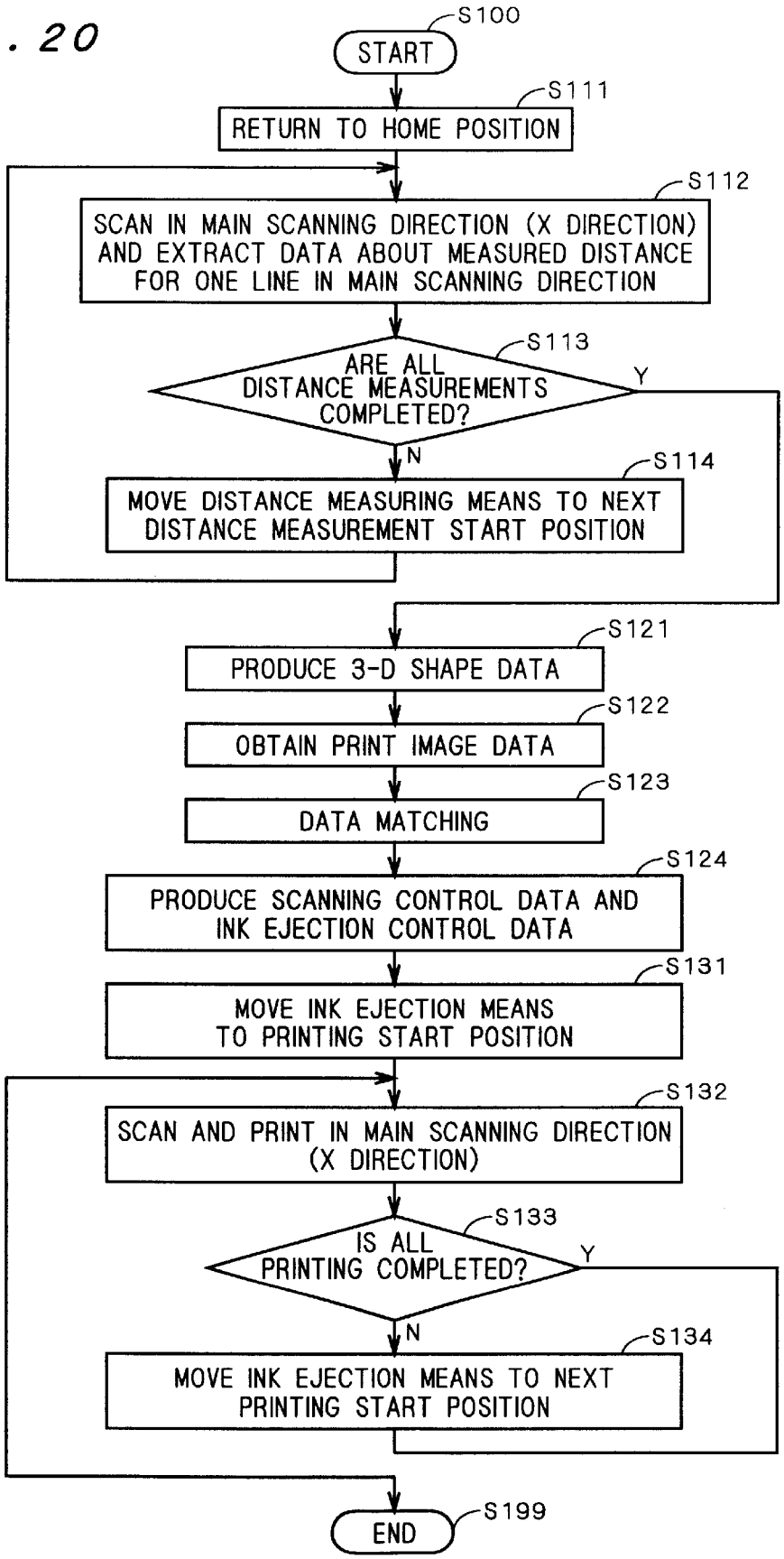
FIG. 20 is a flowchart showing the operation of the printing apparatus according to the second preferred embodiment.

Referring again to the flowchart of FIG. 20, in Step S131, printing starts based on the data produced in Step S124. To this end, the ink ejection head section 11 is moved to the position of the point P1 of FIG. 21 (Step S131). Next, the X-direction scanning section 31 is controlled, and the Z-direction scanning section 33 is controlled to maintain the vertical clearance at a predetermined distance. Then, scanning for one line is performed in the main scanning direction. In synchronism with the scanning, the ink ejection nozzles 111N, 112N, 113N and 114N eject ink toward a first region to be printed, based on the above-mentioned data (Step S132). If it is not judged that all of the printing is completed in Step S133, the ink ejection head section 11 moves to the next printing start position (Step S134) to start printing in the next main scanning line.

In accordance with the ink ejection operation and the scanning operation which are determined for each of the segmented regions A1 to A5, such a printing operation is performed in the above-mentioned sequence of the segmented regions: (1) A1, (2) A2 and A4, and (3) A3 and A5.

If it is judged that all of the printing is completed in Step S133, the printing operation is terminated (Step S199).

As described hereinabove, the printing apparatus 100B according to this preferred embodiment measures the shape of the surface of the object 7, obtains the three-dimensional shape data about the object 7 based on the result of measurement, determines the details of the operations of the ink ejection section 1 and the scanning section 3 in accordance with the information about the inclination of the surface of the object 7 which is included in the obtained three-dimensional shape data, and controls the operations of the scanning section 3 and the ink ejection section 1 in accordance with the details of the operations thereof to perform the printing operation. Printing in accordance with the information obtained by measurement on the inclination of the surface of the object 7 achieves a high-quality printing process.

Although the print area of the object 7 having a simple pyramidal shape is segmented into the plurality of regions A1 to A5 in the above description, the surface of the object 7, if having a complicated shape, may be segmented into a plurality of regions which two-dimensionally approximate the surface shape of the object 7. In other words, the printing target surface of the object 7 may be approximated by n faces (polygonal faces) (where n is an integer) based on the three-dimensional shape data. If the surface of the object 7 has a smoothly rugged shape, the surface shape may be represented as a set of polygonal faces by processing the data about the surface. These polygonal faces are formed by segmentation such that a region in which a normal vector to the surface of the object 7 at each position lies within a predetermined allowable range (or a region having substantially the same inclination) is defined as the same segmented region (polygonal face) and a region in which the normal vector at each position exceeds the predetermined allowable range (or a region having a different inclination) is defined as a different region (polygonal face).

<C. Third Preferred Embodiment>

Although it is assumed that the three-dimensional shape data about the three-dimensional object is completely unknown in the second preferred embodiment, a third preferred embodiment of the present invention will now be described assuming that three-dimensional shape model data representing the three-dimensional shape of the object is previously known and obvious. The three-dimensional shape model data to be prepared need not be so detailed but may be expressed to the extent that the overview of the object is appreciable.

For printing on the three-dimensional object according to the third preferred embodiment, the print area of the object 7 is segmented into a plurality of regions A1 to A5 which two-dimensionally approximate the surface shape of the object 7 based on the previously given three-dimensional shape model data. Then, the shape measuring section 2 measures the three-dimensional shape of each segmented region in detail, and the control section 5 determines the details of the ink ejection operation and the details of the scanning operation to perform the printing operation. The operations (of measurement, determination and printing) are performed for each of the segmented regions to reduce the amount of data to be handled collectively. This is particularly useful when the capacity of the memory 55 is not large enough to handle the data about the entire print area at a time as in the second preferred embodiment.

The printing apparatus according to the third preferred embodiment is different in operation from but similar in physical construction to the printing apparatus of the second preferred embodiment. The operation of the printing apparatus of the third preferred embodiment will now be principally described.

Figure 25:
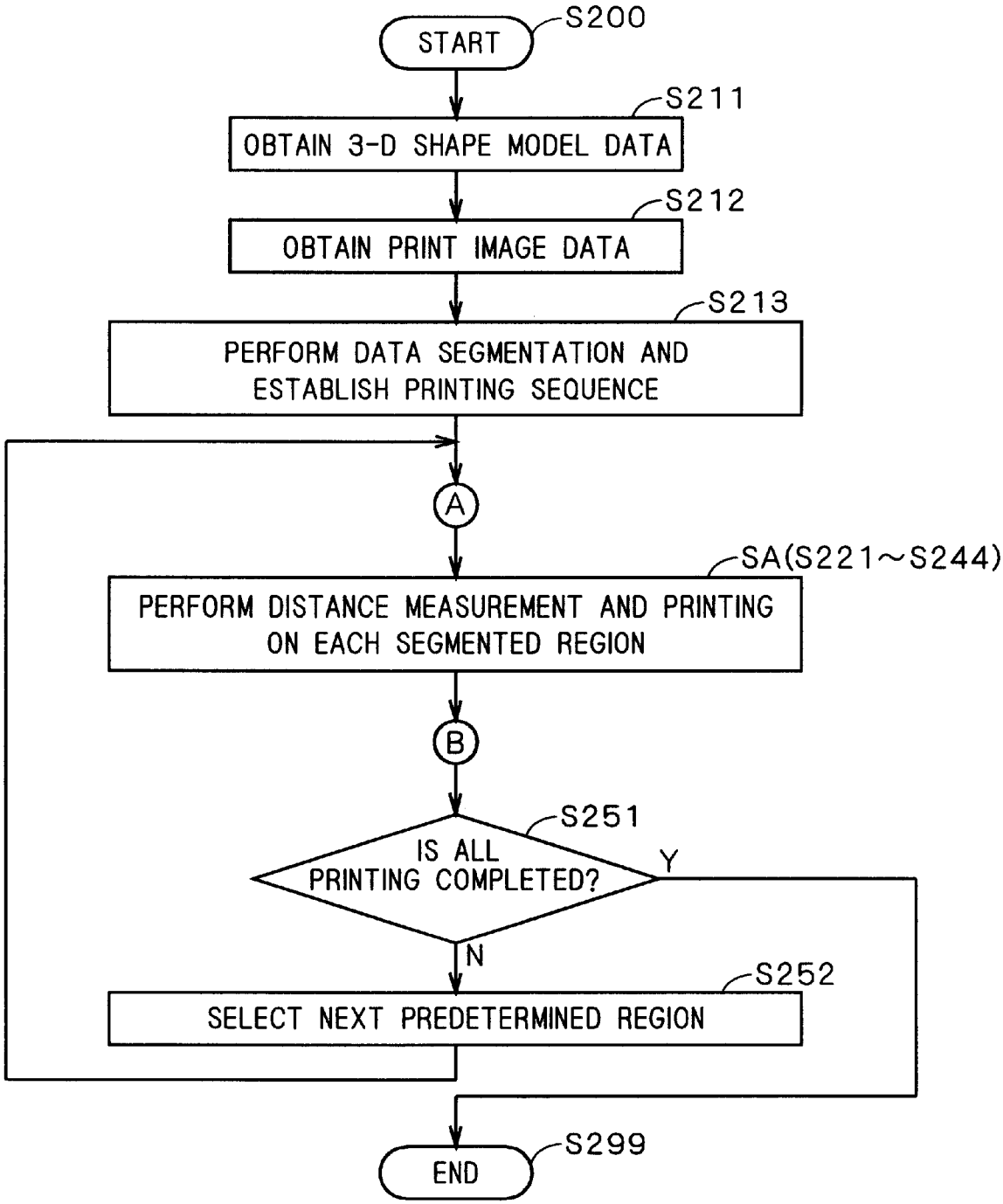
FIG. 25 is a flowchart showing the operation of the printing apparatus according to a third preferred embodiment of the present invention.

FIG. 25 is a flowchart showing the operation according to the third preferred embodiment.

Initially, in Step S200 of FIG. 25, the object 7 is fixed in predetermined position and direction on the turntable 341, and the printing operation is initiated.

Next, a corresponding file (including a description of the three-dimensional shape data about the object) stored in the memory 55 or the auxiliary storage 56 is opened to obtain the three-dimensional shape model data about the object (Step S211). Then, the print image data is obtained (Step S212). This step of obtaining the print image data is similar in operation to Step S122 (FIG. 20).

Based on the three-dimensional shape model data, the surface shape of the object 7 in the print area is approximated by n segmented regions (polygonal faces) (where n is an integer). Then, the sequence of distance measurement of the segmented regions (and the sequence of printing on the segmented regions) is established (Step S213). It is assumed that the faces A1, A2, A3, A4 and A5 shown in FIG. 21 are to be subjected to the distance measurement and printing in the sequence named.

Figure 26:
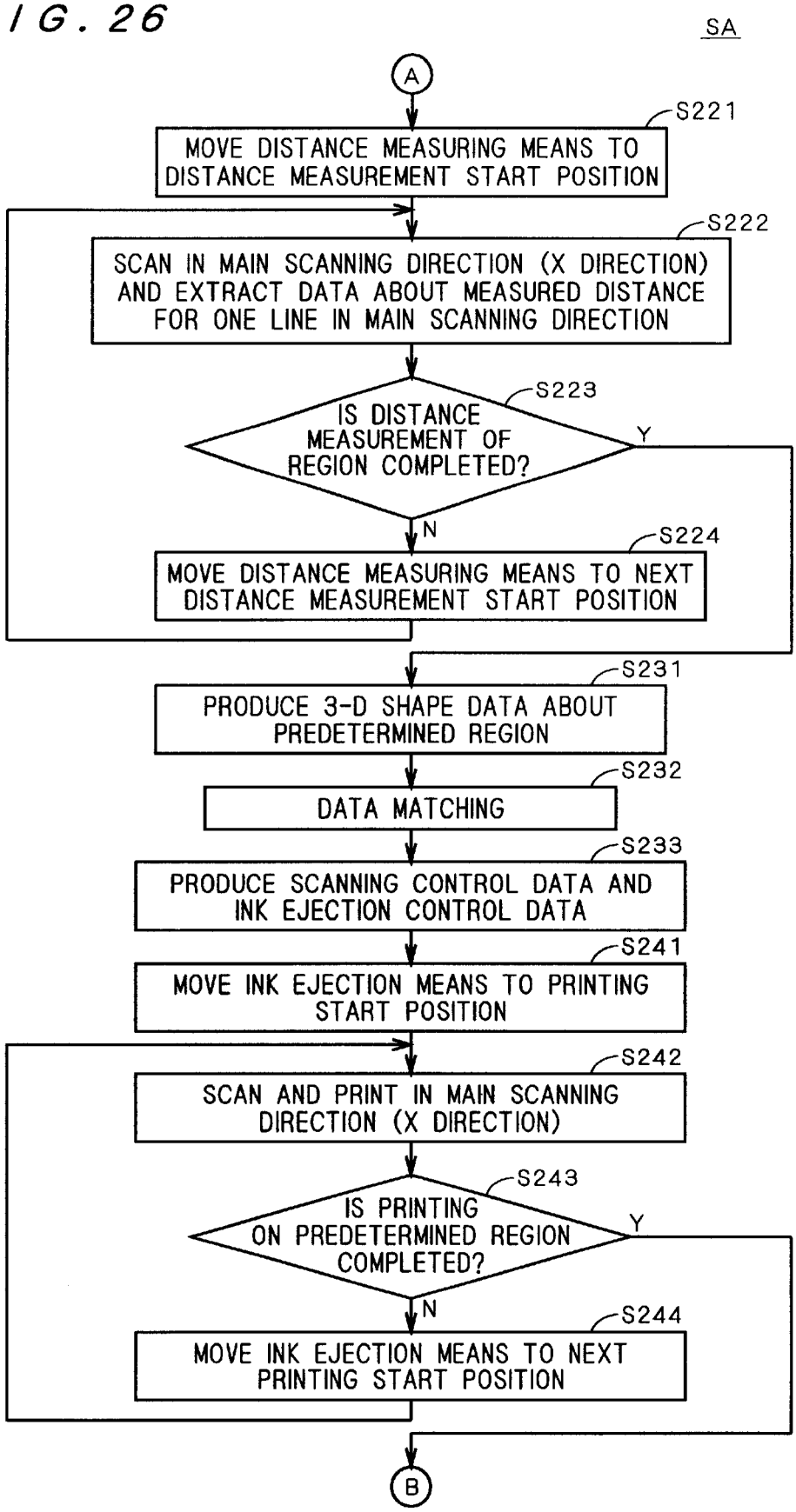
FIG. 26 is a flowchart regarding an operation included in the flowchart of FIG. 25.

When the segmented region having the face A1 is selected first as a target segmented region, the steps to be described below are performed on the segmented region having the face A1, as shown in FIG. 26.

In Step S221, the X-, Y-, Z- and R-direction scanning sections 31, 32, 33 and 34 are driven to move the shape measuring section 2 to the distance measurement start position (the point P1 for the face A1). The distance measurement of the target segmented region starts from the position P1, and the distance measurement is made on the face A1 (Steps S222 to S224). This operation of measurement is similar to that of the second preferred embodiment.

Next, the data obtained by the measurement is processed to produce the three-dimensional shape data about the measured region of the object 7 in a predetermined format (Step S231).

In Step S232, matching is performed between the actual three-dimensional shape data obtained in Steps S221 to S224 and Step S231 and the three-dimensional shape model data obtained in Step S211.

More specifically, the details of the matching operation are selectable depending on the level of reliability of the three-dimensional shape model data.

For example, when the three-dimensional shape model data has a low level of reliability (including the case where the three-dimensional shape model data is data about the overview of the object 7), the three-dimensional shape data produced based on the result of measurement may be used in place of the three-dimensional shape model data as reference data for printing operation for the segmented region of interest.

On the other hand, when the three-dimensional shape model data has a high level of reliability, the matching of data about the position and posture of the object 7 is performed by calculating the amount of deviation of the three-dimensional shape data (measured value) resulting from the result of measurement from the three-dimensional shape model data (theoretical value). The amount of deviation may be calculated by establishing correspondence between the coordinates of the three-dimensional shape model and the actual position obtained from the three-dimensional shape data, and thereafter the three-dimensional shape data may be rewritten in consideration for the amount of deviation from the three-dimensional shape model data (theoretical value). If the object 7 placed on the turntable 341 is deviated at a predetermined angle from a desired position, this process can correct the deviation to provide correct three-dimensional shape data. Such an adjustment provides higher-precision printing. Alternatively, the scanning section 3 (particularly the turntable 341 of the R-direction scanning section 34) may be driven to correct the angle of deviation of the three-dimensional shape data (measured value) from the three-dimensional shape model data (theoretical value) to make a fine adjustment so that the actual position of the object 7 conforms to the three-dimensional shape model data. Thereafter, the matching is performed between the three-dimensional shape data and the print image data, as in Step S123.

After the matching operation (Step S232), the scanning control data and the ink ejection control data are produced (Step S233), as in the second preferred embodiment. Produced in this step is the data about only the segmented region having been subjected to the distance measurement (the face A1 in this case) in the entire print area. Based on the produced data, the ink ejection head section 11 is moved to the printing start position (Step S241). The X-direction scanning section 31 is controlled, whereas the Z-direction scanning section 33 is also controlled to maintain the vertical clearance at the predetermined distance. Then, scanning for one line is performed in the main scanning direction. In synchronism with the scanning, the ink ejection nozzles 111N, 112N, 113N and 114N eject ink toward the region to be printed first, based on the above-mentioned data (Step S242). A judgment is made as to whether or not all of the printing on the predetermined region is completed (Step S243). If it is not judged that all of the printing is completed, the ink ejection head section 11 is moved to the printing start position of the next line (Step S244) to start printing in the next main scanning line. This printing operation is repeated until it is judged that all of the printing on the predetermined region is completed in Step S243. This completes the printing operation on the face A1 of the first target segmented region.

In step S251 (FIG. 25), a judgment is made as to whether or not printing on the entire print area is completed. In this case, since other segmented regions are left unprinted, the next segmented region A2 determined in Step S213 is selected as the target segmented region (Step S252). The flow returns to Step S221 to start the control.

The above described steps are repeated to perform similar operations of measurement and printing on the remaining segmented regions A3 to A5. A region containing no print data (or a region not to be printed) may be skipped.

If it is judged that printing is completed on all of the segmented regions in Step S299, the operation is terminated.

D. Fourth Preferred Embodiment

Figure 27:
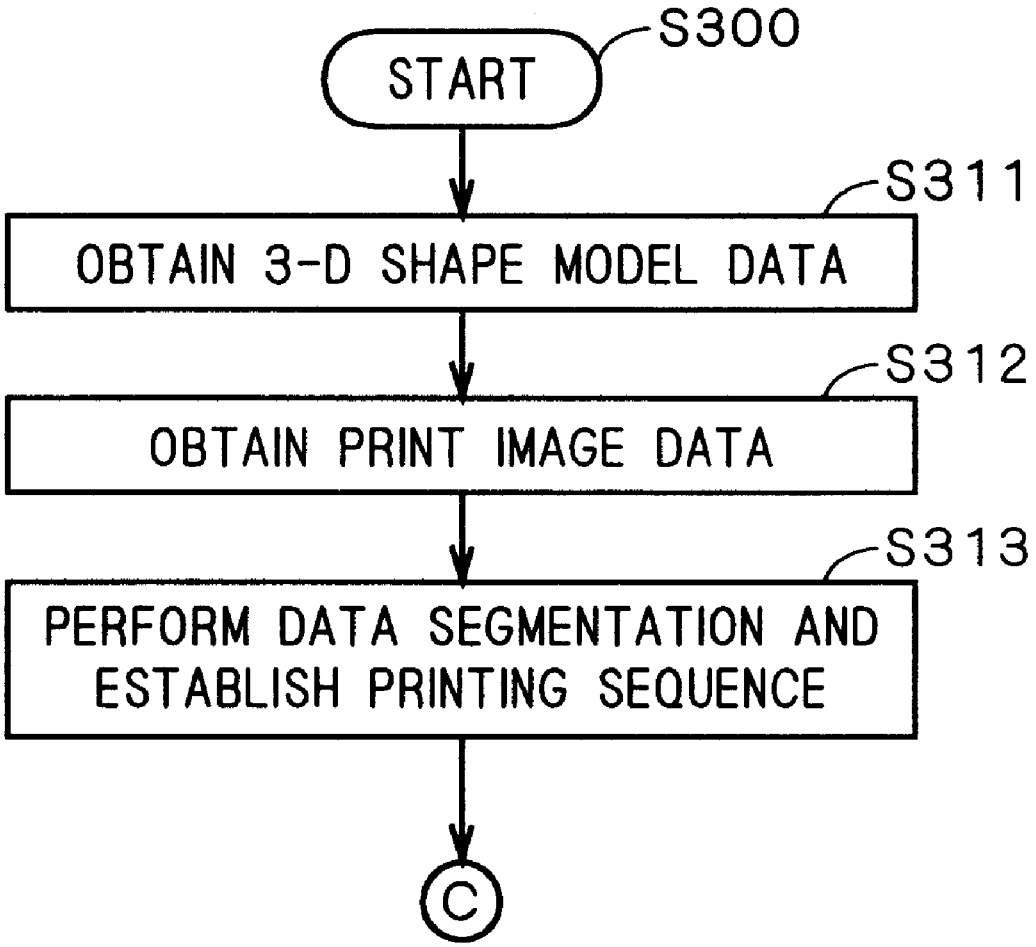
FIG. 27 is a flowchart showing the operation of the printing apparatus according to a fourth preferred embodiment of the present invention.
Figure 28:
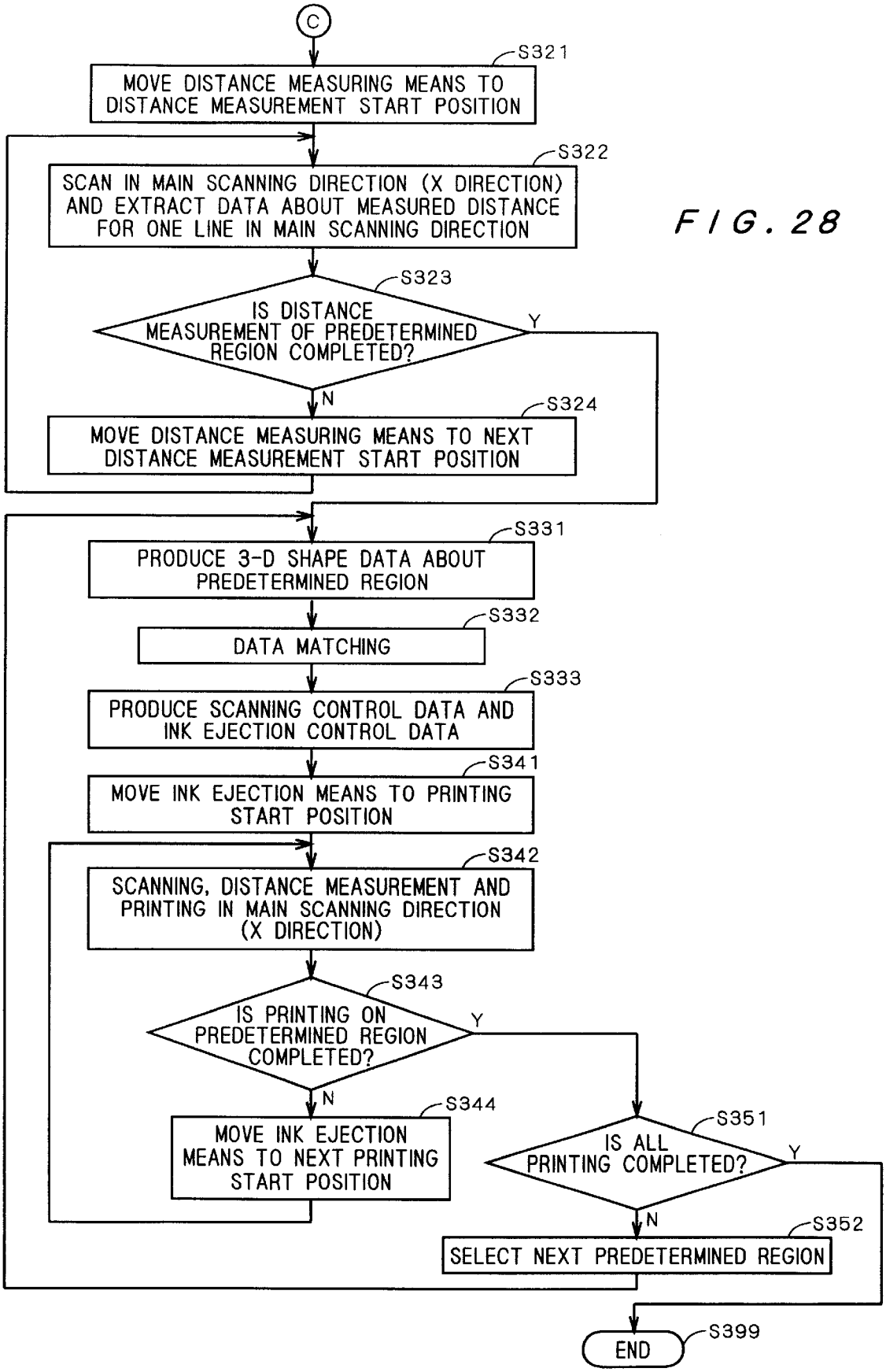
FIG. 28 is a flowchart regarding an operation included in the flowchart of FIG. 27.
Figure 29:
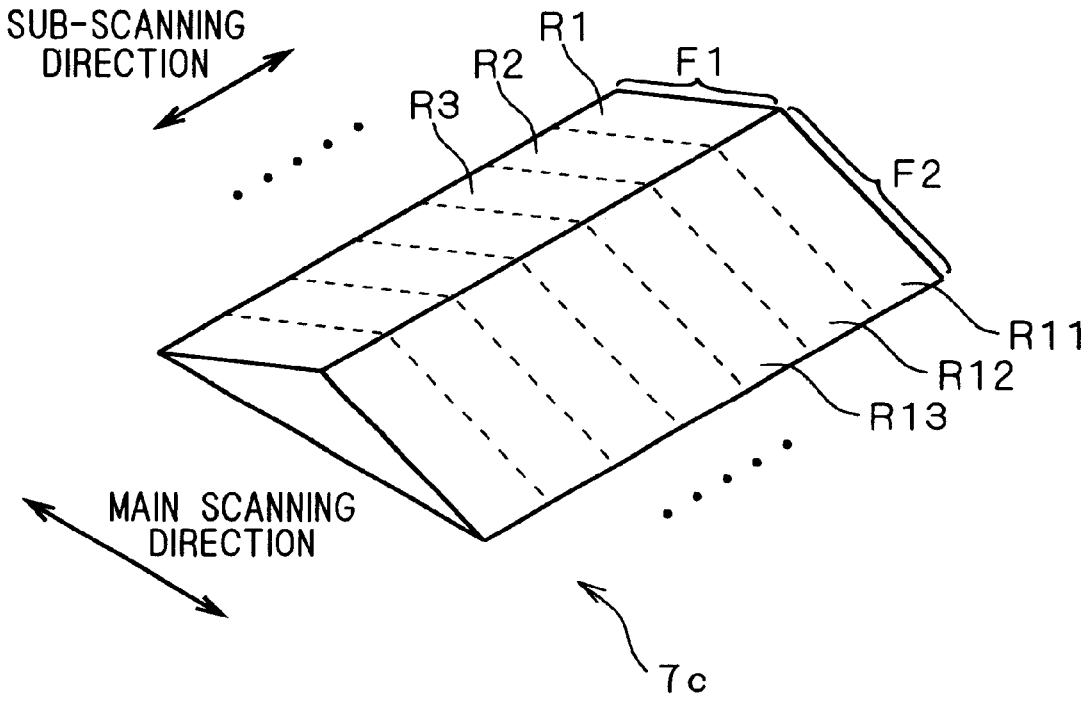
FIG. 29 is a perspective view of an object to be printed which has a triangular cross-sectional configuration.

A fourth preferred embodiment according to the present invention will be described. The fourth preferred embodiment is useful when the surface of the object 7 is less rugged in the sub-scanning direction to allow successive printing on a plurality of adjacent segmented regions arranged in the sub-scanning direction (or when the sequence of printing on the surfaces to be printed is not discrete but successive in one direction). For example, it is useful for printing on an object 7*c* having a triangular cross-sectional configuration, as illustrated in FIG. 29. The object 7*a* has two inclined surfaces F1 and F2 whose inclination does not change in the sub-scanning direction (Y direction). For purposes of simplification, the inclined surface F1 is selected as the print area among the two inclined surfaces F1 and F2, and is segmented into a plurality of rectangular regions (R1, R2, R3, . . . ) having a predetermined width in the sub-scanning direction. The operation will be described with reference to the flowcharts of FIGS. 27 and 28.

The step of starting the printing operation (Step S300) to the step of segmentation into the regions using the three-dimensional shape model data (Step S313) are similar to Steps S200 to S213 of the third preferred embodiment. In Step S313, the sequence of distance measurement of the segmented regions is established so as to be successive in the sub-scanning direction (Y direction). The sequence of distance measurement of the segmented regions is established as R1, R2, R3, . . . in this preferred embodiment. The sequence of printing on the segmented regions is identical with the sequence of distance measurement.

Figure 30A:
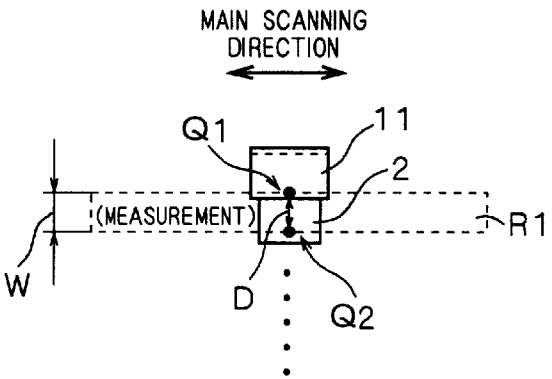
FIGS. 30A, 30B and 30C conceptually show the operation of the fourth preferred embodiment, FIG. 30A illustrating the operation of distance measurement being made on a first segmented region, FIG. 30B illustrating the operation of distance measurement being made on a second segmented region and the operation of printing being performed on the first segmented region, FIG. 30C illustrating the operation of distance measurement being made on a third segmented region and the operation of printing being performed on the second segmented region.

Then, as in the third preferred embodiment, the X-, Y-, Z- and R-direction scanning sections 31, 32, 33 and 34 are moved to the distance measurement start position (Step S321), and the distance information is obtained (Steps S322 to S324). The operation of distance measurement is performed on the first measurement target region R1. Based on the result of measurement, the three-dimensional shape data is produced (Step S331). FIG. 30A shows the operation of performing main scanning in the main scanning direction to make the distance measurement on the segmented region R1 by the shape measuring section 2. The matching is performed between the three-dimensional shape data and the three-dimensional shape model data to reflect the actual shape in the model, and the matching is performed between the three-dimensional shape data and the print image data (Step S332). In this step, a fine adjustment is made, as required, so that the actual orientation of the object 7 conforms to the three-dimensional position coordinates of the three-dimensional shape model. Then, the scanning control data and the ink ejection control data are produced (Step S333). Produced in this step is the data about only the segmented region R1 having been subjected to the distance measurement and to be printed currently. Based on the produced data, the ink ejection head section 11 is moved to the printing start position of the segmented region R1 in Step S341. The steps described hereinabove are similar to those of the third preferred embodiment.

Figure 31:
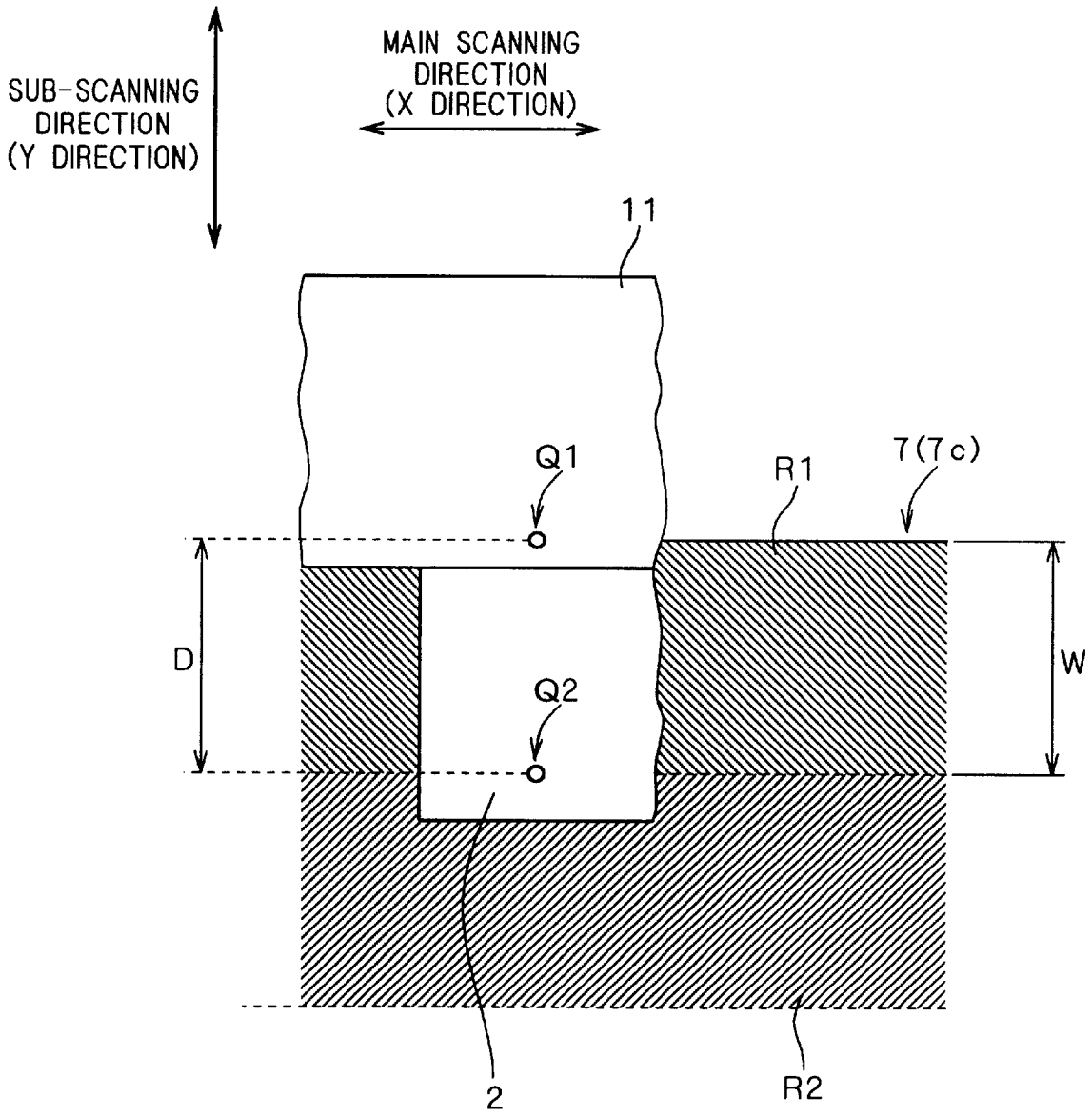
FIG. 31 conceptually shows the relationship between a distance measurement position and an ink striking position.

At this point, as illustrated also in FIG. 16, the distance measurement position of the shape measuring section 2 is spaced a predetermined distance from the ink striking position forwardly in the sub-scanning direction (Y direction). FIG. 31 conceptually illustrates such a positional relationship between the distance measurement position and the ink striking position. With reference to FIG. 31, a distance D between the ink striking position Q1 of the ink ejected from the ink ejection head section 11 and the distance measurement position Q2 of the shape measuring section 2 is determined by the positional relationship between the ink ejection section 1 and the shape measuring section 2 (displacement sensor) in the print head section H. Such a positional relationship may be utilized to simultaneously perform the printing and the distance measurement during the same scanning in the subsequent step (Step S342), thereby achieving efficient distance measurements in unprinted regions (segmented regions R2, R3, . . . ) forward of the printing target region. For purposes of simplification, the ink ejection head section 11 is shown in FIG. 31 as having a single-nozzle arrangement, with the width W of the segmented region R1 in the sub-scanning direction equaling the distance D in the sub-scanning direction between the distance measurement position and the ink striking position. In this case, at the time when the shape measuring section 2 moves to the measurement start position of the next segmented region R2 after the completion of the distance measurement of the segmented region R1, the ink ejection section 1 reaches the printing start position of the segmented region R1 having been measured (See FIG. 31).

Figure 30B:
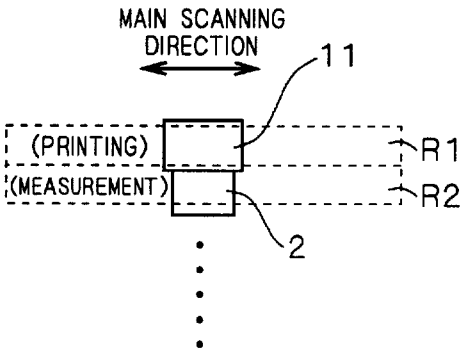

Next, printing is performed on the segmented region R1. While the Z-direction scanning section 33 is controlled to maintain the distance in the Z direction between the print head section H and the object 7 at a predetermined distance (e.g. maintain the above-mentioned minimum clearance at $r_0$), the X-direction scanning section 31 is controlled to scan one line in the main scanning direction (X direction). In synchronism with this operation, the C, M, Y and K ink ejection nozzles 111N, 112N, 113N and 114N eject ink toward the segmented region R1 serving as the first printing target region, based on the above-mentioned data. Additionally, in synchronism with this scanning operation, the ink ejection operation is performed, and the shape measuring section 2 make the distance measurement on the next segmented region R2 (Step S342). This measurement is made at a position which is spaced the predetermined distance D apart in the sub-scanning direction from the ink striking position used in printing on the segmented region R1. The distance D is determined by the arrangement in the print head section H as above described. The resultant measured distance data are sequentially stored in the memory 55 of the control section 5. FIG. 30B schematically shows such an operation in which while printing is performed on the segmented region R1, the measurement is made on the next segmented region R2.

Then, a judgment is made as to whether or not printing on the predetermined region (the segmented region R1 in this case) is completed (Step S343). If the printing is not completed, the above-mentioned scanning operation in the main scanning direction is repeated. In this case, the ink ejection head section 11 moves to the next printing start position (Step S344), and the printing of the next main scanning line and the measurement are initiated.

If it is judged in Step S343 that the printing on the region R1 is completed, a judgment is made as to whether or not printing on all of the segmented regions included in the entire print area is completed (Step S351). Since segmented regions to be printed remain unprinted in this case, the flow proceeds to Step S352 in which the next segmented region R2 is selected as a segmented region to be printed in accordance with the sequence determined in Step S313. At the same time, the next segmented region R3 is selected as a segmented region to be measured.

Figure 30C:
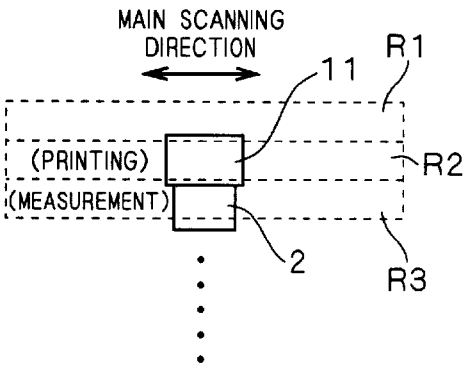

Next, the flow returns again to Step S331 in which the three-dimensional shape data about the segmented region R2 to be printed next which is selected in Step S352 is produced, and printing is performed on the segmented region R2 in the above-mentioned manner. FIG. 30C schematically shows such an operation in which while printing is performed on the segmented region R2, the measurement is made on the next segmented region R3.

Subsequently, similar operations are repeated in succession to sequentially measure and print on the segmented regions. If it is judged that all of the printing is completed in Step S351 during the repetition process, the control and operation are terminated (Step S399).

As described hereinabove, for printing on the three-dimensional object, the printing apparatus of this preferred embodiment simultaneously performs the operation of printing on a predetermined segmented region selected among the plurality of segmented regions and the operation of distance measurement of the segmented region adjacent to the predetermined segmented region, to enhance the efficiency of the operations of printing and measuring.

In the segmentation of the print area into the regions using the three-dimensional shape model data (or the establishment of the segmented regions) in Step S313, it is preferable that the width W of each segmented region in the sub-scanning direction is equal to or less than the distance D (See FIG. 31) in the sub-scanning direction between the distance measurement position of the shape measuring section 2 and the ink striking position of the ink ejection section 1. In the above-mentioned case, the surface F1 to be printed which has the same inclination in the Y direction is segmented into the plurality of regions R1, R2, R3, . . . each having the width W in the sub-scanning direction which satisfies the above condition, i.e., which is equals to the distance D in the sub-scanning direction between the distance measurement position of the shape measuring section 2 and the ink striking position of the ink ejection section 1 (W=D). In the case where W<D, the printing apparatus may be operated so that, at the time of completion of printing on the predetermined segmented region (e.g., the segmented region R1), the distance measurement position of the shape measuring section 2 reaches a position forward of the next region to be printed (e.g., the segmented region R2), and the distance measurement of at least one forward segmented region (e.g., the segmented region R2) is completed. Thus, the printing path is preferably planned also in Step S313 so that the distance measurement of at least one unprinted region is completed whenever it is judged in Step S343 that printing on the current printing target segmented region is completed. In this case, at the end of printing on the predetermined segmented region, the distance measurement of the next printing target segmented region is completed. This allows the flow to proceed without a break to Step S331 in which the three-dimensional shape data about the next printing target segmented region is produced based on the result of measurement.

Figure 32:
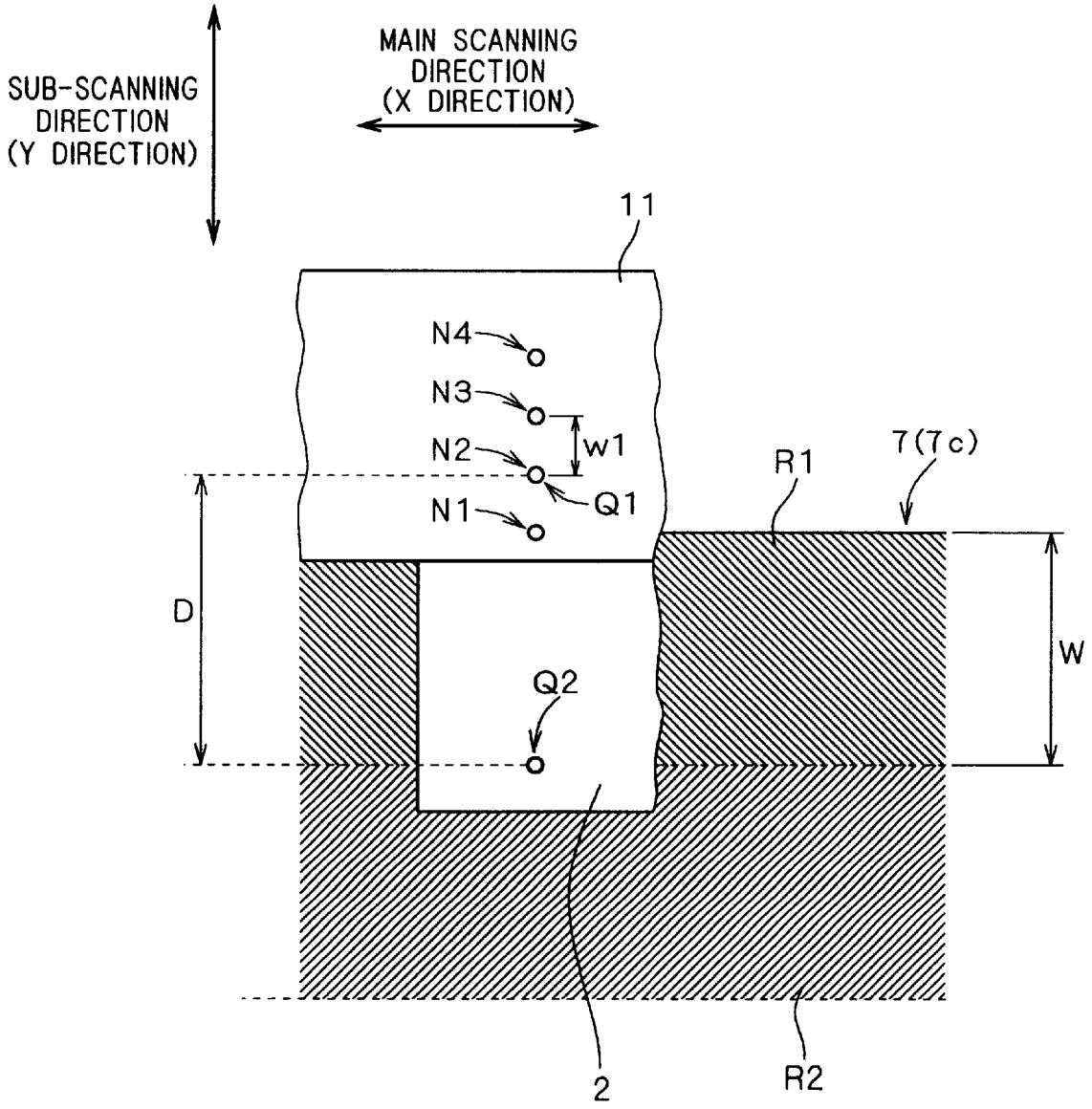
FIG. 32 conceptually shows the relationship between the distance measurement position and the ink striking position when a multi-nozzle arrangement is used.

For the multi-nozzle arrangement as illustrated in FIG. 32, a relationship to be described below should be considered regarding the distance D between the striking position Q1 of ink ejected from a nozzle N2 and the distance measurement position Q2 of the shape measuring section 2, the nozzle N2 being the nearest active nozzle to the shape measuring section 2 of all nozzles N1 to N4 in a nozzle array of the ink ejection head section 11. (The term "active nozzle" used herein means that the nozzle ejects ink.) In the illustration shown in FIG. 32, it is assumed that the nozzle Ni which is the nearest to the shape measuring section 2 of all of the nozzles in the nozzle array is disabled because of the circumstances described with reference to FIGS. 23A to 23D or the like.

With such a multi-nozzle arrangement, the printing operation throughout the width (w1×m) of the segmented region R1 is achieved by the scanning operation throughout the width w1 which involves multi-step (or plural) movements in the sub-scanning direction, where m is the number of active nozzles arranged in a linear array in the sub-scanning direction, for example m=3 when three nozzles N2, N3 and N4 eject ink. Thus, the start of the printing operation on the object in the case of the multi-nozzle arrangement may lag a distance (w1×(m−1)) in the sub-scanning direction behind the start of the printing operation in the case of the single-nozzle arrangement (in other words, the printing operation in the case of the multi-nozzle arrangement may start after the ink ejection head section 11 moves the distance (w1×(m−1)) into the printing target segmented region). Therefore, when m nozzles eject ink, the distance measurement position Q2 of the shape measuring section 2 is required to be present a distance (W−w1×(m−1)), rather than the distance W, farther forward than the striking position Q1 of ink ejected from the ink ejection head section 11 which is the nearest to the shape measuring section 2. Preferably, the width W is set so that the distance D is not less than the distance (W−w1×(m−1)). In other words, the width W of each segmented region in the sub-scanning direction is set at a value (D+w1×(m−1)) or smaller. In general, W=w1×m, in which case (W−w1×(m−1))=w1. In view of the case where all of the nozzles are used, m is defined as the maximum number of nozzles.

The multi-nozzle arrangement requires not only the scanning operation which involves the simultaneous operations of printing and measurement but also the scanning operation to be performed only for the operation of measurement. However, the operations of measurement and printing are performed concurrently during the scanning operation throughout the width w1 included in the entire width (w1×m) in the sub-scanning direction. This is also efficient in operation.

Although only the inclined surface F1 is selected as the print area in the above description for purposes of simplification, the other inclined surface F2 may be additionally selected as the print area. In this case, the inclined surface F2 may be segmented into a plurality of rectangular regions (R11, R12, R13, . . . ) having a predetermined width in the sub-scanning direction, and similar processes may be performed.

E. Modifications

Although the preferred embodiments of the present invention have been described hereinabove, the present invention is not limited to the above description.

E1. Fine Pitch p

For example, the fine pitch p serving as the minimum unit of distance the ejection head 50 is driven to move in the sub-scanning direction Y is set at p=d/10 based on the spacing d between the dots to be formed on the surface of the object 9 in the first preferred embodiment and the like. However the fine pitch p is not limited to this value.

Setting the fine pitch p at a smaller value, e.g., p=d/100 reduces the error of the spacing in the sub-scanning direction Y between the dots printed on the inclined surface, thereby to allow the spacing between the dots printed on the inclined surface to more precisely approach the spacing d between the dots printed on the horizontal surface. In other words, setting the fine pitch p at a smaller value provides an accordingly higher level of uniformity of the dots in the sub-scanning direction to achieve higher-definition printing.

On the other hand, setting the fine pitch p at a smaller value causes an accordingly smaller amount of stepwise movement of the ejection head 50 in the sub-scanning direction Y, resulting in the reduction in printing efficiency.

It is therefore preferable that a setting of the minimum unit of distance the ejection head 50 is driven to move by the sub-scanning direction driver 20 is freely changeable, and the controller 43 determines the fine pitch p to be set for the printing operation in accordance with a print quality and a printing velocity which are desired by a user, to transmit the fine pitch p to the sub-scanning direction driver 20. This provides a user-intended balance between the print quality and the printing velocity which are in trade-off relationship.

E2. Re-measurement

In the second preferred embodiment, one operation of measurement is performed for each of the positions of the object 7 to produce the three-dimensional shape data. However, the present invention is not limited to this. An additional measurement (a total of at least two measurements) may be made on some regions to measure the surface shape of the object 7, thereby obtaining the three-dimensional shape data.

Figure 33:
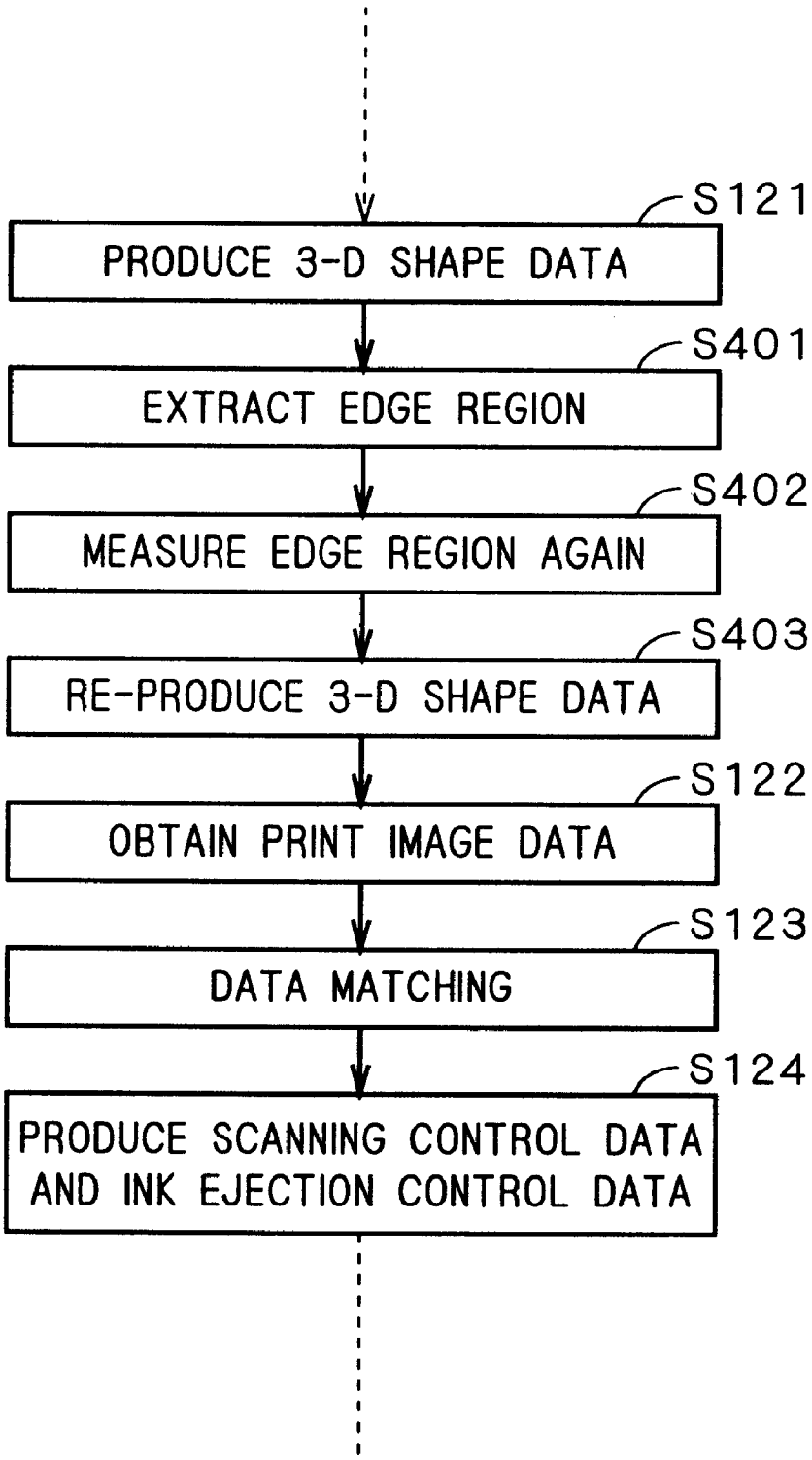
FIG. 33 is a flowchart showing the operation of the printing apparatus according to a modification of the present invention.

FIG. 33 is a flowchart showing such a modification of the operation. Only the steps to which modification is made in the flowchart of FIG. 20 are illustrated in FIG. 33. Steps S121, S122, S123 and S124 of FIG. 33 are similar in operation to those of FIG. 20. The flowchart shown in FIG. 33 includes steps (Steps S401, S402 and S403) different in operation from the flowchart of FIG. 20 between Steps S121 and S122.

More specifically, after the three-dimensional shape data is produced based on the result of the first measurement (Step S121), an edge region is extracted based on the three-dimensional shape data (Step S401). The second measurement is made on the extracted edge region (Step S402). Thereafter, the three-dimensional shape data is reproduced based on the second measurement (Step S403). The subsequent steps may be performed based on the re-produced three-dimensional shape data.

The second measurement (Step S402) can provide more detailed data. The second measurement is preferably higher in precision than the first measurement. Such a higher-precision measurement is achieved by slower scanning in the main scanning direction and/or by scanning in the sub-scanning direction using a smaller travel distance.

This modification can provide more precise three-dimensional shape data about the edge region to correctly assign the print image data obtained in Step S122 to a desired position of the object 7. Additionally, since the printing operation (Steps S131 to S134) are performed based on the more precise three-dimensional shape data, a desired image may be printed in a correct position on the object 7.

In particular, if there are changes in pattern, texture and color in the edge region of the printing image, a print deviation in the edge region remarkably deteriorates the quality of the printing process. In such a case, the above-mentioned re-measurement is applied to suppress the print deviation in the edge region to achieve a high-quality printing process.

Regions to be selected for the second measurement (or regions requiring more detailed three-dimensional shape) include a surface-to-surface junction such as the above-mentioned edge, a boundary line and an end point of the print area, and a region including other characteristic points.

In the third and fourth preferred embodiments, the three-dimensional shape data (three-dimensional shape model data) is obtained before the start of the measurement. Thus, the printing apparatus may extract the edge region based on the three-dimensional shape data (three-dimensional shape model data), and perform slower main scanning or sub-scanning using a smaller travel distance in the edge region than in other regions during the operation of distance measurement in Steps S221 to S224 (FIG. 26), thereby to obtain more detailed shape data. In this case, the measurement for obtaining higher precision (more detailed) data requires longer time. However, the increase in length of time for measurement may be minimized by restricting the region to be measured for such more detailed data to a particular region such as the edge region.

E3. Shape Measuring Section 2

Figure 34:
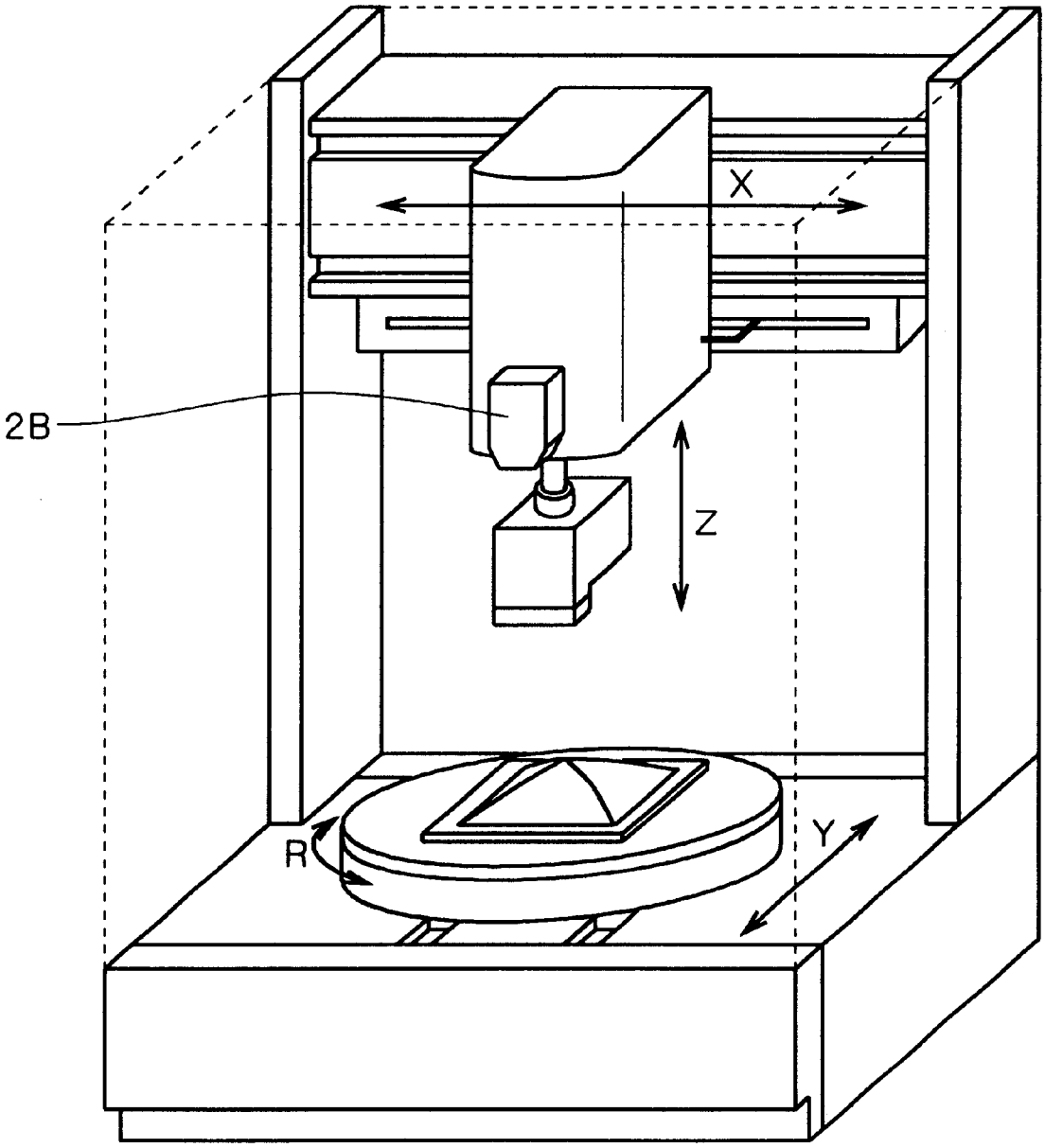
FIG. 34 shows a modification of a displacement sensor mounting position.

Although the displacement sensor of the shape measuring section 2 is mounted as part of the print head section H to the output shaft 331 of the Z-direction scanning section 33 in the above preferred embodiments, the present invention is not limited to such an arrangement. For example, if the shape measuring section 2 has a sufficiently wide detectable distance range and includes a displacement sensor of a long distance detection type, a modification as illustrated in FIG. 34 may be used in which the shape measuring section 2 includes a displacement sensor 2B mounted on a side surface of the Z-direction scanning section 33 so as not to move in the Z direction. The printing method of the present invention is also implemented by such a modification.

In the above preferred embodiments, the displacement sensor of the shape measuring section 2 is a sensor for detecting the distance between the surface of the object at a position (point) to which a spot light is projected and the sensor. However, the present invention is not limited to this. A displacement sensor capable of simultaneously obtaining distance information about a plurality of positions may be employed.

For example, a two-dimensional scanning type optical sensor (referred to hereinafter as a "first type two-dimensional displacement sensor") containing a mechanism (e.g., a rotary polygon mirror) for scanning in the X direction the spot light directed from the phototransmitter 21 onto the object 7 may be used as the shape measuring section 2. The first type two-dimensional displacement sensor detects position information (X coordinate values) about points of measurement irradiated with the spot light and arranged in the scanning direction (X direction) and information about the distances in the Z direction obtained by the above-mentioned method in combination, thereby to provide two-dimensional position information about an X-Z plane including the line scanned by the spot light and extending in the X direction.

Alternatively, a displacement sensor (referred to hereinafter as a "second type two-dimensional displacement sensor") may be used which comprises the phototransmitter 21 for emitting slit laser light and the photoreceiver 22 including an area sensor (CCD, PSD or the like) and which uses the light-section method to obtain the two-dimensional position information about an X-Z plane from the light diffuse-reflected from the surface of the object 7. The second type two-dimensional displacement sensor obtains the two-dimensional position information about the X-Z plane, based on the triangulation technique.

The use of the first or second type two-dimensional displacement sensor eliminates the need to cause the shape measuring section 2 to scan in the X direction for the measurement within its measurable range, to reduce the time required for measurement. For measurement beyond the measurable range of the displacement sensor in the X direction, the operation of moving the displacement sensor to a predetermined measurement position may be intermittently repeated several times, thereby providing the two-dimensional position information about the X-Z plane. Therefore, there is no need to cause the shape measuring section 2 to scan continuously in the X direction.

Figure 35:
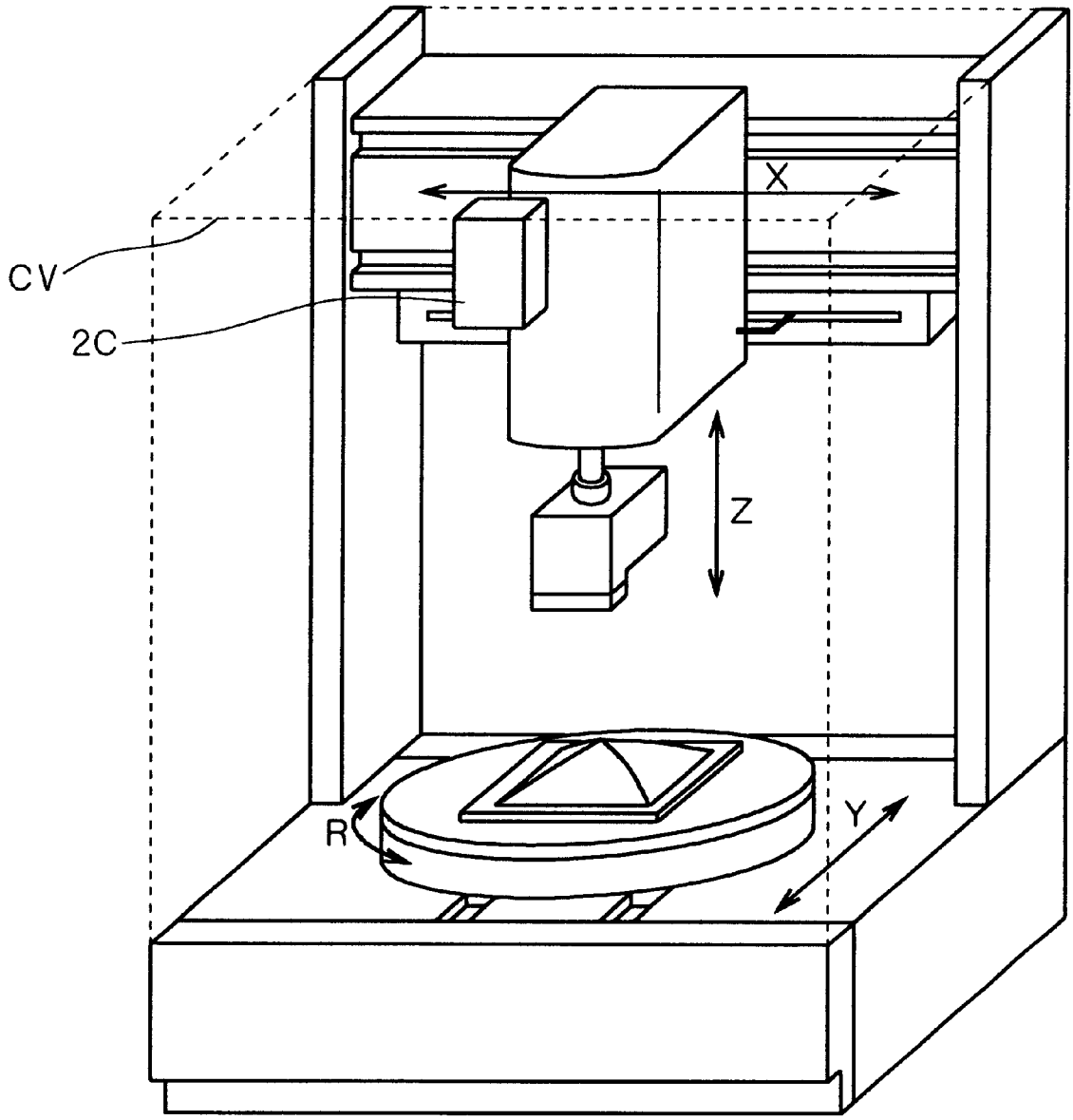
FIG. 35 shows another modification of the displacement sensor mounting position.
Figure 36A:
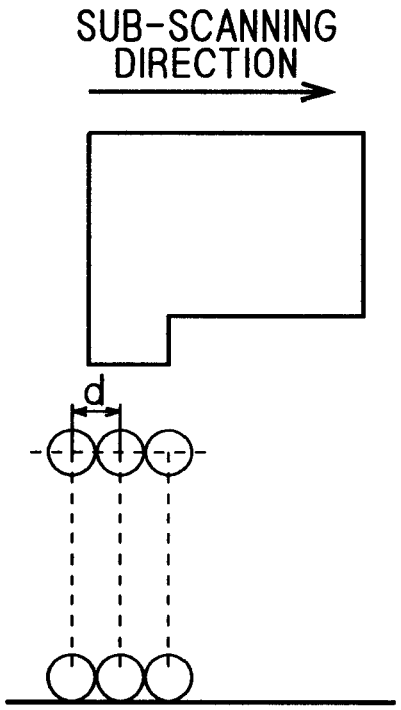
FIGS. 36A and 36B show a conventional method of printing on a three-dimensional object, FIG. 36A illustrating a dot distribution when printed on a horizontal surface, FIG. 36B illustrating a dot distribution when printed on an inclined surface.
Figure 36B:
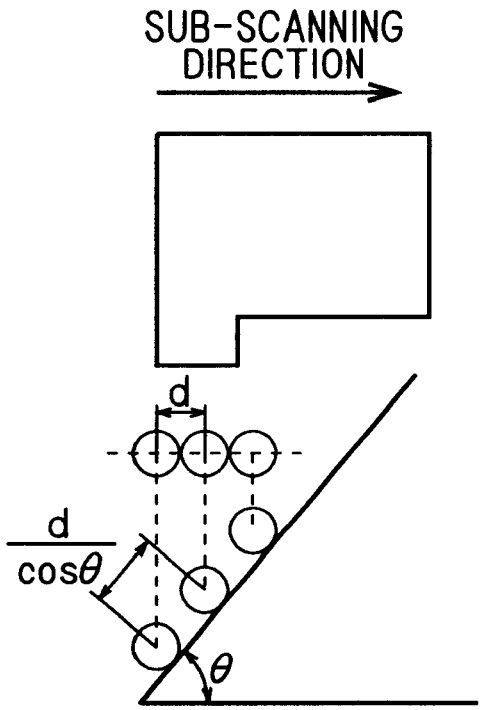

When the first or second type two-dimensional displacement sensor having a long measurable distance range in the Z direction is used as the displacement sensor of the shape measuring section 2, there is no need to cause the displacement sensor itself to scan in the X direction. Additionally, the movement of the object 7 and the print head section H relative to each other is accomplished by driving the object 7 in the Y direction, as in the printing apparatus 100B. In such a case, a displacement sensor 2C may be mounted to an immovable component such as the cover CV, as illustrated in FIG. 35, to achieve a similar operation of measurement.

The shape measuring section 2 including the first or second type two-dimensional displacement sensor may be provided in an orientation rotated 90° from the position shown in FIG. 16 or 34 about the Z axis, in which case two-dimensional position information about a Y-Z plane is obtained without scanning in the Y direction.

The second type two-dimensional displacement sensor may be developed into a mechanism capable of scanning the slit light emitted from the phototransmitter 21 in a direction (e.g., the Y direction) perpendicular to a sectional plane (e.g., the X-Z plane). This mechanism can determine the thee-dimensional shape of the surface of the object 7 by the use of only the sensor itself, based on the information (Y coordinate value) about the positions arranged in the scanning direction and the detected two-dimensional position information (about the X-Z plane) (an example of which is a non-contacting three-dimensional shape input machine available as VIVID700 and the like from MINOLTA CO., LTD.). In such a mechanism, if the displacement sensor of the shape measuring section 2 has a sufficiently wide detectable range in the Z direction and can detect a distance from a sufficiently distant position, the displacement sensor may be fixed in a position shown in FIG. 35 to detect the three-dimensional shape of the surface of the object 7 without moving the scanning section 3. The three-dimensional shape measuring sensor is not limited to those of the above-mentioned types but may be of other types. For example, sensors for measuring the three-dimensional shape of the object 7 by the techniques of the stereo method, the moiré method and interferometry may be used.

In the above-mentioned preferred embodiments, the shape measuring section 2 includes the displacement sensor which obtains the distance information about each single point on the surface of the object 7 and which is caused to scan for measurements. However, the use of the above-mentioned two-dimensional displacement sensors and three-dimensional shape measuring sensors changes the flowcharts of FIGS. 20, 26 and 28 more or less.

For example, a two-dimensional displacement sensor for measuring a distance in the X-Z plane, when used, does not need the scanning operation in the main scanning direction in Steps S112, S222 and S322 but can make the measurement on the X-Z plane while standing still in a predetermined position. The same is true for the measurement in Step S342.

The use of a two-dimensional displacement sensor for measuring a distance in the Y-Z plane, which can obtain all of the information about the Y direction during one operation of distance measurement, eliminates the need to provide Steps S113 and S114 in the second preferred embodiment (FIG. 20). Even if a plurality of operations of distance measurement are required for the displacement sensor to obtain all of the information about the Y direction (e.g., when a short length is measured in the Y direction or when interpolation is needed because of a wide pitch of measurement), this two-dimensional displacement sensor can reduce the number of times of movement in Steps S114, S224 and S324 of the second, third and fourth preferred embodiments, as compared with the sensor which measures a distance at one point during one operation of distance measurement. The distance measurement in Step S342 which are made at a plurality of positions during one operation of main scanning may be performed when required between Steps S342 and S344.

When the shape measuring section 2 includes a three-dimensional measuring sensor capable of measuring the shape of the entire area to be distance-measured during one operation of measurement without the need to cause the sensor itself to scan, the Steps S112, S113, S114 of the second preferred embodiment (FIG. 20) are replaced with one step of measuring the three-dimensional shape. Even if a plurality of operations of distance measurement are required to measure the shape of the entire region to be distance-measured (e.g., when a distance measurable range is small), this sensor can reduce the number of times of operations in Steps S112, S114, Steps S222, S224 and Steps S322, S324 of the second, third and fourth preferred embodiments, as compared with the sensor which measures a distance at one point during one operation of distance measurement. The same is true for the distance measurement in Step S342.

In the third and fourth preferred embodiments, the object 7 is fixed in the predetermined position and orientation on the turntable 341 before the printing is initiated. The third and fourth preferred embodiments, however, are adaptable for the printing with the object 7 mounted in a position (and/or orientation) different from the intended position (and/or orientation).

More specifically, starting from the mechanical home position, the distance measurement is made on a region large enough to obtain the characteristic of the object. Next, the three-dimensional shape data about the region is produced, and matching is performed between the produced three-dimensional shape data and the prepared three-dimensional shape model data, whereby the position and orientation of the object 7 are grasped. Based on the result of detection of the position, the scanning section 3 is controlled to change the orientation of the object 7 or to change the distance measurement start position. Alternatively, the data may be rewritten by bringing the coordinates of the three-dimensional shape model into correspondence with the actual position of the object 7. These steps may be additionally executed, for example, after Step S211 in the third preferred embodiment or after Step S311 in the fourth preferred embodiment.

In the above-mentioned preferred embodiments, the scanning section 3 has three degrees of freedom of linear movement and one degree of freedom of rotation. However, the printing apparatus according to the present invention may be equipped with three or more degrees of freedom of linear movement and three or more degrees of freedom of rotation to serve as a general-purpose printing apparatus. On the contrary, the number of degrees of freedom may be reduced to limit the uses of the printing apparatus.

While the invention has been described in detail, the foregoing description is in all aspects illustrative and not restrictive. It is understood that numerous other modifications and variations can be devised without departing from the scope of the invention.

We claim:

1. An apparatus for providing ink to a surface of a three-dimensional object, comprising:

a shape recognition section for obtaining data about a surface shape of a three-dimensional object;

an ejection section for ejecting ink toward said three-dimensional object;

a scanning section for causing said ejection section to scan relative to said three-dimensional object; and a control section for controlling an operation of said ejection section and/or said scanning section in accordance with information about inclination of the surface of said three-dimensional object, said information being indicated in said data obtained by said shape recognition section, wherein the scanning section causes scanning operations in an x direction and a y direction, and the information about inclination is information about inclination with respect to xy planes.

2. The apparatus according to claim 1, wherein said scanning section performs a plurality of continuous main scanning operations in a predetermined direction, and repeats a sub-scanning operation for each of said continuous main scanning operations, and wherein the operation of said scanning section controlled by said control section is said sub-scanning operation.

3. The apparatus according to claim 1, wherein said ejection section comprises a plurality of nozzles for ejecting ink, and wherein the operation of said ejection section controlled by said control section includes making a predetermined one of said plurality of nozzles available or unavailable.

4. The apparatus according to claim 3, wherein said control section makes said predetermined one of said plurality of nozzles available or unavailable in accordance with a distance between said predetermined one of said plurality of nozzles and the surface of said three-dimensional object.

5. The apparatus according to claim 4, wherein said control section makes said predetermined one of said plurality of nozzles unavailable when the distance between said predetermined one of said plurality of nozzles and the surface of said three-dimensional object is not less than a predetermined value.

6. The apparatus according to claim 1, further comprising an image data obtaining section for obtaining image data about an image to be presented on the surface of said three-dimensional object, wherein said control section controls said ejection section and said scanning section so that said image data is presented on the surface of said three-dimensional object.

7. The apparatus according to claim 1, wherein said shape recognition section measures the surface shape of said three-dimensional object to obtain said data about the surface shape of said three-dimensional object, and wherein said shape recognition section measures an edge part of said three-dimensional object more precisely than other parts.

8. The apparatus according to claim 1, wherein said shape recognition section comprises a sensor for measuring the surface shape of said three-dimensional object to obtain said data about the surface shape of said three-dimensional object, and wherein said sensor is caused to scan the surface of said three-dimensional object along with said ejection section by said scanning section in order to determine the height of a predetermined point on the surface of said three-dimensional object with respect to a predetermined reference plane.

9. The apparatus according to claim 8, wherein said predetermined reference plane is perpendicular to a direction in which said ejection section ejects ink, and wherein said scanning section causes said sensor to scan in two directions parallel to said reference plane.

10. The apparatus according to claim 1, wherein said ejection section performs an operation of ejecting ink toward said three-dimensional object for each polygon of a polyhedron by which the surface shape of said three-dimensional object is approximated.

11. The apparatus according to claim 10, wherein the surface shape of said three-dimensional object is approximated by said polygons, based on previously given three-dimensional shape model data.

12. The apparatus according to claim 11, wherein the data obtainment of said shape recognition section, the ink ejection of said ejection section and the scanning of said scanning section are performed for each of said polygons.

13. The apparatus according to claim 1, wherein said shape recognition section comprises a sensor for measuring the surface shape of said three-dimensional object to obtain said data about the surface shape of said three-dimensional object, and wherein said sensor performs an operation of measuring three-dimensional shape data about said three-dimensional object for each polygon of a polyhedron by which the surface shape of said three-dimensional object is approximated.

14. The apparatus according to claim 13, wherein said surface shape of said three-dimensional object is approximated by said polygons, based on previously given three-dimensional shape model data.

15. The apparatus according to claim 8, wherein the ink ejection of the ejection section and the measurement of said sensor are performed simultaneously while the scanning section causes said ejection section and said sensor to scan.

16. The apparatus according to claim 1, wherein said ejection section comprises at least one nozzle for ejecting ink, and wherein said control section controls the operations of said ejection section and said scanning section to thereby control ejection positions of said ejection section.

17. The apparatus according to claim 16, wherein said scanning section comprises a main scanning section for moving said ejection section continuously in a predetermined main scanning direction, and a sub-scanning section for moving said ejection section stepwise every predetermined travel pitch in a sub-scanning direction perpendicular to said main scanning direction.

18. The apparatus according to claim 17, wherein said control section controls a travel velocity of said main scanning section in said main scanning direction in accordance with inclination of said three-dimensional object with respect to said main scanning direction.

19. The apparatus according to claim 17, wherein said control section controls ink ejection timing of said ejection section in accordance with inclination of said three-dimensional object with respect to said main scanning direction.

20. The apparatus according to claim 17, wherein said control section controls said travel pitch of said sub-scanning section in said sub-scanning direction in accordance with inclination of said three-dimensional object with respect to said sub-scanning direction.

21. The apparatus according to claim 20, wherein said control section moves said ejection section stepwise every fine pitch in said sub-scanning direction, and controls said main scanning section to effect main scanning at a position at which the amount of movement of said ejection section in said sub-scanning direction equals said travel pitch.

22. The apparatus according to claim 21, wherein said travel pitch is variable.

23. The apparatus according to claim 17, wherein, when said ejection section ejects ink toward a surface inclined with respect to a plane parallel to said main scanning direction and said sub-scanning direction, said control section shortens an interval between said ejection positions in accordance with the degree of inclination of said surface.

24. The apparatus according to claim 16, wherein said control section controls the ejection operation for each polygon of a polyhedron by which the surface shape of said three-dimensional object is approximated.

25. The apparatus according to claim 17, wherein said at least one nozzle includes a plurality of nozzles arranged in an array for ejecting ink, and wherein said scanning section further comprises a rotative scanning section for rotating a direction in which said plurality of nozzles are arranged within a plane parallel to said main scanning direction and said sub-scanning direction.

26. The apparatus according to claim 24, wherein said ejection section further comprises a plurality of nozzle array members each including said array of nozzles, each of said plurality of nozzle array members being in one piece for each ink type, and wherein said ejection section further comprises a linkage mechanism for coupling said plurality of nozzle array members with each other to prevent a positional relationship of said nozzles between said nozzle array members from deviating in said sub-scanning direction because of the rotation of said rotative scanning section.

27. A method of providing ink to a surface of a three-dimensional object, comprising the steps of:

(a) obtaining data about a surface shape of a three-dimensional object; and (b) causing an ejection section to eject ink toward said three-dimensional object while causing said ejection section to scan relative to said three-dimensional object in accordance with information about inclination of the surface of said three-dimensional object, said information being indicated in said data obtained in said step (a),wherein the scanning section causes scanning operations in an x direction and a y direction, and the information about inclination is information about inclination with respect to xy planes.

28. The method according to claim 27, wherein, in said step (b), a plurality of continuous main scanning operations are performed in a predetermined direction, and a sub-scanning operation is repeated for each of said continuous main scanning operations, said sub-scanning operation being controlled in accordance with said information about the inclination of the surface of said three-dimensional object.

29. The method according to claim 27, wherein said ejection section comprises a plurality of nozzles for ejecting ink, and wherein said ejection section is controlled to make a predetermined one of said plurality of nozzles available or unavailable in said step (b).

30. The method according to claim 27, wherein said data about the surface shape of said three-dimensional object is obtained in said step (a) by a sensor for measuring the surface shape of said three-dimensional object, and wherein said sensor is caused to scan the surface of said three-dimensional object along with said ejection section in order to determine the height of a predetermined point on the surface of said three-dimensional object with respect to a predetermined reference plane.

31. The method according to claim 27, wherein an operation of ejecting ink toward said three-dimensional object is performed by said ejection section for each polygon of a polyhedron by which the surface shape of said three-dimensional object is approximated.

32. The method according to claim 27, wherein said data about the surface shape of said three-dimensional object is obtained in said step (a) by a sensor for measuring the surface shape of said three-dimensional object, and wherein an operation of measuring three-dimensional shape data about said three-dimensional object is performed by said sensor for each polygon of a polyhedron by which the surface shape of said three-dimensional object is approximated.

33. The method according to claim 27, wherein said ejection section comprises at least one nozzle for ejecting ink.

34. The method according to claim 33, wherein, in said step (b), main scanning for moving said ejection section continuously in a predetermined main scanning direction, and sub-scanning for moving said ejection section stepwise every predetermined travel pitch in a sub-scanning direction perpendicular to said main scanning direction are performed, and a travel velocity of said main scanning in said main scanning direction is controlled in accordance with inclination of said three-dimensional object with respect to said main scanning direction.

35. The method according to claim 33, wherein, in said step (b), main scanning for moving said ejection section continuously in a predetermined main scanning direction, and sub-scanning for moving said ejection section stepwise every predetermined travel pitch in a sub-scanning direction perpendicular to said main scanning direction are performed, and ink ejection timing of said ejection section is controlled in accordance with inclination of said three-dimensional object with respect to said main scanning direction.

36. The method according to claim 33, wherein, in said step (b), main scanning for moving said ejection section continuously in a predetermined main scanning direction, and sub-scanning for moving said ejection section stepwise every predetermined travel pitch in a sub-scanning direction perpendicular to said main scanning direction are performed, and said travel pitch of said sub-scanning in said sub-scanning direction is controlled in accordance with inclination of said three-dimensional object with respect to said sub-scanning direction.

37. The method according to claim 36, wherein said ejection section is moved stepwise every fine pitch in said sub-scanning direction, and said main scanning is controlled to be effected at a position at which the amount of movement of said ejection section in said sub-scanning direction equals said travel pitch.

38. The method according to claim 33, wherein said at least one nozzle includes a plurality of nozzles arranged in an array for ejecting ink, and wherein the scanning in said step (b) is performed by a rotative scanning section for rotating a direction in which said plurality of nozzles are arranged within a plane parallel to said main scanning direction and said sub-scanning direction.

39. The apparatus according to claim 17, wherein said control section controls said scanning section and/or said ejection section so that ink is stained at equal spaces with the surface of said three-dimensional objection.

* * * * *